US011994309B2

(12) United States Patent
Bak et al.

(10) Patent No.: US 11,994,309 B2
(45) Date of Patent: May 28, 2024

(54) AIR CONDITIONER AND METHOD OF CONTROLLING THE SAME

(71) Applicant: SAMSUNG ELECTRONICS CO., LTD., Suwon-si (KR)

(72) Inventors: Jong Won Bak, Suwon-si (KR); Tae Il Kim, Suwon-si (KR); Dong-Il Jung, Suwon-si (KR); Dong Hyun Goh, Suwon-si (KR); Hyeong Joon Seo, Suwon-si (KR); Suk Ho Lee, Suwon-si (KR); Byoung Guk Lee, Suwon-si (KR); Hyeong Seok Lim, Suwon-si (KR); Yong Hee Jang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 551 days.

(21) Appl. No.: 17/277,129

(22) PCT Filed: Aug. 19, 2019

(86) PCT No.: PCT/KR2019/010479
§ 371 (c)(1),
(2) Date: Mar. 17, 2021

(87) PCT Pub. No.: WO2020/060038
PCT Pub. Date: Mar. 26, 2020

(65) Prior Publication Data

US 2022/0049871 A1 Feb. 17, 2022

(30) Foreign Application Priority Data

Sep. 19, 2018 (KR) ..... 10-2018-0111972

(51) Int. Cl.

| | |
|---|---|
| ***F24F 11/54*** | (2018.01) |
| ***F24F 3/06*** | (2006.01) |
| ***F24F 11/67*** | (2018.01) |
| ***F24F 11/84*** | (2018.01) |

(52) U.S. Cl.
CPC ..... *F24F 11/54* (2018.01); *F24F 3/065* (2013.01); *F24F 11/67* (2018.01); *F24F 11/84* (2018.01)

(58) Field of Classification Search
CPC .. F24F 11/54; F24F 3/065; F24F 11/67; F24F 11/84

(Continued)

(56) References Cited

U.S. PATENT DOCUMENTS

2012/0031605 A1* 2/2012 Takayama ..... F24F 11/83 165/201
2014/0260387 A1* 9/2014 Takenaka ..... F24F 11/83 62/205

(Continued)

FOREIGN PATENT DOCUMENTS

EP 1 746 364 A2 1/2007
EP 1 746 364 A3 9/2010

(Continued)

OTHER PUBLICATIONS

Extended European Search Report dated Jan. 4, 2022 from European Application No. 19863752.2.

(Continued)

*Primary Examiner* — Jigneshkumar C Patel
(74) *Attorney, Agent, or Firm* — STAAS & HALSEY LLP

(57) ABSTRACT

An air conditioner includes an outdoor unit, a plurality of mode change devices including at least one mode changer including a branch duct and a changing valve, and configured to receive a control signal from the outdoor unit to control an operation of the at least one mode changer. A plurality of indoor units are connected to the outdoor unit or the plurality of mode change devices. The outdoor unit may determine an operation mode to operate the plurality of (Continued)

mode change devices a plurality of times. Each of the plurality of indoor units may detect a temperature change of an indoor heat exchanger in response to the operation of the mode change devices, to determine the number of connected mode changers and a connectable mode changer candidate group based on the temperature change of the indoor heat exchanger.

13 Claims, 33 Drawing Sheets

(58) Field of Classification Search
USPC ..... 700/277
See application file for complete search history.

(56) References Cited

U.S. PATENT DOCUMENTS

2015/0034293 A1* 2/2015 Takayama ..... F25B 49/02 165/207
2018/0172289 A1 6/2018 Hur et al.
2018/0195783 A1* 7/2018 Jung ..... F25B 5/02

FOREIGN PATENT DOCUMENTS

| | | |
|---|---|---|
| EP | 3 346 206 A1 | 7/2018 |
| JP | 2013-181681 | 9/2013 |
| KR | 10-2008-0060760 | 7/2008 |
| KR | 10-2010-0012660 | 2/2010 |
| KR | 10-2018-0080929 | 7/2018 |
| KR | 10-2018-0082145 | 7/2018 |

OTHER PUBLICATIONS

International Search Report dated Dec. 20, 2019 from International Application No. PCT/KR2019/010479, 7 pages.
European Office Action dated Sep. 2, 2021 from European Application No. 19863752.2.
Korean Office Action dated Feb. 27, 2023 for Korean Application No. 10-2018-0111972.

* cited by examiner

FIG.11

| MODE CHANGE DEVICE | ADDRESS OF MODE CHANGE DEVICE | ADDRESS OF MODE CHANGER | CHANGING VALVE | ADDRESS OF INDOOR UNIT | STORE ADDRESS OF MODE CHANGER THAT OPERATION MODE MATCHES |
|---|---|---|---|---|---|
| FIRST MODE CHANGE DEVICE (100-1) | 0 | 01 | COOLING on / HEATING off | 1 | ALL ADDRESSES |
| | | 02 | COOLING on / HEATING off | 2 | ALL ADDRESSES |
| | | 03 | COOLING on / HEATING off | 3 | ALL ADDRESSES |
| | | 04 | COOLING on / HEATING off | 4 | ALL ADDRESSES |
| | | 05 | COOLING on / HEATING off | 5 | ALL ADDRESSES |
| | | 06 | COOLING on / HEATING off | 6 | ALL ADDRESSES |
| SECOND MODE CHANGE DEVICE (100-2) | 1 | 11 | COOLING on / HEATING off | 7 | ALL ADDRESSES (01,02,03,04,05,06/ 11,12,13,14/ 21,22,23,24) |
| | | 12 | COOLING on / HEATING off | | |
| | | 13 | COOLING on / HEATING off | 8 | ALL ADDRESSES (01,02,03,04,05,06/ 11,12,13,14/ 21,22,23,24) |
| | | 14 | COOLING on / HEATING off | | |
| THIRD MODE CHANGE DEVICE (100-3) | 2 | 21 | COOLING on / HEATING off | 9 | ALL ADDRESSES (01,02,03,04,05,06/ 11,12,13,14/ 21,22,23,24) |
| | | 22 | COOLING on / HEATING off | | |
| | | 23 | COOLING on / HEATING off | 10 | ALL ADDRESSES |
| | | 24 | COOLING on / HEATING off | 11 | ALL ADDRESSES |

<FIRST MODE CHANGER CANDIDATE GROUP SAVED STEP (OUTDOOR UNIT COOLING MODE)>

FIG.12

| MODE CHANGE DEVICE | ADDRESS OF MODE CHANGE DEVICE | ADDRESS OF MODE CHANGER | CHANGING VALVE | ADDRESS OF INDOOR UNIT | STORE ADDRESS OF MODE CHANGER THAT OPERATION MODE MATCHES |
|---|---|---|---|---|---|
| FIRST MODE CHANGE DEVICE (100-1) | 0 | 01 | COOLING on<br>HEATING off | 1 | ODD NUMBER (01,03,05/ 11,13/ 21,23) |
| | | 02 | COOLING off<br>HEATING off | 2 | - |
| | | 03 | COOLING on<br>HEATING off | 3 | ODD NUMBER (01,03,05/ 11,13/ 21,23) |
| | | 04 | COOLING off<br>HEATING off | 4 | - |
| | | 05 | COOLING on<br>HEATING off | 5 | ODD NUMBER (01,03,05/ 11,13/ 21,23) |
| | | 06 | COOLING off<br>HEATING off | 6 | - |
| SECOND MODE CHANGE DEVICE (100-2) | 1 | 11 | COOLING on<br>HEATING off | 7 | ODD NUMBER (01,03,05/ 11,13/ 21,23) |
| | | 12 | COOLING off<br>HEATING off | | |
| | | 13 | COOLING on<br>HEATING off | 8 | ODD NUMBER (01,03,05/ 11,13/ 21,23) |
| | | 14 | COOLING off<br>HEATING off | | |
| THIRD MODE CHANGE DEVICE (100-3) | 2 | 21 | COOLING on<br>HEATING off | 9 | ODD NUMBER (01,03,05/ 11,13/ 21,23) |
| | | 22 | COOLING off<br>HEATING off | | |
| | | 23 | COOLING on<br>HEATING off | 10 | ODD NUMBER (01,03,05/ 11,13/ 21,23) |
| | | 24 | COOLING off<br>HEATING off | 11 | - |

<SECOND MODE CHANGER CANDIDATE GROUP SAVED STEP(2-1) (OUTDOOR UNIT COOLING MODE)>

FIG.13

| MODE CHANGE DEVICE | ADDRESS OF MODE CHANGE DEVICE | ADDRESS OF MODE CHANGER | CHANGING VALVE | ADDRESS OF INDOOR UNIT | STORE ADDRESS OF MODE CHANGER THAT OPERATION MODE MATCHES |
|---|---|---|---|---|---|
| FIRST MODE CHANGE DEVICE (100-1) | 0 | 01 | COOLING off<br>HEATING off | 1 | - |
| | | 02 | COOLING on<br>HEATING off | 2 | EVEN NUMBER (02,04,06/ 12,14/ 22,24) |
| | | 03 | COOLING off<br>HEATING off | 3 | - |
| | | 04 | COOLING on<br>HEATING off | 4 | EVEN NUMBER (02,04,06/ 12,14/ 22,24) |
| | | 05 | COOLING off<br>HEATING off | 5 | - |
| | | 06 | COOLING on<br>HEATING off | 6 | EVEN NUMBER (02,04,06/ 12,14/ 22,24) |
| SECOND MODE CHANGE DEVICE (100-2) | 1 | 11 | COOLING off<br>HEATING off | 7 | EVEN NUMBER (02,04,06/ 12,14/ 22,24) |
| | | 12 | COOLING on<br>HEATING off | | |
| | | 13 | COOLING off<br>HEATING off | 8 | EVEN NUMBER (02,04,06/ 12,14/ 22,24) |
| | | 14 | COOLING on<br>HEATING off | | |
| THIRD MODE CHANGE DEVICE (100-3) | 2 | 21 | COOLING off<br>HEATING off | 9 | EVEN NUMBER (02,04,06/ 12,14/ 22,24) |
| | | 22 | COOLING on<br>HEATING off | | |
| | | 23 | COOLING off<br>HEATING off | 10 | - |
| | | 24 | COOLING on<br>HEATING off | 11 | EVEN NUMBER (02,04,06/ 12,14/ 22,24) |

<SECOND MODE CHANGER CANDIDATE GROUP SAVED STEP(2-2)
(OUTDOOR UNIT COOLING MODE)>

FIG.14

| ADDRESS OF INDOOR UNIT | STORE ADDRESS OF REDUNDANT MODE CHANGER |
|---|---|
| 1 | ODD NUMBER (01,03,05/ 11,13/ 21,23) |
| 2 | EVEN NUMBER (02,04,06/ 12,14/ 22,24) |
| 3 | ODD NUMBER (01,03,05/ 11,13/ 21,23) |
| 4 | EVEN NUMBER (02,04,06/ 12,14/ 22,24) |
| 5 | ODD NUMBER (01,03,05/ 11,13/ 21,23) |
| 6 | EVEN NUMBER (02,04,06/ 12,14/ 22,24) |
| 7 | COMBINED ADDRESS (012,023,034,045,056/ 112,123,134/ 212,223,234) |
| 8 | COMBINED ADDRESS (012,023,034,045,056/ 112,123,134/ 212,223,234) |
| 9 | COMBINED ADDRESS (012,023,034,045,056/ 112,123,134/ 212,223,234) |
| 10 | ODD NUMBER (01,03,05/ 11,13/ 21,23) |
| 11 | EVEN NUMBER (02,04,06/ 12,14/ 22,24) |

<MODE CHANGER CANDIDATE GROUP DETERMINATION STEP (OUTDOOR UNIT COOLING MODE)>

FIG.15

| MODE CHANGE DEVICE | ADDRESS OF MODE CHANGE DEVICE | IDENTIFIER OF MODE CHANGER | ADDRESS OF MODE CHANGER | CHANGING VALVE | ADDRESS OF INDOOR UNIT | EXTRACT ADDRESS OF VALID MODE CHANGE DEVICE |
|---|---|---|---|---|---|---|
| FIRST MODE CHANGE DEVICE (100-1) | 0 | 0 | 01 | COOLING on<br>HEATING off | 1 | 01/03/05/21/23 |
| | | | 02 | COOLING on<br>HEATING off | 2 | 02/04/06/22/24 |
| | | | 03 | COOLING on<br>HEATING off | 3 | 01/03/05/21/23 |
| | | | 04 | COOLING on<br>HEATING off | 4 | 02/04/06/22/24 |
| | | | 05 | COOLING on<br>HEATING off | 5 | 01/03/05/21/23 |
| | | | 06 | COOLING on<br>HEATING off | 6 | 02/04/06/22/24 |
| SECOND MODE CHANGE DEVICE (100-2) | 1 | 1 | 11 | COOLING off<br>HEATING off | 7 | 112/123/134 |
| | | | 12 | COOLING off<br>HEATING off | | |
| | | | 13 | COOLING off<br>HEATING off | 8 | 112/123/134 |
| | | | 14 | COOLING off<br>HEATING off | | |
| THIRD MODE CHANGE DEVICE (100-3) | 2 | 2 | 21 | COOLING on<br>HEATING off | 9 | 012/023/034/045/056/212/223/234 |
| | | | 22 | COOLING on<br>HEATING off | | |
| | | | 23 | COOLING on<br>HEATING off | 10 | 01/03/05/21/23 |
| | | | 24 | COOLING on<br>HEATING off | 11 | 02/04/06/22/24 |

<FIRST MODE CHANGE DEVICE DETERMINATION STEP (OUTDOOR UNIT COOLING MODE)>

FIG.16

| MODE CHANGE DEVICE | ADDRESS OF MODE CHANGE DEVICE | IDENTIFIER OF MODE CHANGER | ADDRESS OF MODE CHANGER | CHANGING VALVE | ADDRESS OF INDOOR UNIT | EXTRACT ADDRESS OF VALID MODE CHANGE DEVICE |
|---|---|---|---|---|---|---|
| FIRST MODE CHANGE DEVICE (100-1) | 0 | 0 | 01 | COOLING on<br>HEATING off | 1 | 01/03/05 |
| | | | 02 | COOLING on<br>HEATING off | 2 | 02/04/06 |
| | | | 03 | COOLING on<br>HEATING off | 3 | 01/03/05 |
| | | | 04 | COOLING on<br>HEATING off | 4 | 02/04/06 |
| | | | 05 | COOLING on<br>HEATING off | 5 | 01/03/05 |
| | | | 06 | COOLING on<br>HEATING off | 6 | 02/04/06 |
| SECOND MODE CHANGE DEVICE (100-2) | 1 | 0 | 11 | COOLING on<br>HEATING off | 7 | 112/123/134 |
| | | | 12 | COOLING on<br>HEATING off | | |
| | | | 13 | COOLING on<br>HEATING off | 8 | 112/123/134 |
| | | | 14 | COOLING on<br>HEATING off | | |
| THIRD MODE CHANGE DEVICE (100-3) | 2 | 1 | 21 | COOLING off<br>HEATING off | 9 | 212/223/234 |
| | | | 22 | COOLING off<br>HEATING off | | |
| | | | 23 | COOLING off<br>HEATING off | 10 | 21/23 |
| | | | 24 | COOLING off<br>HEATING off | 11 | 22/24 |

<SECOND MODE CHANGE DEVICE DETERMINATION STEP (OUTDOOR UNIT COOLING MODE)>

FIG.17

| MODE CHANGE DEVICE | ADDRESS OF MODE CHANGE DEVICE | OPERATION PATTERN OF MODE CHANGER | ADDRESS OF MODE CHANGER | CHANGING VALVE | ADDRESS OF INDOOR UNIT | EXTRACT ADDRESS OF VALID MODE CHANGE DEVICE |
|---|---|---|---|---|---|---|
| FIRST MODE CHANGE DEVICE (100-1) | 0 | 110000 | 01 | COOLING on<br>HEATING off | 1 | 01 |
| | | | 02 | COOLING on<br>HEATING off | 2 | 02 |
| | | | 03 | COOLING off<br>HEATING off | 3 | 03/05 |
| | | | 04 | COOLING off<br>HEATING off | 4 | 04/06 |
| | | | 05 | COOLING off<br>HEATING off | 5 | 03/05 |
| | | | 06 | COOLING off<br>HEATING off | 6 | 04/06 |
| SECOND MODE CHANGE DEVICE (100-2) | 1 | 1000 | 11 | COOLING on<br>HEATING off | 7 | 112 |
| | | | 12 | COOLING off<br>HEATING off | | |
| | | | 13 | COOLING off<br>HEATING off | 8 | 123/134 |
| | | | 14 | COOLING off<br>HEATING off | | |
| THIRD MODE CHANGE DEVICE (100-3) | 2 | 100 | 21 | COOLING on<br>HEATING off | 9 | 212 |
| | | | 22 | COOLING off<br>HEATING off | | |
| | | | 23 | COOLING off<br>HEATING off | 10 | 23 |
| | | | 24 | COOLING off<br>HEATING off | 11 | 22/24 |

<FIRST MODE CHANGER DETERMINATION STEP (OUTDOOR UNIT COOLING MODE)>

FIG.18

| MODE CHANGE DEVICE | ADDRESS OF MODE CHANGE DEVICE | OPERATION PATTERN OF MODE CHANGER | ADDRESS OF MODE CHANGER | CHANGING VALVE | ADDRESS OF INDOOR UNIT | EXTRACT ADDRESS OF VALID MODE CHANGE DEVICE |
|---|---|---|---|---|---|---|
| FIRST MODE CHANGE DEVICE (100-1) | 0 | 100001 | 01 | COOLING on<br>HEATING off | 1 | 01 |
| | | | 02 | COOLING off<br>HEATING off | 2 | 02 |
| | | | 03 | COOLING off<br>HEATING off | 3 | 03/05 |
| | | | 04 | COOLING off<br>HEATING off | 4 | 04 |
| | | | 05 | COOLING off<br>HEATING off | 5 | 03/05 |
| | | | 06 | COOLING on<br>HEATING off | 6 | 06 |
| SECOND MODE CHANGE DEVICE (100-2) | 1 | 0001 | 11 | COOLING off<br>HEATING off | 7 | 112 |
| | | | 12 | COOLING off<br>HEATING off | | |
| | | | 13 | COOLING off<br>HEATING off | 8 | 134 |
| | | | 14 | COOLING on<br>HEATING off | | |
| THIRD MODE CHANGE DEVICE (100-3) | 2 | 100 | 21 | COOLING off<br>HEATING off | 9 | 212 |
| | | | 22 | COOLING off<br>HEATING off | | |
| | | | 23 | COOLING off<br>HEATING off | 10 | 23 |
| | | | 24 | COOLING on<br>HEATING off | 11 | 24 |

<SECOND MODE CHANGER DETERMINATION STEP (OUTDOOR UNIT COOLING MODE)>

FIG.19

| MODE CHANGE DEVICE | ADDRESS OF MODE CHANGE DEVICE | OPERATION PATTERN OF MODE CHANGER | ADDRESS OF MODE CHANGER | CHANGING VALVE | ADDRESS OF INDOOR UNIT | EXTRACT ADDRESS OF VALID MODE CHANGE DEVICE |
|---|---|---|---|---|---|---|
| FIRST MODE CHANGE DEVICE (100-1) | 0 | 000011 | 01 | COOLING off | 1 | 01 |
| | | | | HEATING off | | |
| | | | 02 | COOLING off | 2 | 02 |
| | | | | HEATING off | | |
| | | | 03 | COOLING off | 3 | 03 |
| | | | | HEATING off | | |
| | | | 04 | COOLING off | 4 | 04 |
| | | | | HEATING off | | |
| | | | 05 | COOLING on | 5 | 05 |
| | | | | HEATING off | | |
| | | | 06 | COOLING on | 6 | 06 |
| | | | | HEATING off | | |
| SECOND MODE CHANGE DEVICE (100-2) | 1 | 0000 | 11 | COOLING off | 7 | 112 |
| | | | | HEATING off | | |
| | | | 12 | COOLING off | | |
| | | | | HEATING off | | |
| | | | 13 | COOLING off | 8 | 134 |
| | | | | HEATING off | | |
| | | | 14 | COOLING off | | |
| | | | | HEATING off | | |
| THIRD MODE CHANGE DEVICE (100-3) | 2 | 0000 | 21 | COOLING off | 9 | 212 |
| | | | | HEATING off | | |
| | | | 22 | COOLING off | | |
| | | | | HEATING off | | |
| | | | 23 | COOLING off | 10 | 23 |
| | | | | HEATING off | | |
| | | | 24 | COOLING off | 11 | 24 |
| | | | | HEATING off | | |

<THIRD MODE CHANGER DETERMINATION STEP (OUTDOOR UNIT COOLING MODE)>

FIG.20

| MODE CHANGE DEVICE | ADDRESS OF MODE CHANGE DEVICE | IDENTIFIER OF MODE CHANGE DEVICE | ADDRESS OF MODE CHANGER | CHANGING VALVE | ADDRESS OF INDOOR UNIT | STORE ADDRESS OF MODE CHANGER THAT OPERATION MODE MATCHES |
|---|---|---|---|---|---|---|
| FIRST MODE CHANGE DEVICE (100-1) | 0 | 0 | 01 | COOLING on<br>HEATING off | 1 | 01/02/03/04/05/06/ 21/22/23/24 |
| | | | 02 | COOLING on<br>HEATING off | 2 | 01/02/03/04/05/06/ 21/22/23/24 |
| | | | 03 | COOLING on<br>HEATING off | 3 | 01/02/03/04/05/06/ 21/22/23/24 |
| | | | 04 | COOLING on<br>HEATING off | 4 | 01/02/03/04/05/06/ 21/22/23/24 |
| | | | 05 | COOLING on<br>HEATING off | 5 | 01/02/03/04/05/06/ 21/22/23/24 |
| | | | 06 | COOLING on<br>HEATING off | 6 | 01/02/03/04/05/06/ 21/22/23/24 |
| SECOND MODE CHANGE DEVICE (100-2) | 1 | 1 | 11 | COOLING off<br>HEATING on | 7 | 11/12/13/14 |
| | | | 12 | COOLING off<br>HEATING on | | |
| | | | 13 | COOLING off<br>HEATING on | 8 | 11/12/13/14 |
| | | | 14 | COOLING off<br>HEATING on | | |
| THIRD MODE CHANGE DEVICE (100-3) | 2 | 2 | 21 | COOLING on<br>HEATING off | 9 | 01/02/03/04/05/06/ 21/22/23/24 |
| | | | 22 | COOLING on<br>HEATING off | | |
| | | | 23 | COOLING on<br>HEATING off | 10 | 01/02/03/04/05/06/ 21/22/23/24 |
| | | | 24 | COOLING on<br>HEATING off | 11 | 01/02/03/04/05/06/ 21/22/23/24 |

<FIRST MODE CHANGER CANDIDATE GROUP SAVED STEP (OUTDOOR UNIT MAIN COOLING MODE)>

FIG.21

| MODE CHANGE DEVICE | ADDRESS OF MODE CHANGE DEVICE | IDENTIFIER OF MODE CHANGE DEVICE | ADDRESS OF MODE CHANGER | CHANGING VALVE | ADDRESS OF INDOOR UNIT | STORE ADDRESS OF MODE CHANGER THAT OPERATION MODE MATCHES |
|---|---|---|---|---|---|---|
| FIRST MODE CHANGE DEVICE (100-1) | 0 | 0 | 01 | COOLING on<br>HEATING off | 1 | 01/03/05/11/13 |
| | | | 02 | COOLING off<br>HEATING off | 2 | - |
| | | | 03 | COOLING on<br>HEATING off | 3 | 01/03/05/11/13 |
| | | | 04 | COOLING off<br>HEATING off | 4 | - |
| | | | 05 | COOLING on<br>HEATING off | 5 | 01/03/05/11/13 |
| | | | 06 | COOLING off<br>HEATING off | 6 | - |
| SECOND MODE CHANGE DEVICE (100-2) | 1 | 0 | 11 | COOLING on<br>HEATING off | 7 | 01/03/05/11/13 |
| | | | 12 | COOLING off<br>HEATING off | | |
| | | | 13 | COOLING on<br>HEATING off | 8 | 01/03/05/11/13 |
| | | | 14 | COOLING off<br>HEATING off | | |
| THIRD MODE CHANGE DEVICE (100-3) | 2 | 1 | 21 | COOLING off<br>HEATING on | 9 | 21/23 |
| | | | 22 | COOLING off<br>HEATING off | | |
| | | | 23 | COOLING off<br>HEATING on | 10 | 21/23 |
| | | | 24 | COOLING off<br>HEATING off | 11 | - |

<SECOND MODE CHANGER CANDIDATE GROUP SAVED STEP(2-1)
(OUTDOOR UNIT MAIN COOLING MODE)>

FIG.22

| MODE CHANGE DEVICE | ADDRESS OF MODE CHANGE DEVICE | IDENTIFIER OF MODE CHANGE DEVICE | ADDRESS OF MODE CHANGER | CHANGING VALVE | ADDRESS OF INDOOR UNIT | STORE ADDRESS OF MODE CHANGER THAT OPERATION MODE MATCHES |
|---|---|---|---|---|---|---|
| FIRST MODE CHANGE DEVICE (100-1) | 0 | 0 | 01 | COOLING off<br>HEATING off | 1 | - |
| | | | 02 | COOLING on<br>HEATING off | 2 | 02/04/06/12/14 |
| | | | 03 | COOLING off<br>HEATING off | 3 | - |
| | | | 04 | COOLING on<br>HEATING off | 4 | 02/04/06/12/14 |
| | | | 05 | COOLING off<br>HEATING off | 5 | - |
| | | | 06 | COOLING on<br>HEATING off | 6 | 02/04/06/12/14 |
| SECOND MODE CHANGE DEVICE (100-2) | 1 | 0 | 11 | COOLING off<br>HEATING off | 7 | 02/04/06/12/14 |
| | | | 12 | COOLING on<br>HEATING off | | |
| | | | 13 | COOLING off<br>HEATING off | 8 | 02/04/06/12/14 |
| | | | 14 | COOLING on<br>HEATING off | | |
| THIRD MODE CHANGE DEVICE (100-3) | 2 | 1 | 21 | COOLING off<br>HEATING off | 9 | 22/24 |
| | | | 22 | COOLING off<br>HEATING on | | |
| | | | 23 | COOLING off<br>HEATING off | 10 | - |
| | | | 24 | COOLING off<br>HEATING on | 11 | 22/24 |

<SECOND MODE CHANGER CANDIDATE GROUP SAVED STEP(2-2)
(OUTDOOR UNIT MAIN COOLING MODE)>

FIG.23

| ADDRESS OF INDOOR UNIT | STORE ADDRESS OF REDUNDANT MODE CHANGER |
|---|---|
| 1 | 01,03,05 |
| 2 | 02,04,06 |
| 3 | 01,03,05 |
| 4 | 02,04,06 |
| 5 | 01,03,05 |
| 6 | 02,04,06 |
| 7 | COMBINED ADDRESS 112,113,134 |
| 8 | COMBINED ADDRESS 112,113,134 |
| 9 | COMBINED ADDRESS 212,223,234 |
| 10 | 21,23 |
| 11 | 22,24 |

<MODE CHANGER CANDIDATE GROUP DETERMINATION STEP (OUTDOOR UNIT MAIN COOLING MODE)>

FIG.24

| MODE CHANGE DEVICE | ADDRESS OF MODE CHANGE DEVICE | IDENTIFIER OF MODE CHANGE DEVICE | ADDRESS OF MODE CHANGER | CHANGING VALVE | ADDRESS OF INDOOR UNIT | EXTRACT ADDRESS OF VALID MODE CHANGE DEVICE |
|---|---|---|---|---|---|---|
| FIRST MODE CHANGE DEVICE (100-1) | 0 | 0 | 01 | COOLING on<br>HEATING off | 1 | 01,03,05 |
| | | | 02 | COOLING on<br>HEATING off | 2 | 02,04,06 |
| | | | 03 | COOLING on<br>HEATING off | 3 | 01,03,05 |
| | | | 04 | COOLING on<br>HEATING off | 4 | 02,04,06 |
| | | | 05 | COOLING on<br>HEATING off | 5 | 01,03,05 |
| | | | 06 | COOLING on<br>HEATING off | 6 | 02,04,06 |
| SECOND MODE CHANGE DEVICE (100-2) | 1 | 1 | 11 | COOLING on<br>HEATING off | 7 | 112,123,134 |
| | | | 12 | COOLING on<br>HEATING off | | |
| | | | 13 | COOLING on<br>HEATING off | 8 | 112,123,134 |
| | | | 14 | COOLING on<br>HEATING off | | |
| THIRD MODE CHANGE DEVICE (100-3) | 2 | 2 | 21 | COOLING on<br>HEATING off | 9 | 212,223,234 |
| | | | 22 | COOLING on<br>HEATING off | | |
| | | | 23 | COOLING on<br>HEATING off | 10 | 21,23 |
| | | | 24 | COOLING on<br>HEATING off | 11 | 22,24 |

<FIRST MODE CHANGE DEVICE DETERMINATION STEP (OUTDOOR UNIT MAIN COOLING MODE)>

FIG.25

| MODE CHANGE DEVICE | ADDRESS OF MODE CHANGE DEVICE | OPERATION PATTERN OF MODE CHANGER | ADDRESS OF MODE CHANGER | CHANGING VALVE | ADDRESS OF INDOOR UNIT | EXTRACT ADDRESS OF VALID MODE CHANGE DEVICE |
|---|---|---|---|---|---|---|
| FIRST MODE CHANGE DEVICE (100-1) | 0 | 110000 | 01 | COOLING on<br>HEATING off | 1 | 01 |
| | | | 02 | COOLING on<br>HEATING off | 2 | 02 |
| | | | 03 | COOLING off<br>HEATING off | 3 | 03,05 |
| | | | 04 | COOLING off<br>HEATING off | 4 | 04,06 |
| | | | 05 | COOLING off<br>HEATING off | 5 | 03,05 |
| | | | 06 | COOLING off<br>HEATING off | 6 | 04,06 |
| SECOND MODE CHANGE DEVICE (100-2) | 1 | 1000 | 11 | COOLING off<br>HEATING on | 7 | 112 |
| | | | 12 | COOLING off<br>HEATING off | | |
| | | | 13 | COOLING off<br>HEATING off | 8 | 123,134 |
| | | | 14 | COOLING off<br>HEATING off | | |
| THIRD MODE CHANGE DEVICE (100-3) | 2 | 1000 | 21 | COOLING on<br>HEATING off | 9 | 212 |
| | | | 22 | COOLING off<br>HEATING off | | |
| | | | 23 | COOLING off<br>HEATING off | 10 | 23 |
| | | | 24 | COOLING off<br>HEATING off | 11 | 22,24 |

<FIRST MODE CHANGER DETERMINATION STEP (OUTDOOR UNIT MAIN COOLING MODE)>

FIG.26

| MODE CHANGE DEVICE | ADDRESS OF MODE CHANGE DEVICE | OPERATION PATTERN OF MODE CHANGER | ADDRESS OF MODE CHANGER | CHANGING VALVE | ADDRESS OF INDOOR UNIT | EXTRACT ADDRESS OF VALID MODE CHANGE DEVICE |
|---|---|---|---|---|---|---|
| FIRST MODE CHANGE DEVICE (100-1) | 0 | 100001 | 01 | COOLING on<br>HEATING off | 1 | 01 |
| | | | 02 | COOLING off<br>HEATING off | 2 | 02 |
| | | | 03 | COOLING off<br>HEATING off | 3 | 03,05 |
| | | | 04 | COOLING off<br>HEATING off | 4 | 04 |
| | | | 05 | COOLING off<br>HEATING off | 5 | 03,05 |
| | | | 06 | COOLING on<br>HEATING off | 6 | 06 |
| SECOND MODE CHANGE DEVICE (100-2) | 1 | 0001 | 11 | COOLING off<br>HEATING off | 7 | 112 |
| | | | 12 | COOLING off<br>HEATING off | | |
| | | | 13 | COOLING off<br>HEATING off | 8 | 134 |
| | | | 14 | COOLING off<br>HEATING on | | |
| THIRD MODE CHANGE DEVICE (100-3) | 2 | 0001 | 21 | COOLING off<br>HEATING off | 9 | 212 |
| | | | 22 | COOLING off<br>HEATING off | | |
| | | | 23 | COOLING off<br>HEATING off | 10 | 23 |
| | | | 24 | COOLING on<br>HEATING off | 11 | 24 |

<SECOND MODE CHANGER DETERMINATION STEP (OUTDOOR UNIT MAIN COOLING MODE)>

FIG.27

| MODE CHANGE DEVICE | ADDRESS OF MODE CHANGE DEVICE | OPERATION PATTERN OF MODE CHANGER | ADDRESS OF MODE CHANGER | CHANGING VALVE | ADDRESS OF INDOOR UNIT | EXTRACT ADDRESS OF VALID MODE CHANGE DEVICE |
|---|---|---|---|---|---|---|
| FIRST MODE CHANGE DEVICE (100-1) | 0 | 000011 | 01 | COOLING off<br>HEATING off | 1 | 01 |
| | | | 02 | COOLING off<br>HEATING off | 2 | 02 |
| | | | 03 | COOLING off<br>HEATING off | 3 | 03 |
| | | | 04 | COOLING off<br>HEATING off | 4 | 04 |
| | | | 05 | COOLING on<br>HEATING off | 5 | 05 |
| | | | 06 | COOLING on<br>HEATING off | 6 | 06 |
| SECOND MODE CHANGE DEVICE (100-2) | 1 | 0000 | 11 | COOLING off<br>HEATING off | 7 | 112 |
| | | | 12 | COOLING off<br>HEATING off | | |
| | | | 13 | COOLING off<br>HEATING off | 8 | 134 |
| | | | 14 | COOLING off<br>HEATING off | | |
| THIRD MODE CHANGE DEVICE (100-3) | 2 | 0000 | 21 | COOLING off<br>HEATING off | 9 | 212 |
| | | | 22 | COOLING off<br>HEATING off | | |
| | | | 23 | COOLING off<br>HEATING off | 10 | 23 |
| | | | 24 | COOLING off<br>HEATING off | 11 | 24 |

<THIRD MODE CHANGER DETERMINATION STEP (OUTDOOR UNIT MAIN COOLING MODE)>

FIG.28

| MODE CHANGE DEVICE | ADDRESS OF MODE CHANGE DEVICE | OPERATION PATTERN OF MODE CHANGER | ADDRESS OF MODE CHANGER | CHANGING VALVE | ADDRESS OF INDOOR UNIT | EXTRACT ADDRESS OF VALID MODE CHANGE DEVICE |
|---|---|---|---|---|---|---|
| FIRST MODE CHANGE DEVICE (100-1) | 0 | 100001 | 01 | COOLING off<br>HEATING on | 1 | 01 |
| | | | 02 | COOLING off<br>HEATING off | 2 | 02 |
| | | | 03 | COOLING off<br>HEATING off | 3 | 03 |
| | | | 04 | COOLING off<br>HEATING off | 4 | 04 |
| | | | 05 | COOLING off<br>HEATING off | 5 | 05 |
| | | | 06 | COOLING off<br>HEATING on | 6 | 06 |
| SECOND MODE CHANGE DEVICE (100-2) | 1 | 0001 | 11 | COOLING off<br>HEATING off | 7 | 112 |
| | | | 12 | COOLING off<br>HEATING off | | |
| | | | 13 | COOLING off<br>HEATING off | 8 | 134 |
| | | | 14 | COOLING on<br>HEATING off | | |
| THIRD MODE CHANGE DEVICE (100-3) | 2 | 0001 | 21 | COOLING off<br>HEATING off | 9 | 212 |
| | | | 22 | COOLING off<br>HEATING off | | |
| | | | 23 | COOLING off<br>HEATING off | 10 | 23 |
| | | | 24 | COOLING off<br>HEATING on | 11 | 24 |

<SECOND MODE CHANGER DETERMINATION STEP (OUTDOOR UNIT MAIN COOLING MODE)-ALTERNATELY OPERATE>

FIG.31

| MODE CHANGE DEVICE | ADDRESS OF MODE CHANGE DEVICE | GROUP OF MODE CHANGE DEVICE | ADDRESS OF MODE CHANGER | CHANGING VALVE | ADDRESS OF INDOOR UNIT | EXTRACT ADDRESS OF VALID MODE CHANGE DEVICE |
|---|---|---|---|---|---|---|
| FIRST MODE CHANGE DEVICE (100-1) | 0 | A | 01 | COOLING on<br>HEATING off | 1 | 01/03/05 |
| | | | 02 | COOLING on<br>HEATING off | 2 | 02/04/06 |
| | | | 03 | COOLING on<br>HEATING off | 3 | 01/03/05 |
| | | | 04 | COOLING on<br>HEATING off | 4 | 02/04/06 |
| | | | 05 | COOLING on<br>HEATING off | 5 | 01/03/05 |
| | | | 06 | COOLING on<br>HEATING off | 6 | 02/04/06 |
| SECOND MODE CHANGE DEVICE (100-2) | 1 | B | 11 | COOLING off<br>HEATING off | 7 | 112,123,134,/<br>212,223,234 |
| | | | 12 | COOLING off<br>HEATING off | | |
| | | | 13 | COOLING off<br>HEATING off | 8 | 112,123,134,/<br>212,223,234 |
| | | | 14 | COOLING off<br>HEATING off | | |
| THIRD MODE CHANGE DEVICE (100-3) | 2 | B | 21 | COOLING off<br>HEATING off | 9 | 112,123,134,/<br>212,223,234 |
| | | | 22 | COOLING off<br>HEATING off | | |
| | | | 23 | COOLING off<br>HEATING off | 10 | 11,13/21,23 |
| | | | 24 | COOLING off<br>HEATING off | 11 | 12,14/22,24 |

<FIRST MODE CHANGE DEVICE DETERMINATION STEP (OUTDOOR UNIT COOLING MODE)>

FIG.32

| MODE CHANGE DEVICE | ADDRESS OF MODE CHANGE DEVICE | GROUP OF MODE CHANGE DEVICE | ADDRESS OF MODE CHANGER | CHANGING VALVE | ADDRESS OF INDOOR UNIT | EXTRACT ADDRESS OF VALID MODE CHANGE DEVICE |
|---|---|---|---|---|---|---|
| SECOND MODE CHANGE DEVICE (100-2) | 1 | A | 11 | COOLING on | 7 | 112,123,134 |
| | | | | HEATING off | | |
| | | | 12 | COOLING on | | |
| | | | | HEATING off | | |
| | | | 13 | COOLING on | 8 | 112,123,134 |
| | | | | HEATING off | | |
| | | | 14 | COOLING on | | |
| | | | | HEATING off | | |
| THIRD MODE CHANGE DEVICE (100-3) | 2 | B | 21 | COOLING off | 9 | 212,223,234 |
| | | | | HEATING off | | |
| | | | 22 | COOLING off | | |
| | | | | HEATING off | | |
| | | | 23 | COOLING off | 10 | 21,23 |
| | | | | HEATING off | | |
| | | | 24 | COOLING off | 11 | 22,24 |
| | | | | HEATING off | | |

<SECOND MODE CHANGE DEVICE DETERMINATION STEP (OUTDOOR UNIT COOLING MODE)>

AIR CONDITIONER AND METHOD OF CONTROLLING THE SAME

CROSS-REFERENCE TO RELATED APPLICATIONS

This application is a U.S. National Stage Application, which claims the benefit under 35 U.S.C. § 371 of PCT International Patent Application No. PCT/KR2019/010479, filed Aug. 19, 2019 which claims the foreign priority benefit under 35 U.S.C. § 119 of Korean Patent Application No. 10-2018-0111972, filed Sep. 19, 2018, the contents of which are incorporated herein by reference.

TECHNICAL FIELD

The present disclosure relates to an air conditioner and a method of controlling the same.

BACKGROUND ART

An air conditioner is an apparatus for adjusting indoor air to be suitable for a purpose of use and is an apparatus configured to adjust temperature, humidity, purity, flow, or the like of indoor air. The air conditioner may be used in various locations such as a general house, an office, a factory, and a vehicle.

Generally, the air conditioner may emit cooled air obtained through a cooling cycle that consists of a process of compressing, condensing, expanding, and evaporating a refrigerant to an indoor space or emit heated air obtained by performing the above-described process in a reverse order to an indoor space to adjust indoor air.

For example, an air conditioner may include a compressor, a condenser, an expansion valve, an evaporator, and a fan, and a refrigerant may sequentially pass through the compressor, the condenser, the expansion valve, and the evaporator to adjust indoor air.

The air conditioner may include a multi-air conditioner. The multi-air conditioner connects a plurality of indoor units to at least one outdoor unit via a single piping system to adjust air in a plurality of indoor spaces. In this case, all of indoor units installed in the indoor spaces may have a different operation mode according to the operation mode of the outdoor unit. For example, when the outdoor unit is in a cooling mode, all of the plurality of indoor units may operate in the cooling mode. When the outdoor unit is in a heating mode, all of the plurality of indoor units may operate in the heating mode. In addition, when the outdoor unit is in a main cooling mode or a main heating mode, some of the plurality of indoor units may operate in the cooling mode, and some of the other indoor units may operate in the heating mode.

DISCLOSURE

Technical Problem

An aspect of the present disclosure is to provide an air conditioner capable of promptly and accurately determining automatically how each of a plurality of indoor units is connected to a mode change device, and a method of controlling the same.

Technical Solution

To achieve the above aspect, there are provided an air conditioner and a method of controlling the same.

An aspect of the disclosure provides an air conditioner including: an outdoor unit; a plurality of mode change devices connected to the outdoor unit, including at least one mode changer including a branch duct and a changing valve, and configured to receive a control signal from the outdoor unit to control an operation of the at least one mode changer; and a plurality of indoor units connected to the outdoor unit or the plurality of mode change devices. The outdoor unit may be configured to determine an operation mode of the plurality of mode change devices to operate the plurality of mode change devices a plurality of times. Each of the plurality of indoor units may be configured to detect a temperature change of an indoor heat exchanger in response to the operation of the plurality of mode change devices, to determine the number of connected mode changers and a connectable mode changer candidate group based on the temperature change of the indoor heat exchanger, and to extract a valid mode changer from the determined mode changer candidate group and obtain branch duct connection information.

The outdoor unit may be configured to set an address and an identifier to each of the plurality of mode change devices, to set an address to the at least one mode changer included in each of the plurality of mode change devices, and based on the identifier of the set mode change device and the address of the mode changer, to determine an operation mode of the plurality of mode change devices and an operation mode of the mode changers. The each of the plurality of indoor units may be configured to detect and store the addresses of the mode changers related to the temperature change of the indoor heat exchanger.

The outdoor unit may be configured to operate all mode changers, and then to operate sequentially by dividing an odd mode changer having an odd address and an even mode changer having an even address. The each of the plurality of indoor units may be configured to store the address of the mode changer related to the temperature change of the indoor heat exchanger as a first saved address after the operation of all the mode changers, to store the address of the mode changer related to the temperature change of the indoor heat exchanger as a second saved address after the operation of the odd mode changer, and to store the address of the mode changer related to the temperature change of the indoor heat exchanger as a third saved address after the operation of the even mode changer.

The each of the plurality of indoor units may be configured to determine the number of the connected mode changer by detecting the number of times of operation corresponding to the operation of the odd mode changer and the operation of the even mode changer, and to compare the first saved address, the second saved address, and the third saved address and determine the mode changer candidate group by detecting the address of the redundantly stored mode changer.

The outdoor unit may be configured to operate the plurality of mode change devices by determining a first operation number for the plurality of mode change devices based on the number of the plurality of mode change devices, and to determine the operation mode of each of the plurality of mode change devices based on the identifier of the mode change device that changes for each step. The each of the plurality of indoor units may be configured to extract the address of the valid mode changer by comparing the temperature change of the indoor heat exchanger with the operation mode of the mode changers for each step in which the plurality of mode change devices are operated.

The outdoor unit may be further configured to operate each of the plurality of mode change devices by determining a second operation number for each of the plurality of mode change devices based on the number of mode changers included in each of the plurality of mode change devices, and to operate the mode changer of each of the plurality of mode change devices according to a predetermined operation pattern for each operation step. The each of the plurality of indoor units may be further configured to extract the address of the valid mode changer by comparing the temperature change of the indoor heat exchanger with the operation mode of the mode changers for each step in which each of the plurality of mode change devices is operated.

The each of the plurality of indoor units may be configured to determine the address of the valid mode changer as the branch duct connection information in response to a case where the address of the extracted valid mode changer is one.

The each of the plurality of indoor units may be configured to determine to be directly connected to the outdoor unit in response to a case where there is no address of the extracted valid mode changer.

The outdoor unit may be further configured to set the plurality of mode change devices as a first group or a second group based on the number of the mode changers included in each of the plurality of mode change devices, and to operate by setting the operation mode of the first group and the operation mode of the second group differently. The each of the plurality of indoor units may be further configured to extract the address of the valid mode changer by comparing the temperature change of the indoor heat exchanger with the operation mode of the mode changer of the first group and the operation mode of the mode changer of the second group.

The outdoor unit may be configured to repeat setting the first group and the second group as two groups again until the number of elements in each of the first group and the second group is one.

The outdoor unit may be further configured to operate the mode change device of the first group or the mode change device of the second group by a predetermined number of steps in response to a case where the number of elements in the first group or the number of elements in the second group is one, and to operate the mode changer of the mode change device of the first group or the mode changer of the mode change device of the second group according to a predetermined operation pattern. The each of the plurality of indoor units may be further configured to extract the address of the valid mode changer by comparing the temperature change of the indoor heat exchanger with the operation mode of the mode changer of the first group or the operation mode of the mode changer of the second group each step the mode change device of the first group or the mode change device of the second group is operated.

Another aspect of the disclosure provides an air conditioner including: an outdoor unit; a mode change device connected to the outdoor unit, including a plurality of mode changers including a branch duct and a changing valve, and configured to receive a control signal from the outdoor unit to control an operation of the plurality of mode changers; and a plurality of indoor units connected to the outdoor unit or the plurality of mode change devices. The outdoor unit may be configured to determine an operation mode of the mode change device to operate the mode change device a plurality of times. Each of the plurality of indoor units may be configured to detect a temperature change of an indoor heat exchanger in response to the operation of the mode change device, to determine the number of connected mode changers and a connectable mode changer candidate group based on the temperature change of the indoor heat exchanger, and to extract a valid mode changer from the determined mode changer candidate group and obtain branch duct connection information.

The outdoor unit may be configured to set the address to the plurality of mode changers, and to operate all mode changers, and then to operate sequentially by dividing an odd mode changer having an odd address and an even mode changer having an even address. The each of the plurality of indoor units may be configured to store the address of the mode changer related to the temperature change of the indoor heat exchanger as a first saved address after the operation of all the mode changers, to store the address of the mode changer related to the temperature change of the indoor heat exchanger as a second saved address after the operation of the odd mode changer, and to store the address of the mode changer related to the temperature change of the indoor heat exchanger as a third saved address after the operation of the even mode changer.

The each of the plurality of indoor units may be configured to determine the number of the connected mode changer by detecting the number of times of operation corresponding to the operation of the odd mode changer and the operation of the even mode changer, and to compare the first saved address, the second saved address, and the third saved address, and to determine the mode changer candidate group by detecting the address of the redundantly stored mode changer.

In addition, the outdoor unit may be configured to operate the mode change device as many times as the number of operations determined based on the number of the plurality of mode changers, and to operate the plurality of mode changers according to a predetermined operation pattern for each operation step. Each of the plurality of indoor units may be configured to extract an address of the valid mode changer by comparing the temperature change of the indoor heat exchanger with operation modes of the plurality of mode changers for each step in which the mode change device is operated.

The each of the plurality of indoor units may be configured to determine the address of the valid mode changer as the branch duct connection information in response to a case where the address of the extracted valid mode changer is one.

The each of the plurality of indoor units may be configured to determine to be directly connected to the outdoor unit in response to a case where there is no address of the extracted valid mode changer.

Another aspect of the disclosure provides a method of controlling an air conditioner, the air conditioner includes an outdoor unit, a plurality of mode change devices connected to the outdoor unit, and a plurality of indoor units connected to the outdoor unit or the plurality of mode change devices. The method of controlling the air conditioner including: operating the plurality of mode change devices in an operation mode determined by the outdoor unit; detecting a temperature change of an indoor heat exchanger included in each of the plurality of indoor units in response to the operation of the plurality of mode change devices; determining the number of mode changers connected to each of the plurality of indoor units and a mode changer candidate group connectable to each of the plurality of indoor units based on temperature changes of the indoor heat exchangers of each of the plurality of indoor units; and extracting a valid mode changer from the mode changer candidate group and obtaining branch duct connection information for each of the plurality of indoor units.

The method may further include setting an address and an identifier to each of the plurality of mode change devices, and setting the address to the at least one mode changer included in each of the plurality of mode change devices. The operating of the plurality of mode change devices may include determining an operation mode of the mode change device and operation modes of the mode changers based on the set identifier of the mode change device and the address of the mode changer. The determining of the mode changer candidate group may include detecting and storing the addresses of the mode changers related to the temperature change of the indoor heat exchanger.

The operating of the plurality of mode change devices may further include determining a first operation number determined based on the number of the plurality of mode change devices and a second operation number for each of the plurality of mode change devices based on the number of mode changers included in each of the plurality of mode change devices, and operating the plurality of mode change devices a plurality of times. The obtaining of the branch duct connection information may include extracting an address of the valid mode changer by comparing the temperature change of the indoor heat exchanger with operation modes of the mode changers for each operation of the plurality of mode change devices.

Advantageous Effects

According to an air conditioner and a method of controlling the same of the disclosure, how each of a plurality of indoor units is connected to a mode change device can be promptly and accurately determined automatically.

According to an air conditioner and a method of controlling the same of the disclosure, the indoor units can be simultaneously operated to determine how each of the indoor units is connected to the mode change device. Therefore, it is possible to obtain connection information between the plurality of indoor units and the mode change device more promptly in comparison to a case in which the indoor units are sequentially operated.

According to an air conditioner and a method of controlling the same of the disclosure, since a user does not need to separately input information about connection states between the indoor units and the mode change device, it is possible to prevent misconfiguration by the user and improve the convenience of use.

According to an air conditioner and a method of controlling the same of the disclosure, it is possible to obtain connection information between the plurality of indoor units and the mode change device with only a least number of steps, and thus operational efficiency can be improved.

DESCRIPTION OF DRAWINGS

FIGS. 11 to 19 are views for describing an entire process of obtaining connection information between a plurality of indoor units and a plurality of mode changers when an outdoor unit is in a cooling mode.

FIGS. 20 to 27 are views for describing an entire process of obtaining connection information between a plurality of indoor units and a plurality of mode changers when an outdoor unit is in a main cooling mode.

FIG. 28 is a view for describing another example of a process of extracting an address of a valid mode changer when an outdoor unit is in a main cooling mode.

FIGS. 29 to 32 are views for describing a method of extracting an address of a valid mode changer according to another embodiment.

MODES OF THE INVENTION

Hereinafter, an air conditioner and a method of controlling the same will be described in detail through the present specification. However, not all elements of embodiments of the present disclosure are described herein, and general knowledge in the art to which the present disclosure pertains or content overlapping between the embodiments will be omitted.

Terms used herein to which the suffix "-er" or "-or" is added may be implemented with software or hardware. According to an embodiment, a plurality of elements referred to by terms to which the suffix "-er" or "-or" is added may be implemented with a single element, or a single element referred to by a term to which the suffix "-er" or "-or" is added may include a plurality of elements. Terms such as "first" and "second" are used to distinguish one part from another part and do not imply a sequential order unless particularly described otherwise.

When a certain part is described as "including" a certain element, this signifies that the certain part may also include other elements rather than excluding other elements unless particularly described otherwise. Throughout the specification, when a certain part is described as being "connected" to another part, this may include a case in which the certain part is indirectly connected to the other part as well as a case in which the certain part is directly connected to the other part, and the indirect connection includes connection through a wireless communication network.

A singular expression includes a plural expression unless context clearly indicates otherwise.

Hereinafter, an air conditioner according to various embodiments will be described with reference to FIGS. 1 to 4.

Figure 1:
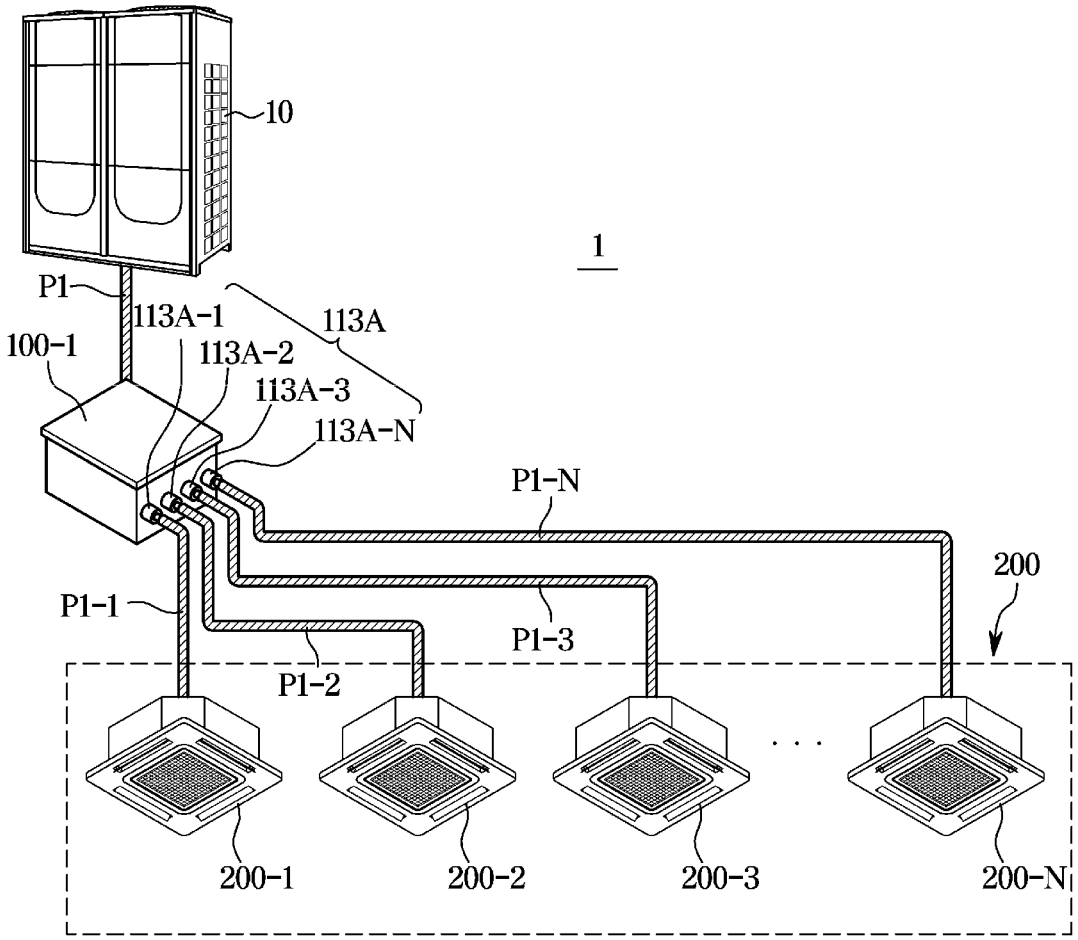
FIG. 1 is a schematic view of an air conditioner according to an embodiment.
Figure 2:
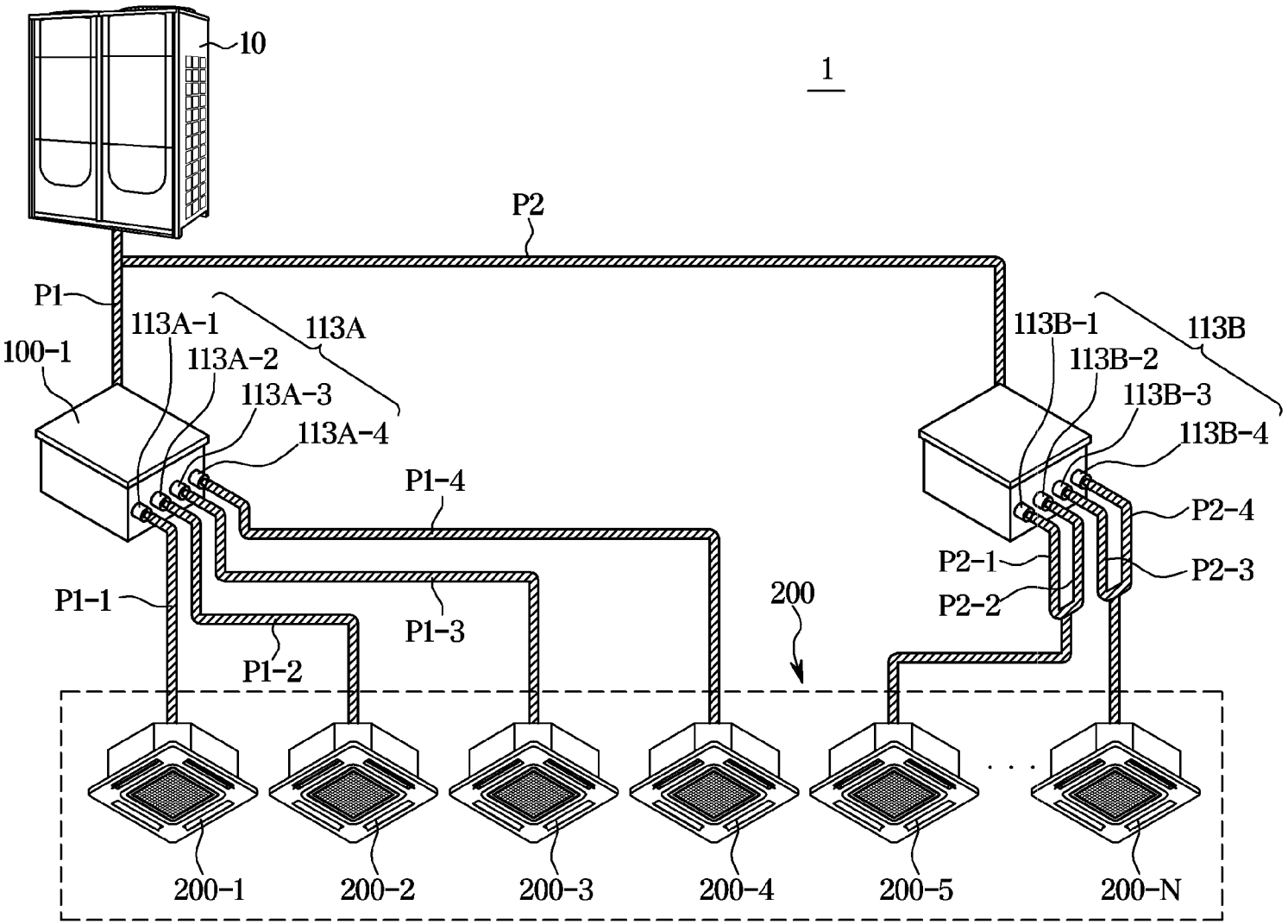
FIG. 2 is a schematic view of an air conditioner according to another embodiment.
Figure 3:
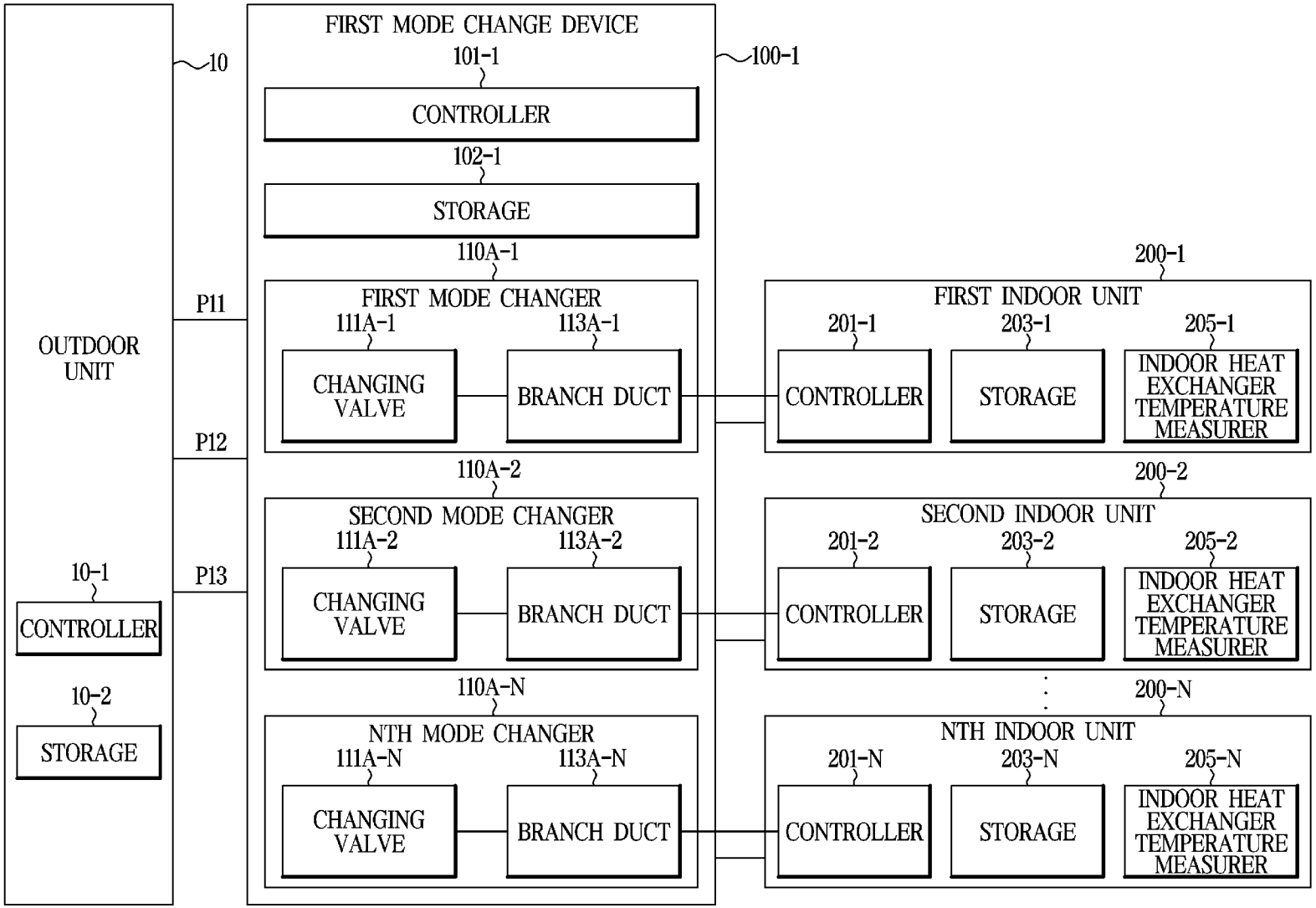
FIG. 3 is a block diagram of an air conditioner according to an embodiment and another embodiment.
Figure 4:
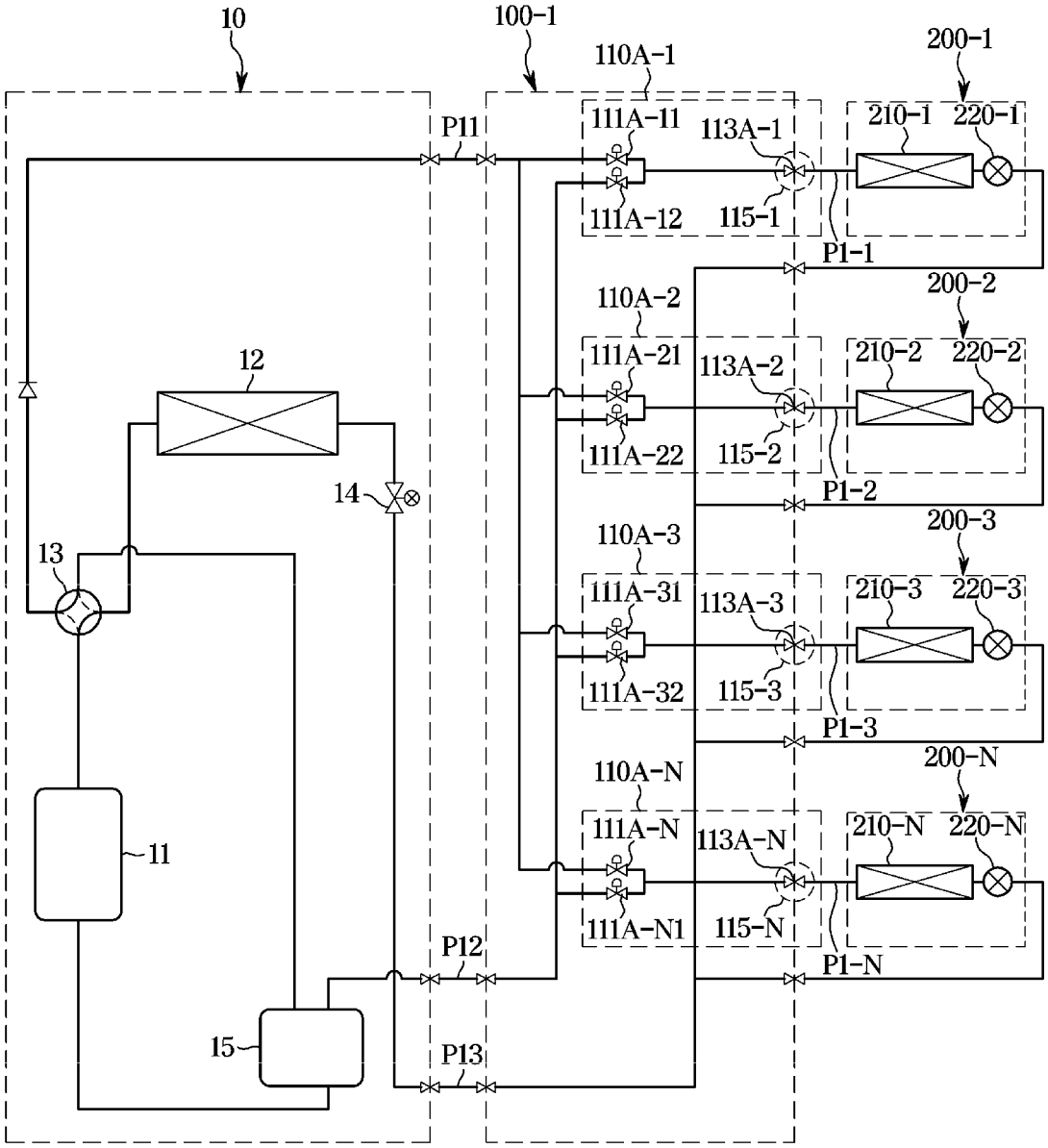
FIG. 4 is a view for describing an operation of an air conditioner according to an embodiment.

FIG. 1 is a schematic view of an air conditioner according to an embodiment, FIG. 2 is a schematic view of an air conditioner according to another embodiment, FIG. 3 is a block diagram of an air conditioner according to an embodiment and another embodiment, and FIG. 4 is a view for describing an operation of an air conditioner according to an embodiment.

Referring to FIG. 1, an air conditioner 1 may include an outdoor unit 10, a mode change device 100-1, and a plurality of indoor units 200 (200-1, 200-2, 200-3, . . . , 200-N, 200-M).

The outdoor unit 10 and the mode change device 100-1 may be connected through a pipe P1. The mode change device 100-1 and the plurality of indoor units 200 (200-1, 200-2, 200-3, . . . , 200-N, 200-M) may be connected through a plurality of pipes p1-1, p1-2, p1-3, . . . , and p1-N, respectively. N and M are natural numbers of 1 or more.

The air conditioner 1 may use a refrigerant flowing between the outdoor unit 10, the mode change device 100-1, and the plurality of indoor units 200 (200-1, 200-2, 200-3, . . . , 200-N, 200-M) to provide cold air or hot air to an indoor space in which each of the indoor units 200 (200-1, 200-2, 200-3, . . . , 200-N, 200-M) is installed.

A halogen compound refrigerant such as chlorofluorocarbon (CFC), a hydrocarbon refrigerant, carbon dioxide, ammonia, water, air, an azeotropic refrigerant, chloromethyl, or the like may be used as a refrigerant and, in addition, various other substances that may be taken into consideration by a designer may be used as the refrigerant.

The outdoor unit 10 may be disposed at an outdoor space and perform a heat exchange between outdoor air and the refrigerant. The outdoor unit 10 may be operated in a cooling mode, a heating mode, a main cooling mode, or a main heating mode according to a predetermined setting according to an outdoor temperature or a user's selection. However, as illustrated in FIG. 2, when a plurality of mode change devices 100-1 and 100-2 are included in the air conditioner 1, the outdoor unit 10 may be operated in the main cooling mode or the main heating mode.

The cooling mode of the outdoor unit 10 may refer to that all of the plurality of indoor units 200 operate in the cooling mode. The heating mode of the outdoor unit 10 may refer to that all of the plurality of indoor units 200 operate in the heating mode.

The main cooling mode of the outdoor unit 10 may refer to that the outdoor unit 10 itself operates in the cooling mode, some of the plurality of indoor units 200 are operated in the cooling mode, and others are operated in the heating mode. The main heating mode of the outdoor unit 10 may refer to that the outdoor unit 10 itself operates in the heating mode, some of the plurality of indoor units 200 are operated in the cooling mode, and others are operated in the heating mode. For the main cooling mode or the main heating mode, a plurality of mode change devices 100-1, 100-2, 100-3 may be required.

Referring to FIG. 3, the outdoor unit 10 may be connected to the mode change device 100-1 via a plurality of pipes P11, P12, and P13. Among the plurality of pipes P11 to P13, a first pipe P11 may be configured to guide a high-temperature refrigerant to the mode change device 100-1, a second pipe P12 may be configured to guide a refrigerant into which that heat is absorbed from the indoor units 200 (200-1, 200-2, 200-3, . . . , 200-N) to the outdoor unit 10, and a third pipe P13 may be configured to guide a refrigerant that emits heat to any one of the outdoor unit 10 and the indoor units 200 (200-1, 200-2, 200-3, . . . , 200-N) to the mode change device 100-1 or the outdoor unit 10.

The mode change device 100-1 may be configured to transfer a refrigerant received from the outdoor unit 10 to at least one of the plurality of indoor units 200 (200-1, 200-2, 200-3, . . . , 200-N) or transfer a refrigerant received from at least one of the plurality of indoor units 200 (200-1, 200-2, 200-3, . . . , 200-N) to the outdoor unit 10.

The mode change device 100-1 may independently control the indoor units 200-1, 200-2, 200-3, . . . , 200-N so that some of the plurality of indoor units 200 (200-1, 200-2, 200-3, . . . , 200-N) operate the cooling mode and the remaining indoor units 200-1, 200-2, 200-3, . . . , 200-N operate the heating mode under a control of the outdoor unit 10.

The mode change device 100-1 may also control the indoor units 200-1, 200-2, 200-3, . . . , 200-N so that all of the indoor units 200-1, 200-2, 200-3, . . . , 200-N operate the heating mode or all of the indoor units 200-1, 200-2, 200-3, . . . , 200-N operate the cooling mode under a control of the outdoor unit 10.

The mode change device 100-1 may be implemented with a mode change unit (MCU) configured to control a change between the cooling mode and the heating mode.

Referring to FIG. 2, the air conditioner 1 may include the plurality of mode change devices 100-1 and 100-2. A number of branch ducts 113B (113B-1, 113B-2, . . . , 113B-N) of a second mode change device 100-2 may be different from a number of branch duct 113A (113A-1, 113A-2, . . . , 113A-N) of a first mode change device 100-1. Accordingly, a number of mode changers 110B (110BA-1, 110B-2, . . . , 110BA-N) of the second mode change device 100-2 may be different from a number of mode changers 110A (110A-1, 110A-2, . . . , 110A-N) of the first mode change device 100-1.

When the air conditioner 1 includes the plurality of mode change devices 100-1 and 100-2, the outdoor unit 10 may be operated in the main heating mode or the main cooling mode. For example, when the outdoor unit 10 is operated in the main heating mode or the main cooling mode, some of the plurality of indoor units 200 (200-1, 200-2, 200-3, . . . , 200-N) may operate in the cooling mode, and other indoor units may operate in the heating mode.

Particularly, when the outdoor unit 10 is operated in the main heating mode or the main cooling mode, in order to operate the plurality of indoor units 200 (200-1, 200-2, 200-3, . . . , 200-N) in different operation modes, the outdoor unit 10 may control the first mode change device 100-1 to operate in the cooling mode and the second mode change device 100-2 to operate in the heating mode. An operation mode of each of the plurality of mode change devices 100-1 and 100-2 may be changed according to a predetermined rule. That is, each of the plurality of mode change devices 100-1 and 100-2 may control the opening or closing of a cooling valve and a heating valve by controlling the mode changers 110A and 110B according to the predetermined rule.

Referring to FIG. 3, the outdoor unit 10 may include a controller 10-1 and a storage 10-2. The controller 10-1 of the outdoor unit 10 may generate a control signal for controlling each of the plurality of mode change devices 100-1 and 100-2 and transmit it to each mode change device 100-1 and 100-2. For example, the storage 10-2 may store an address for each of the mode changers 110A (110A-1, 110A-2, . . . , 110A-N).

Meanwhile, in FIG. 3, the outdoor unit 10 is illustrated to be connected to one mode change device 100-1, but the number of mode change devices is not limited thereto. That is, the air conditioner 1 may include the plurality of mode change devices 100 such as a second mode change device 100-2 and a third mode change device 100-3 in addition to a first mode change device 100-1.

When the air conditioner 1 includes the plurality of mode change devices 100 (100-1, 100-2, 100-3), the second mode change device 100-2, the third mode change device 100-3 may also include controllers 101B and 101C, storages 102B and 102C, and at least one mode changer 110B or 110C (110B-1, . . . , 110B-N, 110C-1, . . . , 110C-N).

Hereinafter, the first mode change device 100-1 will be described in detail.

The first mode change device 100-1 may include a controller 101A-1, a storage 102A-1, and the plurality of mode changers 110A (110A-1, 110A-2, . . . , 110A-N).

The controller 101A-1 of the first mode change device 100-1 may generate the control signal for operating the first mode change device 100-1, and transmit the generated control signal to each of the plurality of mode changers 110A (110A-1, 110A-2, . . . , 110A-N). Accordingly, the plurality of mode changers 110A (110A-1, 110A-2, . . . , 110A-N) may operate in the cooling mode or the heating mode.

Each controller of the outdoor unit 10 and the mode change device 100-1 may control the overall operation of the outdoor unit 10 and the mode change device 100, respectively. The controller may correspond to a processor capable of performing various operations and control processing, such as a central processing unit (CPU) and a micro control unit (MCU).

The storage 102A-1 of the first mode change device 100-1 may store various types of information necessary for the operation of the controller 101A-1. For example, the storage 102A-1 may record various information, settings, and/or programs related to the operation of controller 101A-1, and provide various types of information, settings, and/or programs to the controller 101A-1 according to the call of controller 101A-1. For example, the storage 102A-1 may store the address for each of the mode changers 110A (110A-1, 110A-2, . . . , 110A-N).

The storage 10-2, 102, and 203 of the outdoor unit 10, the mode change device 100, and the indoor unit 200, respectively, may be implemented using a magnetic disk storage medium, a magnetic drum storage medium, or a semiconductor storage medium. For example, the semiconductor storage medium may include a volatile memory such as a static random access memory (S-RAM) and a dynamic RAM (D-RAM) or may include a nonvolatile memory such as a read only memory (ROM), an erasable programmable ROM (EPROM), an electrically EPROM (EEPROM), and a flash memory.

Each of the plurality of indoor units 200 (200-1, 200-2, 200-3, . . . , 200-N) may be connected to at least one mode changer 110A (110A-1, 110A-2, . . . , 110A-N), and the mode changer 110A (110A-1, 110A-2, . . . , 110A-N) may selectively connect the indoor units 200 (200-1, 200-2, 200-3, . . . 200-N) to one of the first pipe P11 and the second pipe P12.

According to the embodiment, the mode changers 110A (110A-1, 110A-2, . . . , 110A-N) may include changing valves 111A (111A-1, 111A-2, . . . , 111A-N) and the branch ducts 113A (113A-1, 113A-2, . . . , 113A-N). The plurality of mode changers 110A (110A-1, 110A-2, . . . , 110A-N, 110B-M) may control the changing valves 111A (111A-1, 111A-2 . . . , 111A-N) according to the operation mode of the outdoor unit 10.

Although the branch ducts 113A (113A-1, 113A-2, . . . , 113A-N, 113B-M) may be referred to as ports, the branch ducts 113A (113A-1, 113A-2, . . . , 113A-N, 113B-M) will be referred to as branch ducts for convenience of description.

The changing valves 111A (111A-1, 111A-2, . . . , 111A-N, 111B-M) may directly or indirectly connect the one or more indoor units 200 (200-1, 200-2, 200-3, . . . , 200-N, 200-M) connected to corresponding branch ducts 113A (113A-1, 113A-2, . . . , 113A-N) via the pipes P1-1, P1-2, P1-3, P1-N to any one of the first pipe P11 and the second pipe P12.

In response to each of the branch ducts 113A (113A-1, 113A-2, . . . , 113A-N) of the first mode change device 100-1, the changing valves 111A (111A-1, 111A-2, . . . , 111A-N) may be provided. That is, one branch duct 113A (113A-1, 113A-2, . . . , or 113A-N) and one changing valve 111A (111A-1, 111A-2, . . . , or 111A-N) may be connected.

The branch ducts 113A (113A-1, 113A-2, . . . , 113A-N) may be provided so that one end of the pipes P1-1, P1-2, P1-3, . . . , and P1-N can be mounted. The other end of the pipes P1-1, P1-2, P1-3, . . . , and P1-N may be connected to the indoor units 200 (200-1, 200-2, 200-3, . . . , 200-N). Accordingly, each of the indoor units 200 (200-1, 200-2, 200-3, . . . , 200-N) may be connected to at least one of the plurality of branch ducts 113A (113A-1, 113A-2, . . . , 113A-N) of the first mode change device 100-1. Accordingly, the refrigerant may flow between the branch ducts 113A (113A-1, 113A-2, . . . , 113A-N) and the indoor units 200 (200-1, 200-2, 200-3, . . . 200-N).

Particularly, as illustrated in FIG. 2, each of the plurality of indoor units 200-1, 200-2, 200-3, and 200-4 may be connected to one branch duct 113A (113A-1, 113A-2, or 113A-4), or two branch ducts 113B-1 and 113B-2 may be connected to one indoor unit 200-5.

The plurality of indoor units 200 (200-1, 200-2, 200-3, . . . 200-N) may operate in the heating mode to emit hot air to the indoor space, or operate in the cooling mode to emit cool air into the indoor space, thereby controlling a temperature of the indoor space.

Meanwhile, referring to FIG. 3, the plurality of indoor units 200 200-1, 200-2, 200-3, . . . , 200-N may include controllers 201-1, 201-2, . . . , 201-N, storages 203-1, 203-2, . . . , 203-N, and indoor heat exchanger temperature measurers 205-1, 205-2, . . . , and 205-N.

The controllers 201 (201-1, 201-2, . . . , 201-N, 201-M) of the indoor unit 200 may be provided to control the overall operation of the indoor unit 200. The controller 201 may be separately provided for each indoor unit 200.

The controller 201 of each of the plurality of indoor units 200 may determine the mode changers 110A-1, 110A-2, . . . , 110A-N, and 110B-M connected to the indoor unit 200. To this end, the controllers 201-1, 201-2, . . . , 201-N, and 201-M may call a predetermined program stored in the storages 203-1, 203-2, 203-N, and 203-M, and may determine the mode changers 110A and 110B connected to the indoor units 200-1, 200-2, 200-3, . . . 200-N, and 200-M by driving the called program.

In addition, the controller 201 of the indoor unit 200 may determine the mode changers 110A-1, 110A-2, . . . , 110A-N, 110B-M, which is connected to each of the plurality of indoor units 200-1, 200-2, 200-3, . . . , and 200-N, . . . , 110A-N, 110B-M). The controller 201 of the indoor unit 200 may obtain connection information includes the plurality of indoor units 200-1, 200-2, 200-3, . . . , and 200-N and the branch duct 113A of the mode changers 110A (110A-1, 110A-2, . . . , 110A-N), and may control the connection information to be stored by transmitting the obtained connection information to the storages 203-1, 203-2, . . . , and 203-N. The controller 201 of the indoor unit 200 may be implemented using a processor capable of performing various operations and control processing, such as the CPU and the MCU.

The storages 203-1, 203-2, . . . , 203-N, and 203-M of the indoor unit 200 may be provided to store various types of information, data, or programs necessary for the operation of the controllers 201-1, 201-2, . . . , 201-N, and 201-M.

For example, the storage 203 of the indoor unit 200 may store the address for each of the mode changers 110A and 110B, or may store information about the plurality of indoor units 200 (200-1, 200-2, 200-3, . . . , 200-N, 200-M) operating in the cooling mode or the heating mode at a specific time point. In addition, the storages 203 (203-1, 203-2, . . . , 203-N, 203-M) may store various types of data and information necessary for a process of determining the mode changers 110A and 110B connected to each of the plurality of indoor units 200. The storage 203 may be implemented using the magnetic disk storage medium, the magnetic drum storage medium, or the semiconductor storage medium.

The indoor heat exchanger temperature measurers 205 (205-1, 205-2, . . . , 205-N, 205-M) may measure temperatures of indoor heat exchangers 210 (210-1, 210-2, 210-3, 210-3, . . . , 210-N, 210-M) respectively disposed in the each indoor unit 200 or temperature of air around the indoor heat exchangers 210.

The indoor heat exchanger temperature measurers 205 (205-1, 205-2, . . . , 205-N, 205-M), the controller 10-1 of the outdoor unit 10, the controllers 101A-1 and 101B-1 of the mode change devices 100-1 and 100-2, and the controllers 201-1, 201-2, . . . , and 201-N of the indoor units 200 (200-1, 200-2, 200-3, . . . , 200-N) may be provided to enable mutual communication using wired communication and/or wireless communication. The temperature of the indoor heat exchanger 210 or the temperature of air around the indoor heat exchangers 210 measured by the indoor heat exchanger temperature measurer 205 may be converted into data and transmitted to the controller 10-1 of the outdoor unit 10, the controllers 101A-1 and 101B-1 of the plurality of mode change devices 100-1 and 100-2, or the controller 201 of each indoor unit 200.

The indoor units 200 may include a ceiling-mounted indoor unit, a wall-mounted indoor unit, or a floor-standing indoor unit.

Hereinafter, a process in which the air conditioner 1 operates will be described in more detail with reference to FIG. 4. FIG. 4 illustrates the outdoor unit 10, the first mode change device 100-1, and the plurality of indoor units 200 (200-1, 200-2, . . . , 200-N) connected to the first mode change device 100-1.

The outdoor unit 10 may include at least one compressor 11 configured to compress a refrigerant, an outdoor heat exchanger 12 configured to perform a heat exchange between outdoor air and the refrigerant, and an expansion valve 14 configured to decompress a refrigerant transferred to the indoor units 200-1, 200-2, 200-3, 200-4, . . . , 200-N during the cooling mode and decompress a refrigerant transferred to the outdoor heat exchanger 12 during the heating mode.

The outdoor unit 10 may further include a four-way valve 13 configured to selectively guide the refrigerant discharged from the compressor 11. The four-way valve 13 may connect any two of four outlets to each other and connect the other two outlets to determine a direction in which the refrigerant flows. The four-way valve 13 may guide the refrigerant discharged from the compressor 11 toward the first pipe P11 or toward the outdoor heat exchanger 12 depending on operations and allow the outdoor unit 10 to perform the heating mode or the cooling mode.

The four-way valve 13 may be configured to change the direction in which the refrigerant flows according to a predetermined pattern. For example, the four-way valve 13 may periodically change the direction in which the refrigerant flows. According to another embodiment, the four-way valve 13 may be configured to arbitrarily change the direction in which the refrigerant flows.

The outdoor unit 10 may further include an accumulator 15 to prevent introduction of a liquid refrigerant into the compressor 11. The accumulator 15 may separate an unevaporated liquid refrigerant and an evaporated gaseous refrigerant from each other and then provide the gaseous refrigerant to the compressor 11.

The first mode change device 100-1 may include the plurality of mode changers 110A (110A-1, 110A-2, . . . , 110A-N) connected in parallel with each other. The plurality of mode changers 110A (110A-1, 110A-2, . . . , 110A-N) may each include the changing valves 111A (111A-1, 111A-2, . . . , 111A-N).

Each of the changing valves 111A (111A-1, 111A-2, . . . , 111A-N) may include heating valves 111A-11, 111A-21, 111A-31, . . . , and 111A-N1 and cooling valves 111A-12, 111A-22, 111A-32, . . . , and 111A-N2. For example, the first changing valve 111A-1 may include a first heating valve 111A-11 and a first cooling valve 111A-12. The heating valves 111A-11, 111A-21, 111A-31, . . . , and 111A-N1 and the cooling valves 111A-12, 111A-22, 111A-32, . . . , and 111A-N2 may be solenoid valves.

When the outdoor unit 10 is operated in the heating mode, among the changing valves 111A (111A-1, 111A-2, . . . , 111A-N), the heating valves 111A-11, 111A-21, 111A-31, . . . , and 111A-N1 may be opened, and the indoor units 200 (200-1, 200-2, 200-3, . . . , 200-N) connected to the branch ducts 113A (113A-1, 113A-2, . . . , 113A-N) may be connected to the first pipe P11 to operate in the heating mode. At this time, the cooling valves 111A-12, 111A-22, 111A-32, . . . , and 111A-N2 may all be closed.

In addition, when the outdoor unit 10 is operated in the cooling mode, among the changing valves 111A (111A-1, 111A-2, . . . , 111A-N), the cooling valves 111A-12, 111A-22, 111A-32, . . . , and 111A-N2 may be opened, and the indoor units 200 (200-1, 200-2, 200-3, . . . , 200-N) connected to the branch ducts 113A (113A-1, 113A-2, . . . , 113A-N) may be connected to the second pipe P12 to operate in the cooling mode. At this time, the heating valves 111A-11, 111A-21, 111A-31, . . . , and 111A-N1 may all be closed.

When the first mode change device 100-1 operates in the heating mode according to the control of the outdoor unit 10, the heating valve 111A-11 opens a flow path to connect the first indoor unit 200-1 and the first pipe P11. The cooling valve 111A-12 may close the flow path to block the connection between the first indoor unit 200-1 and the second pipe P12.

When the first mode change device 100-1 operates in the cooling mode according to the control of the outdoor unit 10, the heating valve 111A-11 closes the flow path to connect the first indoor unit 200-1 and the first pipe P11. The cooling valve 111A-12 may open the flow path to connect the first indoor unit 200-1 and the second pipe P12.

The heating valve 111A-11 and the cooling valve 111A-12 alternately open or close the flow path according to the operation mode of the first mode changer 110A-1. Accordingly, the first indoor unit 200-1 may operate in the heating mode or the cooling mode.

Particularly, when the heating valve 111A-11 opens the flow path and the cooling valve 111A-12 closes the flow path, the refrigerant discharged from the compressor 11 and guided via the first pipe P11 may be transmitted to the first indoor unit 200-1, and accordingly, the first indoor unit 200-1 may perform the heating mode.

Conversely, when the heating valve 111A-11 closes the flow path and the cooling valve 111A-12 opens the flow path, the refrigerant discharged from the expansion valve 14 and guided via the third pipe P13 is transmitted to the first indoor unit 200-1, and accordingly, the first indoor unit 200-1 may perform the cooling mode. In this case, the refrigerant discharged from the first indoor unit 200-1 may be transmitted to the compressor 11 or the accumulator 15 via the flow path opened by the cooling valve 111A-12 and the second pipe P12.

Although the operation of the first changing valve 111A-1 among the plurality of changing valves 111A (111A-1, 111A-2, . . . , 111-N) illustrated in FIG. 4 has been described above, the changing valves 111-2, . . . , 111-N other than the first changing valve 111A-1 may also include the heating valves 111A-21, 111A-31, . . . , and 111A-N1 and the cooling valves 111A-22, 111A-32, . . . , and 111A-N2, respectively.

As described above, each of the plurality of mode changers 110A (110A-1, 110A-2, . . . , 110A-N) may include the branch ducts 113A (113A-1, 113A-2, 113A-N) at which the pipes P1-1, P1-2, P1-3, . . . , and P1-N are respectively installed.

Predetermined valves 115-1, 115-2, 115-3, 115-4, . . . , and 115-N may be installed at the branch ducts 113A (113A-1, 113A-2, . . . , 113A-N), The predetermined valves 115-1, 115-2, 115-3, 115-4, . . . , 115-N provided at the points where the branch ducts 113A (113A-1, 113A-2, . . . , 113A-N) and indoor units 200 (200-1, 200-2, 200-3, . . . , 200-N) may block transfer of the refrigerant discharged from the changing valves 111A (111A-1, 111A-2, . . . , 111A-N) to the indoor units 200-1, 200-2, 200-3, 200-4, . . . , and 200-N.

Meanwhile, as illustrated in FIG. 4, the indoor units 200 (200-1, 200-2, 200-3, . . . , 200-N) may include the indoor heat exchangers 210 (210-1, 210-2, 210-3, . . . , 210-N) configured to perform a heat exchange between indoor air and the refrigerant. The indoor heat exchangers 210 (210-1, 210-2, 210-3, . . . , 210-N) absorb heat and are cooled when the indoor units 200-1, 200-2, 200-3, 200-4, . . . , and 200-N perform a cooling operation and emit heat to the outside when the indoor units 200-1, 200-2, 200-3, 200-4, . . . , and 200-N perform a heating operation.

The indoor units 200 (200-1, 200-2, 200-3, 200-4, . . . 200-N) may further include indoor expansion valves 220 (220-1, 220-2, 220-3, 220-4, . . . , 220-N) configured to decompress the refrigerant provided to the indoor heat exchangers 210 during the cooling mode.

Hereinafter, refrigerant flows in the case in which the indoor units 200 (200-1, 200-2, 200-3, 200-4, . . . , 200-N) operate the cooling mode or the heating mode will be described.

When the outdoor unit 10 operates the cooling mode and, accordingly, the plurality of indoor units 200 (200-1, 200-2, 200-3, 200-4, . . . , 200-N) operate the cooling mode, the refrigerant is compressed with a high pressure by the compressor 11 of the outdoor unit 10, and the compressed refrigerant flows to the outdoor heat exchanger 12 by the four-way valve 13. The compressed refrigerant is condensed in the outdoor heat exchanger 12 and emits latent heat. The condensed refrigerant is expanded through the expansion valve 14. The expanded refrigerant is guided to the indoor units 200-1, 200-2, 200-3, 200-4, . . . , 200-N performing the cooling operation via the control device 100. The refrigerant guided to the indoor units 200-1, 200-2, 200-3, 200-4, . . . , 200-N is decompressed in the indoor expansion valves 220-1, 220-2, 220-3, 220-4, . . . , 220-N disposed in the indoor units 200-1, 200-2, 200-3, 200-4, . . . , 200-N and then evaporated in the indoor heat exchangers 210-1, 210-2, 210-3, 210-4, . . . , 210-N. While the refrigerant is being evaporated, the refrigerant absorbs latent heat from indoor air and, accordingly, the indoor heat exchangers 210-1, 210-2, 210-3, 210-4, and 210-N or air around the indoor heat exchangers 210-1, 210-2, 210-3, 210-4, and 210-N are cooled. The indoor heat exchangers 210-1, 210-2, 210-3, 210-4, and 210-N discharge the refrigerant into which latent heat is absorbed, and the discharged refrigerant is guided to the outdoor unit 10 via flow paths opened by the cooling valves 111A-12, 111A-22, 111A-32, . . . , 111A-N2 of the mode change device 100-1 and the second pipe P12. The refrigerant is transferred to the compressor 11 via the accumulator 15, compressed by the compressor 11, and then transferred again to the four-way valve 13.

When the outdoor unit 10 operates the heating mode and, accordingly, the plurality of indoor units 200 (200-1, 200-2, 200-3, 200-4, . . . , 200-N) operate the heating mode, the refrigerant is compressed with the high pressure by the compressor 11 of the outdoor unit 10, and the compressed refrigerant flows to the first pipe P11 by the four-way valve 13. The compressed refrigerant passes through flow paths opened by the heating valves 111A-11, 111A-21, 111A-31, . . . , 111-N1A of the mode change device 100-1 and is guided to the indoor units 200-1, 200-2, 200-3, 200-4, . . . , 200-N. The refrigerant is condensed in the indoor heat exchangers 210-1, 210-2, 210-3, 210-4, . . . , 210-N disposed in the indoor units 200-1, 200-2, 200-3, 200-4, . . . , 200-N. While the refrigerant is being condensed, the refrigerant emits latent heat and, accordingly, the indoor heat exchangers 210-1, 210-2, 210-3, 210-4, and 210-N or air around the indoor heat exchangers 210-1, 210-2, 210-3, 210-4, and 210-N are heated. The condensed refrigerant is decompressed in the indoor expansion valves 220-1, 220-2, 220-3, 220-4, . . . , 220-N and then flows to the outdoor unit 10 via the mode change device 100-1 and the third pipe P13. The refrigerant transferred to the outdoor unit 10 is decompressed in an outdoor expansion valve 14, absorbs latent heat from the outdoor heat exchanger 12, and is transferred to the accumulator 15 or the compressor 11. The accumulator 15 separates an unevaporated liquid refrigerant and an evaporated gaseous refrigerant from each other and transfers the gaseous refrigerant to the compressor 11. The compressor 11 compresses the refrigerant provided from the outdoor heat exchanger 12 or the accumulator 15 and transfers the compressed refrigerant back to the four-way valve 13.

Through the above-described process, the air conditioner 1 may heat or cool a plurality of indoor spaces. In this case, the air conditioner 1 may selectively heat or cool one or more indoor spaces in which the one or more indoor units 200 are respectively installed. That is, the air conditioner 1 may heat some of the plurality of indoor spaces and cool the remaining indoor spaces.

In order for the plurality of indoor units 200 to properly operate in the cooling mode or the heating mode, at least one of the plurality of branch ducts 113A and 113B must be properly connected to each of the plurality of indoor units 200.

The air conditioner 1 may automatically detect how each of the plurality of indoor units 200 (200-1, 200-2, 200-3, 200-4, . . . , 200-N, 200-M) is connected to the mode change devices 100-1 and 100-2. Particularly, the air conditioner 1 may accurately identify positions of the branch ducts 113A and 113B connected to each of the plurality of indoor units 200, and may obtain the connection information between the plurality of indoor units 200 and the plurality of mode changers 110A and 110B or the connection information between the plurality of mode changers 110A and 110B.

Hereinafter, an embodiment of a method for controlling an air conditioner will be described with reference to FIGS. 5 to 32.

Figure 5:
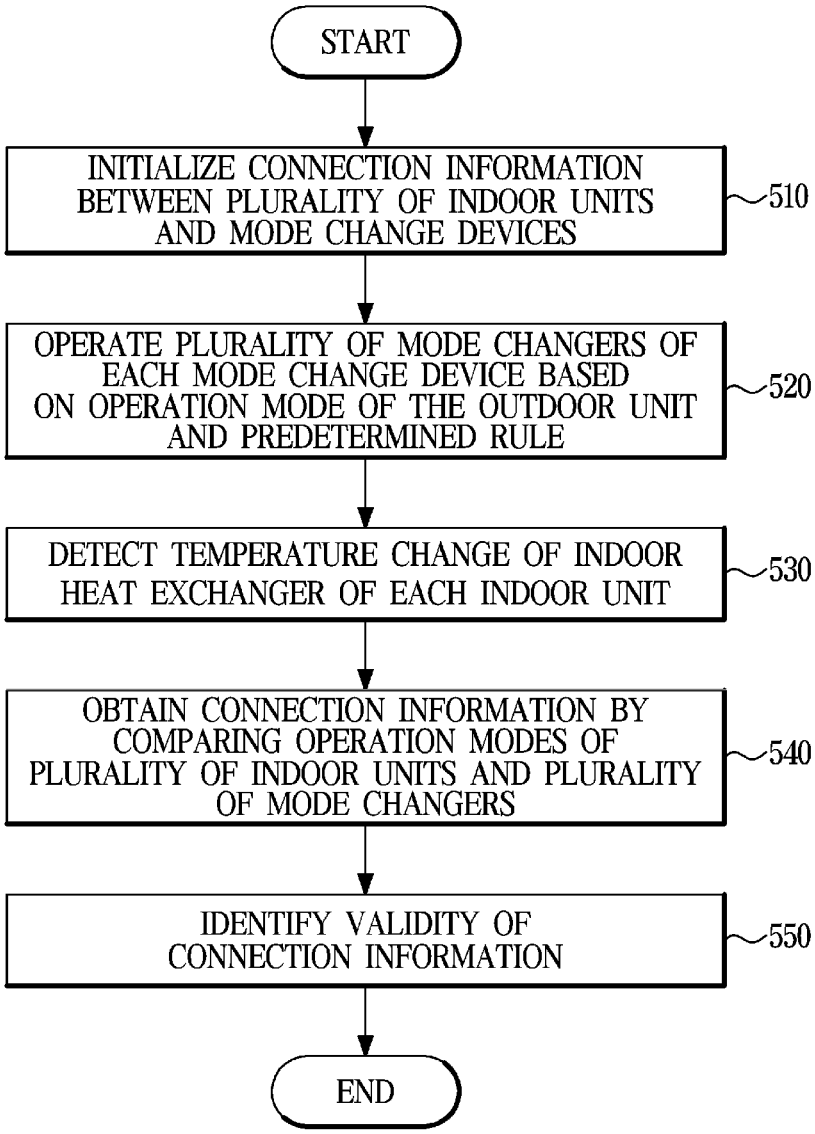
FIG. 5 is a flowchart illustrating an overall method of controlling an air conditioner according to an embodiment.
Figure 6:
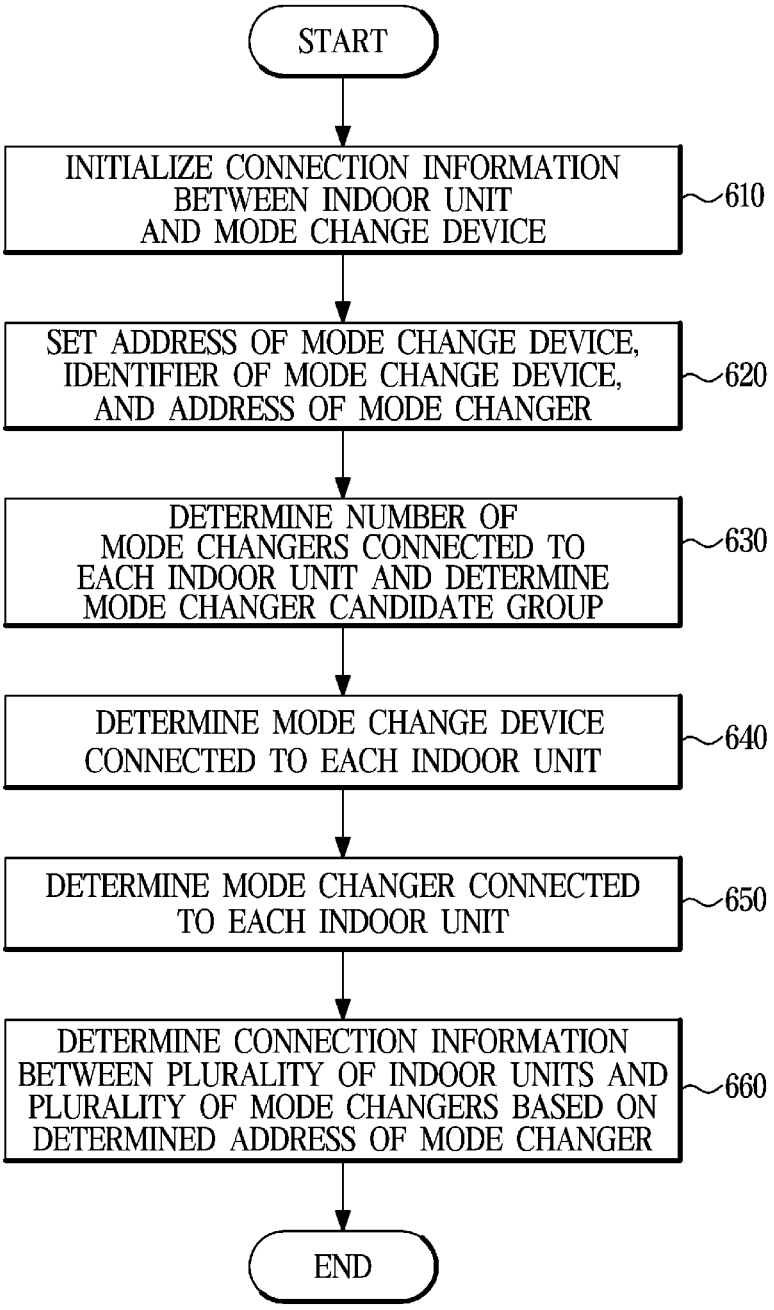
FIG. 6 is a flowchart illustrating in more detail the method of controlling the air conditioner of FIG. 5.

FIG. 5 is a flowchart illustrating an overall method of controlling an air conditioner according to an embodiment. FIG. 6 is a flowchart illustrating in more detail the method of controlling the air conditioner of FIG. 5.

First, the connection information between the plurality of indoor units 200 and the plurality of mode changers 110A and 110B of the mode change device 100-1 may be obtained through a plurality of operations, and the plurality of mode changers 110A and 110B may be operated based on predetermined rules for each operation.

When the process of obtaining the connection information between the plurality of indoor units 200 and the plurality of mode changers 110A and 110B is started, the air conditioner 1 may operate the outdoor unit 10 in the cooling mode, the heating mode, the main cooling mode, or the main heating mode according to the outdoor temperature. When the air conditioner 1 includes only one mode change device 100-1, the outdoor unit 10 may operate in the cooling mode or the heating mode. When the air conditioner 1 includes the plurality of mode change devices 100-2 and 100-2, the outdoor unit 10 may operate in the cooling mode, the heating mode, the main cooling mode, or the main heating mode. FIGS. 2 and 3 illustrate that two mode change devices 100-1 and 100-2 are included in the air conditioner 1, but the number of mode change devices is not limited thereto.

In addition, the outdoor unit 10, the plurality of mode change devices 100-1 and 100-2, and the plurality of indoor units 200 are interconnected, so that the process of obtaining information on where the plurality of indoor units 200 are connected among the plurality of mode changers 110A and 110B included in the plurality of mode change devices 100-1 and 100-2 may be performed.

In addition, when the plurality of indoor units 200 are connected to the plurality of mode changers 110A, it is assumed that all of the indoor units 200 operate simultaneously according to the operation of the outdoor unit 10 and the operation of the plurality of mode changers 110A and 110B.

In order to obtain the connection information between the plurality of indoor units 200 (200-1, 200-2, 200-3, . . . , 200-N) and the branch ducts 113A and 113B of the plurality of mode changers 110A (110A-1, 110A-2, . . . , 110A-N), it is necessary to set the address to each of the plurality of indoor units 200 (200-1, 200-2, 200-3, . . . , 200-N), the plurality of mode change devices 100-1 and 100-2, and the plurality of mode changers 110A (110A-1, 110A-2, . . . , 110A-N). Meanwhile, for each of the plurality of mode change devices 100-1 and 100-2, the address may be designated by a user.

However, when the process of obtaining branch duct connection information is started, the controller 10-1 of the outdoor unit 10 may initialize the connection information between the plurality of indoor units 200 and the mode change devices 100 (100-1, 100-2) regardless of the address specified by the user or a preset address (510, 610), and may reset address for each of the plurality of indoor units 200, the mode change device 100, and the plurality of mode changers 110A and 110B (620).

Hereinafter, the address set in each of the plurality of indoor units 200, the mode change device 100, and the plurality of mode changers 110A and 110B may be described as the address of the indoor unit 200, the address of the mode change device 100, and the address of the mode changer 110.

In addition, in addition to the 'address', the 'identifier' may be set in the mode change device 100 (620). The identifier of the mode change device 100 may be a value that is changed according to the predetermined rule while obtaining the connection information between the plurality of indoor units 200 and the mode change device 100. These addresses or identifiers may be set as numbers.

When there are the plurality of mode change devices 100 (100-1, 100-2), the address for each of the mode change devices 100-1 and 100-2 may be designated as the natural number sequentially increasing from 0 to 1, and the addresses for each of the plurality of mode changers 110A included in each mode change device 100-1 and 100-2 may also be designated as the natural number sequentially increasing from 1 to 1. The address of the mode changer 110A may include the address of the mode change device 100. For example, when the address of the mode change device 100-1 is 0 and there are four mode changers 110A, the addresses of the mode changer 110A may be 01, 02, 03, and 04, respectively.

The controller 10-1 of the outdoor unit 10 may set the address for each device, and then operate the plurality of mode changers 110A and 110B according to the operation mode of the outdoor unit 10 and the predetermined rule (520). Accordingly, when the changing valves 111A and 111B of the plurality of mode changers 110A and 110B operate, and the refrigerant flows through each of the plurality of indoor units 200, the indoor heat exchanger temperature measurer 205 may detect a temperature change of the indoor heat exchanger 210 (530).

Each of the plurality of indoor units 200 may determine the operation mode of each of the indoor units 200 based on the temperature change detected by the indoor heat exchanger temperature measurer 205.

Meanwhile, when the temperature change of the indoor heat exchanger 210 satisfies some or all of the following reference (a to c), it may be determined that it occurs due to the refrigerant flowing by the operation of the mode changer 110A.

(a) An elapse of a minimum time for the temperature of the indoor heat exchanger 210 to change or saturate (b) |The temperature of the indoor heat exchanger 210 measured in a previous step—The temperature of the indoor heat exchanger 210 measured in the current step|>a predetermined value ($\alpha$)

(c) |Indoor temperature—the temperature of the indoor heat exchanger 210 measured at the current step|>a predetermined value ($\beta$)

Each of the plurality of indoor units 200 may control each operation mode of each of the indoor units 200 based on the temperature change measured by each indoor heat exchanger temperature measurer 205-1, 205-2, . . . , or 205-N of each of the indoor units 200, and may obtain the connection information between the plurality of indoor units 200 and the plurality of mode changers 110A by comparing the operation mode of each of the indoor units 200 with the operation mode of the plurality of mode changers 110A (540).

Each of the plurality of indoor units 200 may identify the validity of the connection information between the finally obtained indoor unit 200 and the mode changer 110A, and determine whether a connection state between the indoor unit 200 and the mode changer 110A is normal or abnormal (550).

Referring to FIG. 6, the controller 10-1 of the outdoor unit 10 may be initialized and reset the addresses of the plurality of mode change devices 100-1 and 100-2, identifiers of the plurality of mode change devices 100-1 and 100-2, and the addresses of the mode changers 110A and 110B) (610, 620).

Thereafter, each of the plurality of indoor units 200 may determine the number of mode changers 110A and 110B connected to each of the plurality of indoor units 200, and may determine the mode changer candidate group to extract the addresses of the mode changers 110A and 110B, which is actually connected to each of the plurality of indoor units 200 (630). The determining the mode changer candidate group will be described in more detail in FIGS. 7, 8A, and 8B.

Each of the plurality of indoor units 200 may extracts the addresses of the mode change devices 100-1 and 100-2 to which each of the plurality of indoor units 200 is connected, based on the temperature change of the indoor heat exchanger 210, and may determine the mode change devices 100-1 and 100-2 to which each of the plurality of indoor units 200 is actually connected (640). The mode change device is determined by extracting the address of a valid mode changer from the mode changer candidate group, which is a set of addresses of mode changers 110A and 110B that may be connected to the plurality of indoor units 200.

Extracting the address of the valid mode changer may refer to that each of the plurality of indoor units 200 detects the addresses of the mode changers 110A and 110B related to the temperature change of the indoor heat exchanger 210.

Particularly, each of the plurality of indoor units 200 may compare the operation mode of each of the plurality of indoor units 200 and the operation modes of the plurality of mode changers 110A according to the temperature change of the indoor heat exchanger 210 and delete the address of the mode changer 110A operating in an operation mode that is not the same as the operation mode of the indoor unit 200. This will be described in more detail in FIG. 9.

When the number of mode change devices 100-1 included in the air conditioner 1 is one, the process of determining the mode change device may be omitted.

Thereafter, each of the plurality of indoor units 200 may extract the addresses of the mode changers 110A and 110B connected to each of the plurality of indoor units 200, and may determine the mode changers 110A and 110B in which each of the plurality of indoor units 200 is actually connected (650). The mode changers 110A and 110B are determined by extracting the address of the valid mode changer from the mode changer candidate group, similar to the process of determining the mode change device. This will be described in more detail in FIG. 10.

Finally, the each of the plurality of indoor units 200 may determine the connection information between the plurality of indoor units 200 and the branch ducts 113A and 113B of the plurality of mode changers 110A and 110B based on the determined address of the mode changer 110A and 110B (660). Particularly, each of the plurality of indoor units 200 may determine the address of the valid mode changer as branch duct connection information when the extracted valid mode changer address is one.

In addition, the each of the plurality of indoor units 200 may be determined to be directly connected to the outdoor unit 10 when there is no address of the extracted valid mode changer. The indoor unit directly connected to the outdoor unit 10 may correspond to a cooling-only or heating-only indoor unit.

Figure 7:
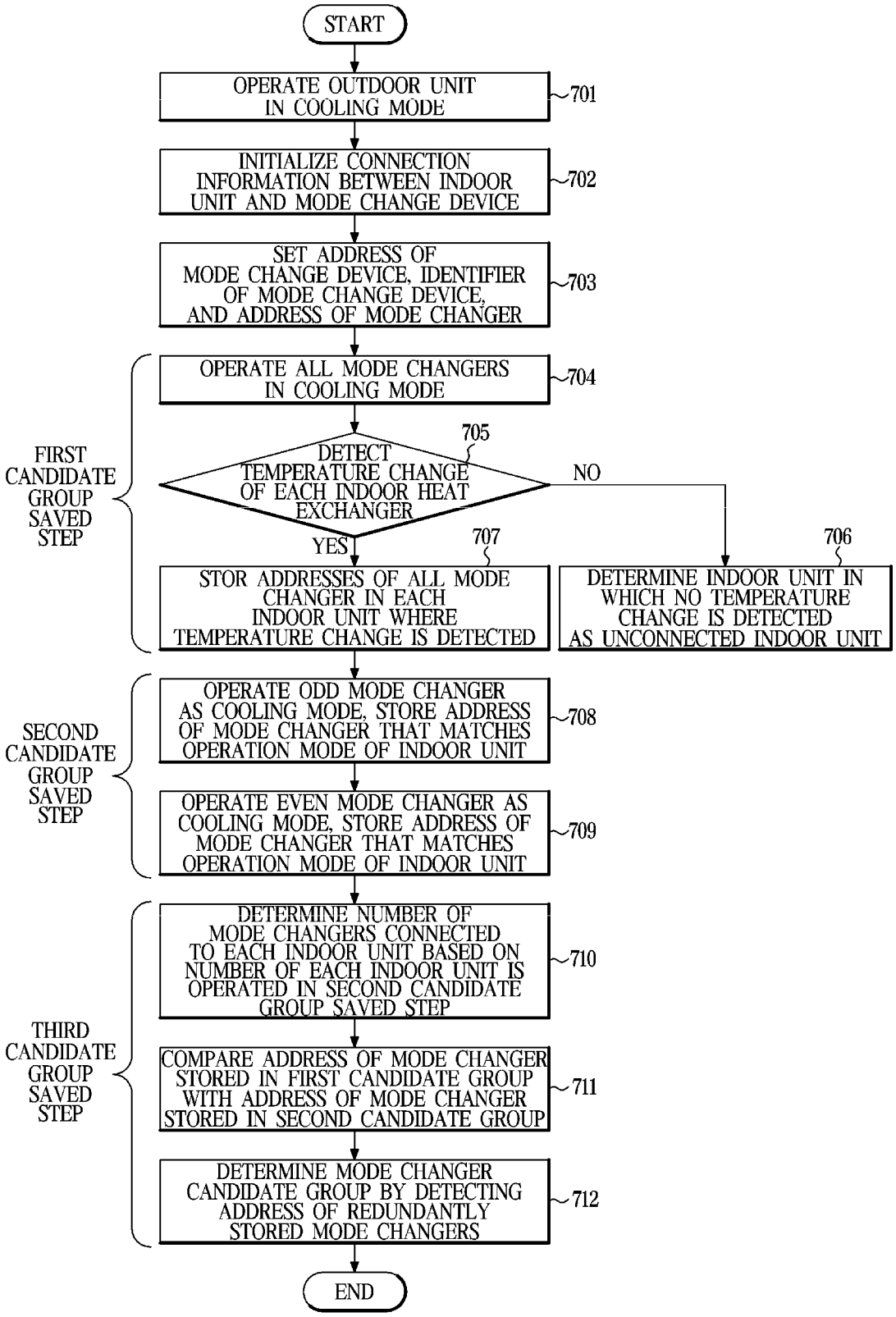
FIGS. 7, 8A, and 8B are flowcharts illustrating a process of determining a mode changer candidate group according to an operation mode of an outdoor unit in relation to a process of determining the mode changer candidate group among the contents described in FIG. 6.
Figure 8A:
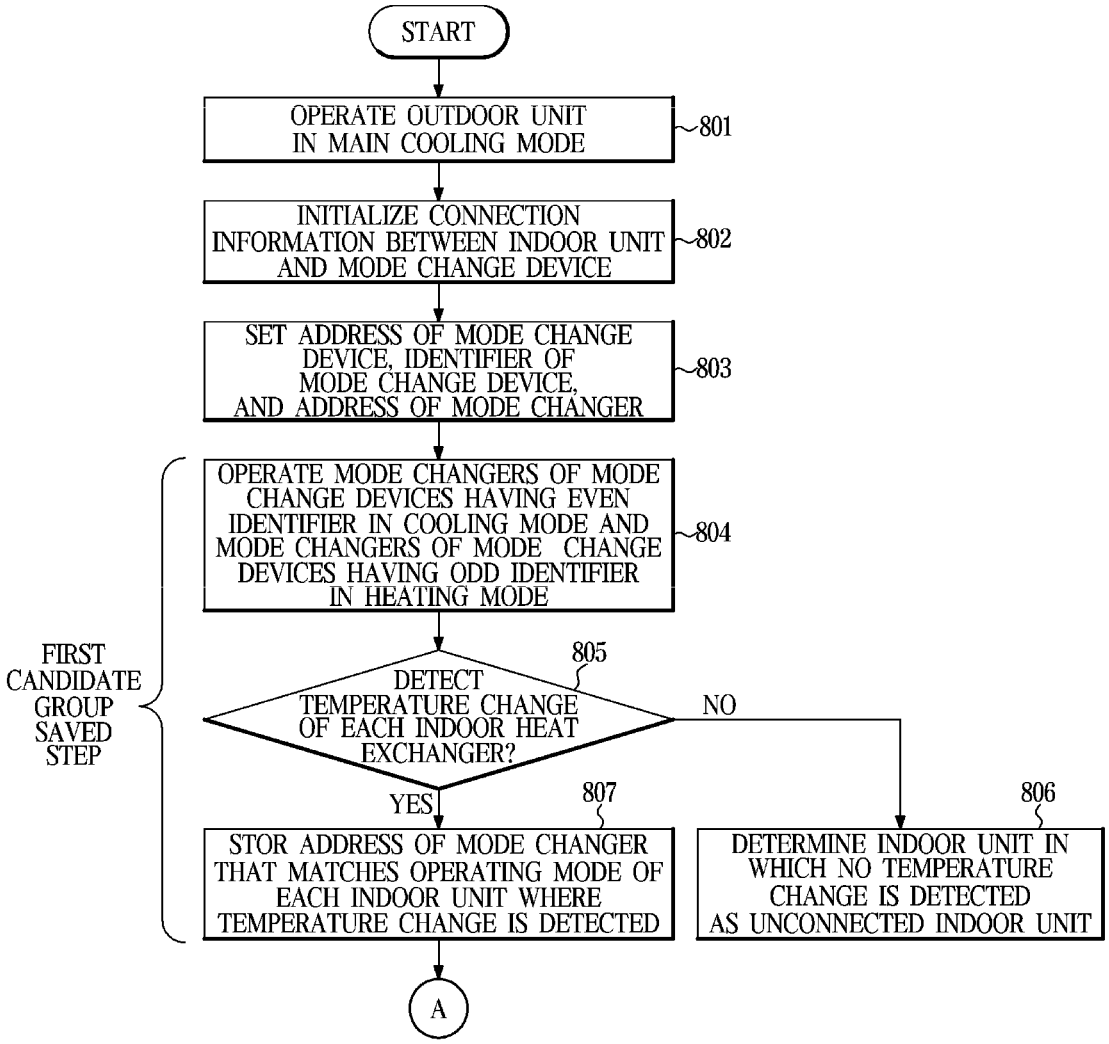
Figure 8B:
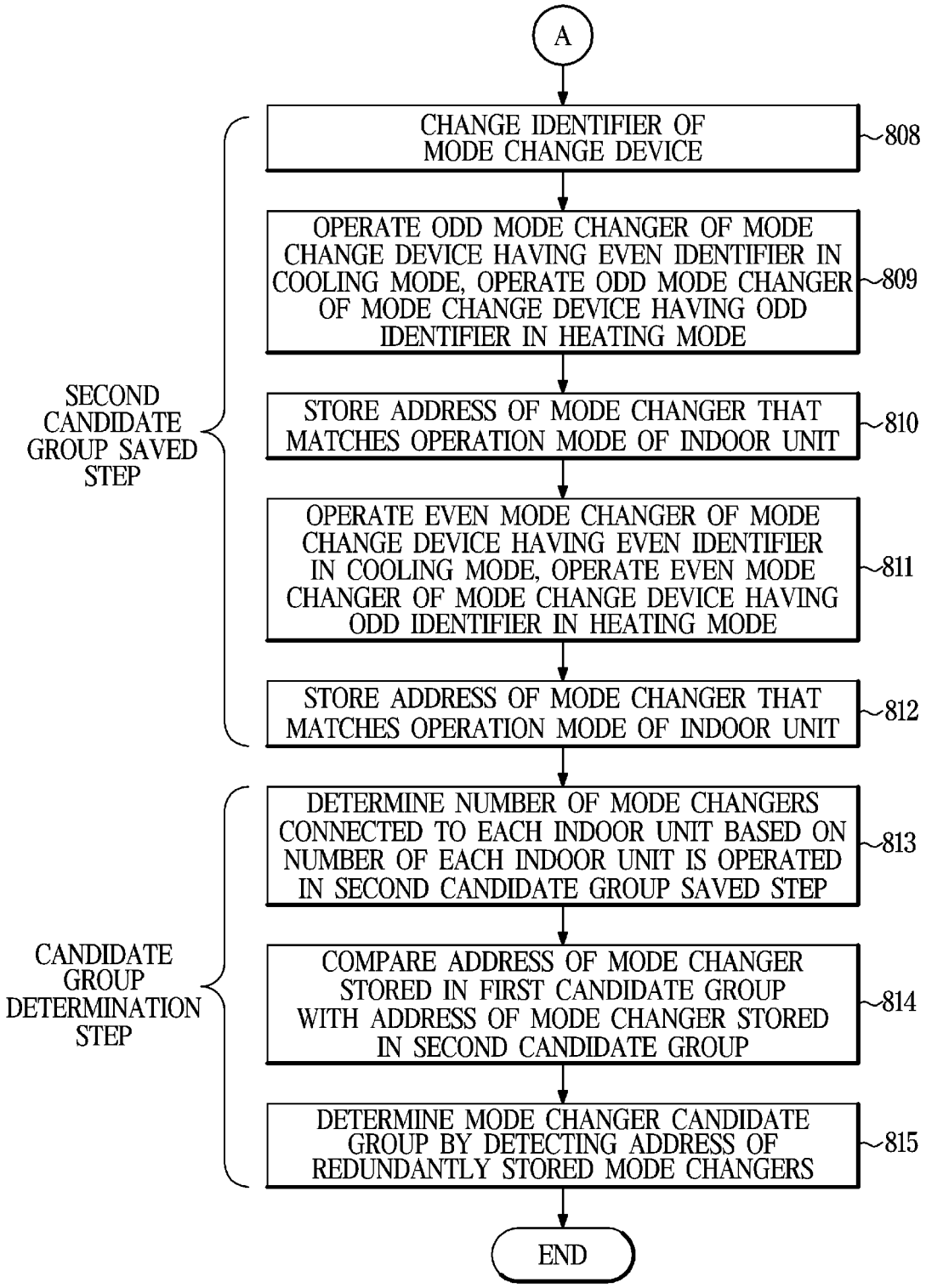

FIGS. 7, 8A, and 8B are flowcharts illustrating a process of determining a mode changer candidate group according to an operation mode of an outdoor unit in relation to a process of determining the mode changer candidate group among the contents described in FIG. 6.

FIG. 7 illustrates determining the mode changer candidate group when the outdoor unit 10 operates in the cooling mode or the heating mode. FIG. 7 illustrates that the outdoor unit 10 operates in the cooling mode, but a method of determining the mode changer candidate group is the same even when the outdoor unit 10 operates in the heating mode. Accordingly, a case where the outdoor unit 10 operates in the cooling mode will be described below.

Referring to FIG. 7, the operation of the air conditioner 1 may be started so that the outdoor unit 10 operates in the cooling mode (701). The mode change devices 100 (100-1, 100-2) may initialize the connection information set in the plurality of indoor units 200 and the plurality of mode changers 110A and 110B of the mode change device 100, and may reset the address of the mode change device 100 and the address of the plurality of mode changers 110A and 110B. When the plurality of mode change devices 100 exist, a process of setting the identifier to each of the plurality of mode change devices 100-1 and 100-2 may be included (703).

However, when the outdoor unit 10 is in the cooling mode or the heating mode, since the operation mode of each of the plurality of mode changers 110A and 110B operating at the same is the cooling mode or the heating mode, the identifier of the mode change device 100 does not affect determining the changer candidate group.

The first mode change device 100-1 may operate all mode changers 110A in the cooling mode according to the operation mode (cooling mode) of the outdoor unit 10 (704). That is, the first mode change device 100-1 may control the cooling valve 111A-12, 111A-22, 111A-32, . . . , and 111A-N2 to open among the changing valves 111A of all mode changers 110A.

When the plurality of mode change devices 100-1 and 100-2 exist, the plurality of mode change devices may control the refrigerant to be transferred to the plurality of indoor units 200 by opening the cooling valves of all mode changers 110A and 110B included in each of the mode change devices 100-1 and 100-2.

When the refrigerant is transferred to the plurality of indoor units 200 through the plurality of mode changers 110A and 110B, the plurality of indoor units 200 may operate in the cooling mode. When the refrigerant flows through each of the plurality of indoor units 200, the temperature change of the indoor heat exchanger 210 may be detected by the indoor heat exchanger temperature measurers 205-1, 205-2, . . . , 205-N, and 205-M. However, when the refrigerant does not flow through each of the plurality of indoor units 200, the temperature change of the indoor heat exchanger 210 is not detected. Accordingly, the each of the indoor units 200 in which the temperature change of the indoor heat exchanger 210 is not detected may be determined to be not connected to any of the mode changers 110A and 110B of the mode change device 100 (705, 706).

In other words, it may be determined that the indoor unit 200 in which the temperature change of the indoor heat exchanger 210 is not detected is not connected to the branch ducts 113A and 113B of the mode changers 110A and 110B. Also, it may be determined that the indoor unit 200 is not also connected to the outdoor unit 10.

The each of the plurality of indoor units 200 in which the temperature change of the indoor heat exchanger 210 is detected by the indoor heat exchanger temperature measurer 205 may store the addresses of all mode changers 110A and 110B related to the temperature change of the indoor heat exchanger (707). The address of the mode changers 110A and 110B stored in the operation may be defined as a first saved address.

On the other hand, the address of the mode changer 110A may be stored in the storage 10-2 of the outdoor unit 10, the storage 102A-1 of the mode change devices 100-1 and 100-2, or the storage 203 of the each of the indoor unit 200.

As illustrated in FIG. 7, all mode changers 110A may be operated in the same operation mode as the outdoor unit 10, and an unconnected indoor unit may be detected. The operation of storing the addresses of all mode changers 110A by each of the plurality of indoor units 200 in which temperature changes are detected by the indoor heat exchanger temperature measurers 205-1, 205-2, . . . , and 205-N may be defined as a 'first mode changer candidate group saved step'.

Thereafter, the outdoor unit 10 may control the mode changer of an odd address of each of the mode change devices 100-1 and 100-2 to operate in the cooling mode, and the mode changer of an even address of each of the mode change devices 100-1 and 100-2 to operate in the off mode. For example, the outdoor unit 10 may control the mode changers 110A-1, 110A-3, and 110A-(2*k*−1) of the odd address of the first mode change device 100-1 to operate in the cooling mode, and the mode changers 110A-2, 110A-4, and 110A-(2*k*) of the even address of the first mode change device 100-1 to operate in the off mode. Here, k is the natural number as a factor for classifying odd and even numbers.

The outdoor unit 10 may operate only mode changers of odd addresses of each of the mode change devices 100-1 and 100-2 in the cooling mode, and each of the plurality of indoor units 200 may detect the temperature change of the indoor heat exchanger 210. The each of the plurality of indoor units 200 may determine the operation mode based on the temperature change of the indoor heat exchanger 210 and store the addresses of mode changers 110A and 110B operating in the same operation mode (708). The address of the mode changers 110A and 110B stored in the operation may be defined as a second saved address. For example, when the each of the plurality of indoor units 200 operates in the cooling mode, the addresses of odd mode changers 110A-1, 110A-3, and 110A-(2*k*-1) operating in the cooling mode may be stored.

In addition, the outdoor unit 10 may control the mode changers 110A-1, 110A-3, and 110A-(2*k*-1) of the odd address of each of the mode change devices 100-1 and 100-2 to operate in the off mode, and control the mode changers 110A-2, 110A-4, and 110A-(2*k*) of the even address to operate in the cooling mode. That is, the outdoor unit 10 may operate only mode changers 110A-2, 110A-4, and 110A-(2*k*) of the even addresses in the cooling mode. Each of the plurality of indoor units 200 may detect the temperature change of the indoor heat exchanger 210 and store the address of the mode changer 110A operating in the same operation mode (709). In other words, each of the indoor units 200 operating in the cooling mode may store addresses of even mode changers 110A-2, 110A-4, and 110A-(2*k*) operating in the cooling mode. The address of the mode changers 110A and 110B stored in the operation may be defined as a third saved address.

As illustrated in FIG. 7, the outdoor unit 10 may alternate between the mode changers 110A-1, 110A-3, and 110A-(2*k*−1) of the odd addresses and the mode changers 110A-2, 110A-4, and 110A-(2*k*) of the even addresses. The operation of storing the address of the mode changer 110A in which each of the plurality of indoor units 200 operates in the same operation mode as that of the plurality of indoor units 200 may be defined as a 'second mode changer candidate group saved step'.

The each of the plurality of indoor units 200 may determine the number of the mode changers 110A connected to the each of the indoor units 200 based on the number of each of the plurality of indoor units 200 is operated in the second mode changer candidate group saved step after completion of the first and second mode changer candidate group saved steps (710).

Particularly, when the address of the odd mode changer 110A-1, 110A-3, and 110A-(2*k*−1) or the even mode changers 110A-2, 110A-4, and 110A-(2*k*) is stored only once, it may be determined that the each of the plurality of indoor units 200 has one connected mode changer. In other words, it may be determined that the each of the plurality of indoor units 200 has one number of the branch ducts 113A and 113B connected to it.

In addition, when the address of the odd mode changer 110A-1, 110A-3, and 110A-(2*k*-1) and the even mode changers 110A-2, 110A-4, and 110A-(2*k*) are all stored in sequence, it may be determined that the each of the plurality of indoor units 200 has two connected mode changer. In other words, it may be determined that the each of the plurality of indoor units 200 has two number of the branch ducts 113A and 113B connected to it.

In addition, the each of the plurality of indoor units 200 may compare the first saved address stored in the first mode changer candidate group with the second saved address, which is the address of the odd mode changer 110A-(2*k*−1) stored in the second mode changer candidate group saved step, and the third saved address, which is the address of the even mode changer 110A-(2*k*) (711), and may determine the mode changer candidate group by detecting the address of the redundantly stored mode changers 110A and 110B (712).

For example, when the first indoor unit 200-1 stores the addresses of all mode changers 110A as the first saved address in the first mode changer candidate group saved step and only the second saved address, which is the address of the odd mode changer 110A-(2*k*−1) in the second mode changer candidate group saved step, the first indoor unit 200-1 may determine the second saved address, which is the address of the odd mode changer 110A-(2*k*−1), as the mode changer candidate group.

In addition, the first indoor unit 200-1 may store the addresses of all mode changers 110A as the first saved addresses in the first mode changer candidate group saved step, and may sequentially store the second saved address that is the address of the odd mode changer 110A-(2*k*−1) and the third saved address that is the address of the even mode changer 110A-(2*k*) in the second mode changer candidate group saved step.

In this case, the first indoor unit 200-1 may determine an address in which the address of the odd mode changer 110A-(2*k*−1) and the address of the even mode changer 110A-(2*k*) are combined as a mode changer candidate group. For example, as illustrated in FIGS. 11 to 14, when there are the number of mode changers 110A of the first mode change device 100-1 is 6, the address of the first mode change device 100-1 is 0, and the address of the mode changer 110A is set to 01, 02, 03, 04, 05, 06, the seventh indoor unit 200-7 connected to the two mode changers may determine the combined address (012, 023, 034, 045, 056) as the mode changer candidate group.

The combined address may be generated in various ways according to the user's setting, but generally, when one indoor unit 200-1 is connected to two branch ducts, since two adjacent branch ducts 113A-1 and 113A-2 are connected to the indoor unit 200-1, the combined address may be generated by combining two consecutive addresses among the addresses of the plurality of mode changers 110A in pairs.

FIGS. 8A and 8B illustrate determining a mode changer candidate group when the outdoor unit 10 operates in the main cooling mode or the main heating mode.

FIGS. 8A and 8B illustrate that the outdoor unit 10 operates in the main cooling mode, the method of determining the mode changer candidate group is the same even when the outdoor unit 10 operates in the main heating mode. Hereinafter, a case where the outdoor unit 10 operates in the main cooling mode will be described. For the description of FIGS. 8A and 8B, it is assumed that three mode change devices 100-1, 100-2, and 100-3 exist, and the plurality of mode changers 110A, 110B, and 110C exist in each mode change device.

Referring to FIG. 8A, the operation of the air conditioner 1 is started so that the outdoor unit 10 operates in the main cooling mode (801). The outdoor unit 10 may initialize the connection information set in the plurality of indoor units 200 and the plurality of mode changers 110A, 110B, and 110C of each mode change device 100-1, 100-2, or 100-3 (802), and may reset the addresses of the plurality of mode change devices 100-1, 100-2, and 100-3, the identifiers of a plurality of mode change devices 100-1, 100-2, and 100-3, and the addresses of the plurality of mode changers 110A, 110B, and 110C (803).

In the step of determining the mode changer candidate group, the identifiers of the plurality of mode change devices 100-1, 100-2, and 100-3 may be determined by Equation 1 below.

$$\text{Identifier (ID) of mode change device} = \text{Address of mode change device}/2^{\wedge}(\text{step}_{connect}-1) \quad \text{[Equation 1]}$$

Here, the addresses of the three mode change devices 100-1, 100-2, and 100-3 may be set to 0, 1, and 2, respectively, and $\text{step}_{connect}$ is numbers for the first mode changer candidate group saved step and the second mode changer candidate group saved step, 1 and 2 may be assigned respectively.

When the outdoor unit 10 operates in the main cooling mode, the outdoor unit 10 may operate the plurality of mode change devices 100-1, 100-2, and 100-3 in different operation modes according to the identifier of each of the plurality of mode change devices 100-1, 100-2, and 100-3 in the step of determining the mode changer candidate group. For example, the mode change device having an even identifier among the plurality of mode change devices 100-1, 100-2, and 100-3 may operate in the cooling mode, and the mode change device having an odd identifier among the plurality of mode change devices 100-1, 100-2, and 100-3 may operate in the heating mode.

As illustrated in FIG. 20, in the first mode changer candidate group saved step, the identifier of the first mode change device 100-1 is 0, which corresponds to the even number, and the identifier of the second mode change device 100-2 is 1, which corresponds to the odd number, and the identifier of the third mode change device 100-3 is 2, which corresponds to the even number. Therefore, the mode changers of the first mode change device 100-1 and the third mode change device 100-3 having the even identifier may operate in the cooling mode, and the mode changers of the second mode change device 100-2 having the odd identifier may operate in the heating mode (804).

Thereafter, the each of the plurality of indoor units 200 may detect the temperature change of the indoor heat exchanger 210 (805). It is determined that the indoor unit 200 in which the temperature change is not detected is not connected to any mode changers 110A, 110B, and 110C (806). Also, it may be determined that the indoor unit 200 is not connected to the outdoor unit 10.

The each of the plurality of indoor units 200 in which the temperature change of the indoor heat exchanger 210 is detected may store the address of the mode changer 110A and 110B related to the temperature change of the indoor heat exchanger 210. That is, the each of the plurality of indoor units 200 may store the address of the mode changer 110A operating in the same operation mode as its own operation mode (first saved address) (807).

Particularly, referring to FIG. 20, the each of the indoor unit 200 operating in the cooling mode may store the address 110A of the mode changer of the first mode change device 100-1 having the even identifier and the address of the mode changer 110C of the third mode change device 100-3. The each of the indoor units 200 operating in the heating mode may store the address of the mode changer 110B of the second mode change device 100-2 having the odd identifier as the first saved address.

Referring back to FIG. 8A, the outdoor unit 10 may operate the mode change devices 100-1, 100-2, and 100-3 in different operation modes according to the identifier of the mode change devices 100-1, 100-2, and 100-3. The step of storing the address of the mode changer 110A, 110B, and 110C related to the temperature change of the indoor heat exchanger 210 as the first saved address in each of the plurality of indoor units 200 in which the temperature change is detected may be defined as the 'first mode changer candidate group saved step'.

Referring to FIG. 8B, the each of the plurality of indoor units 200 may enter the second mode changer candidate group saved step. In the second mode changer candidate group saved step, the identifiers of each of the plurality of mode change devices 100-1, 100-2, and 100-3 may be changed. Referring to FIG. 21, in the second mode changer candidate group saved step, the identifier of the first mode change device 100-1 may be changed to 0, the identifier of the second mode change device 100-2 may be changed to 0, and the identifier of the third mode change device 100-3 may be changed to 1 (808).

The outdoor unit 10 may control the odd mode changer of the mode change device having the even identifier to operate in the cooling mode and the odd mode changer of the mode change device having the odd identifier to operate in the heating mode (809). That is, the odd mode changer of the first mode change device 100-1 and the odd mode changer of the second mode change device 100-2 having the even identifier may open the cooling valve and operate in the cooling mode, and the odd mode changer of the third mode change device 100-3 having the odd identifier may open the heating valve and operate in heating mode. At this time, all the even mode changers may operate in the off mode by closing both the cooling valve and the heating valve.

The each of the plurality of indoor units 200 may detect the temperature change of the indoor heat exchanger 210 and store the address of the mode changers 110A, 110B, and 110C related to the temperature change of the indoor heat exchanger 210 as the second saved address (810). That is, when the outdoor unit 10 operates in the main cooling mode or the main heating mode, since some of the plurality of indoor units 200 operate in the cooling mode and other parts operate in the heating mode, the indoor unit 200 operating in the cooling mode may store the address of the odd mode changer of the first mode change device 100-1 having the even identifier and the address of the odd mode changer of the second mode change device 100-2 as the second saved address, and the indoor unit 200 operating in the heating mode may store the address of the odd mode changer of the third mode change device 100-3 having the odd identifier as the second saved address.

In addition, the outdoor unit 10 may control the even mode changer of the mode change device having the even identifier to operate in the cooling mode, and the even mode changer of the mode change device having the odd identifier to operate in the heating mode (811). That is, the even mode changer of the first mode change device 100-1 having the even identifier and the even mode changer of the second mode change device 100-2 may operate in the cooling mode, and the even mode changer of the third mode change device 100-3 having the odd identifier may operate in the heating mode. At this time, all the odd mode changers may operate in the off mode.

The each of the plurality of indoor units 200 may detect the temperature change of the indoor heat exchanger 210 again, and store the addresses of the mode changers 110A, 110B, and 110C operating in the same operation mode as the third saved address (812). That is, the indoor unit 200 operating in the cooling mode may store the address of the even mode changer of the first mode change device 100-1 and the address of the even mode changer of the second mode change device 100-2 having the even identifier as the third saved address. The indoor unit 200 operating in the heating mode may store the address of the even mode changer of the third mode change device 100-3 having the odd identifier as the third saved address.

When the first and second mode changer candidate group saved steps are completed, the each of the plurality of indoor units 200 may enter a mode changer candidate group determination step. Steps 813, 814, and 815 of determining the mode changer candidate group in FIG. 8 and steps 710, 711, and 712 of determining the mode changer candidate group of FIG. 7 may be the same.

That is, after the first and second mode changer candidate group saved steps are completed, the each of the plurality of indoor units 200 may determine the number of mode changers 110A connected to the each of the plurality of indoor units 200 based on the number of each of the plurality of indoor units 200 operates in the second mode changer candidate group saved step (813). In addition, the each of the plurality of indoor units 200 may compare the first saved address stored in the first mode changer candidate group saved step with the second saved address and the third saved address stored in the second mode changer candidate group saved step (814), and may detect the address of the redundantly stored mode changers 110A, 110B, and 110C and determine as the mode changer candidate group (815).

Figure 9:
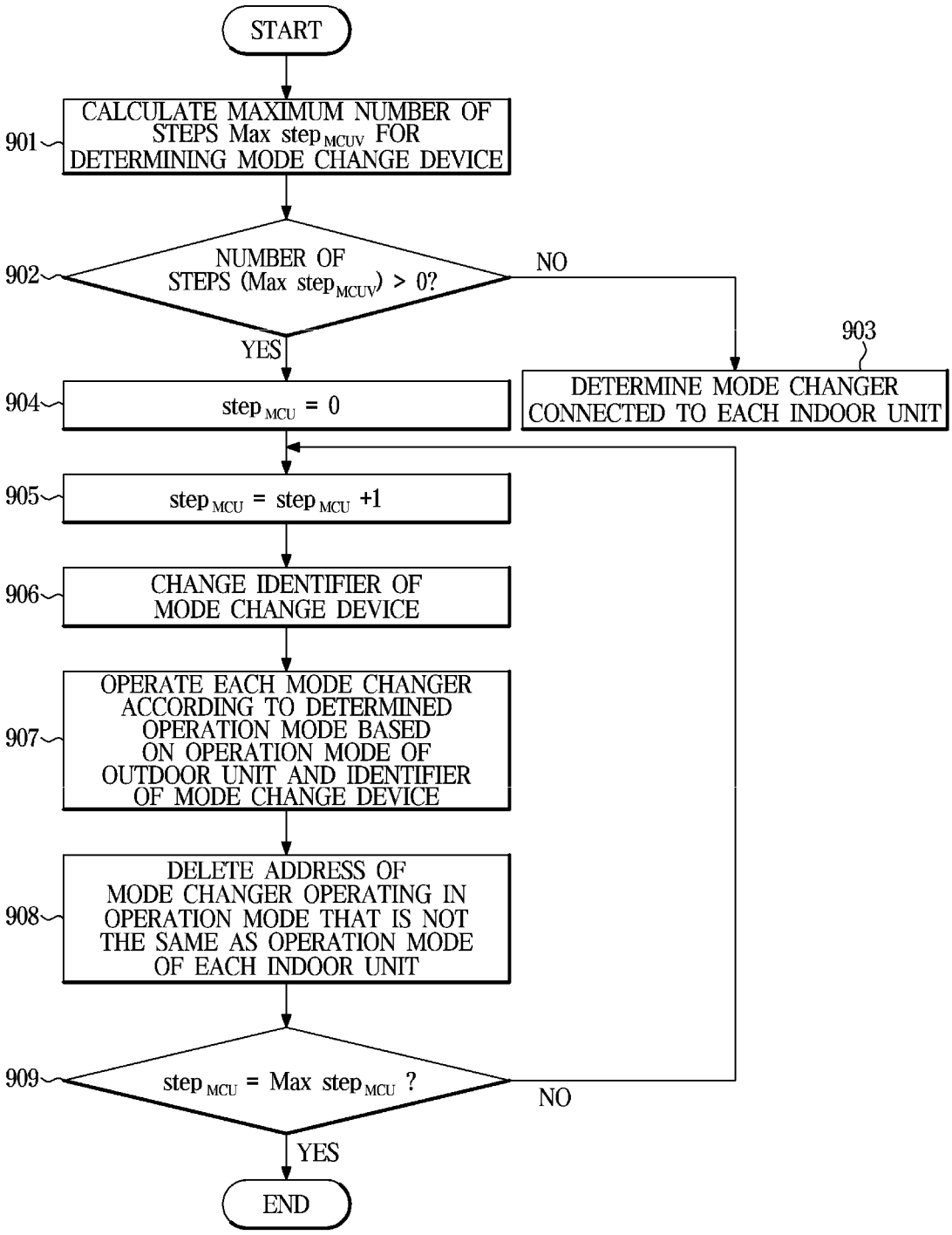
FIG. 9 is a flowchart illustrating a process of extracting an address of a valid mode changer in relation to a process of determining a mode change device among the contents described in FIG. 6.

FIG. 9 is a flowchart illustrating a process of extracting an address of a valid mode changer in relation to a process of determining a mode change device among the contents described in FIG. 6.

Referring to FIG. 9, the each of the plurality of indoor units 200 may extract the address of the connected mode change devices 100-1, 100-2, and 100-3, and may determine the mode change devices 100-1, 100-2, and 100-3 that are actually connected to them.

To this end, first, the outdoor unit 10 may calculate a maximum number of steps Max $step_{MCUV}$ for determining the mode change device (901). The maximum number of steps Max $step_{MCU}$ may be calculated based on the number of the plurality of mode change devices 100-1, 100-2, and 100-3 included in the air conditioner 1. The maximum number of steps Max $step_{MCU}$ may refer to the number of times (first operation number) to operate the plurality of mode change devices 100-1, 100-2, and 100-3 in the step of determining the mode change device.

The first operation number Max $step_{MCU}$ may be determined by Equation 2 below.

$$\text{Max } step_{MCU} = \log 2n_{MCU} - a \quad \text{[Equation 2]}$$

Here, $n_{MCU}$ is the number of mode change devices, a is set to 0 when the operation mode of the outdoor unit 10 is in the cooling mode or the heating mode, and a is set to 2 when the operation mode of the outdoor unit 10 is in the main cooling mode or the main heating mode. In addition, anything below a decimal point of a value calculated by Equation 2 is rounded up.

The outdoor unit 10 may determine whether the first operation number Max $step_{MCU}$ is equal to or greater than 0 (902). When the first operation number Max $step_{MCU}$ is 0 or less, the mode change device determination step may be omitted. In this case, it immediately enters the mode changer determination step (903). The mode changer determination step will be described in detail in FIG. 10.

When the first operation number Max $step_{MCU}$ is greater than 0, since the number of mode change devices is two or more, a process of determining which mode change device the plurality of indoor units 200 are connected to is required. The outdoor unit 10 may operate the plurality of mode change devices 100-1, 100-2, and 100-3 as much as the first operation number Max $step_{MCU}$, and the each of the plurality of indoor units 200 may extract the address of the valid mode changer by comparing the temperature change of the indoor heat exchanger 210 and the operation mode of the mode changers 110A, 110B, and 110C each operation of the plurality of mode change devices 100-1, 100-2, and 100-3.

Particularly, when the first operation number Max $step_{MCU}$ is set, the outdoor unit 10 may initializes the $step_{MCU}$ to 0 (904), and operate the plurality of mode change devices 100-1, 100-2, and 100-3 in the operation mode corresponding to the operation mode of the outdoor unit 10 while increasing by one time (905).

Referring to FIGS. 15 and 16, it will be described as a first mode change device determination step and a second mode change device determination step according to the $step_{MCU}$ of a plurality of mode change devices 100-1, 100-2, and 100-3.

In the mode change device determination step, the identifiers of each of the plurality of mode change devices 100-1, 100-2, and 100-3 are changed according to Equation 3 below for each step (906).

$$\text{Identifier(ID) of mode change device} = \text{Address of mode change device}/2\hat{}(step_{MCU} - 1 + a) \quad \text{[Equation 3]}$$

Here, $step_{MCU}$ is a step value, a is set to 0 when the operation mode of the outdoor unit 10 is the cooling mode or the heating mode, and a is set to 2 when the operation mode of the outdoor unit 10 is the main cooling mode or the main heating mode. In addition, anything below the decimal point of the value calculated by Equation 3 is rounded out.

The outdoor unit 10 may determine the operation mode of each of the mode change devices 100-1, 100-2, 100-3 based on the operation mode of the outdoor unit 10 and the identifier of the mode change device for each $step_{MCU}$, and operate the mode changer of each of the mode change devices 100-1, 100-2, and 100-3 in the determined operation mode (907).

For example, when the operation mode of the outdoor unit 10 is the cooling mode, the mode changers of the mode change device having the even identifier for each $step_{MCU}$ are all operated in the cooling mode, and the mode changers of the mode change device having the odd identifier for each $step_{MCU}$ are all operated in the off mode.

When the operation mode of the outdoor unit 10 is the main cooling mode, the mode changers of the mode change device having the even identifier for each $step_{MCU}$ are all operated in the cooling mode, and the mode changers of the mode change device having the odd identifier for each $step_{MCU}$ are all operated in the heating mode.

Referring to FIG. 15, in the first mode change device determination step, the identifier of the first mode change device 100-1 and the identifier of the second mode change device 100-2 are 0 and correspond to the even number. The identifier of the third mode change device 100-3 is 1 and correspond to the odd number. Since the outdoor unit 10 is in the cooling mode, the first mode change device 100-1 and the second mode change device 100-2 may operate in the cooling mode, and the third mode change device 100-3 may operate in the off mode.

In addition, the each of the plurality of indoor units 200 may compare the temperature change of the indoor heat exchanger 210 with the operation mode of the mode changers 110A, 110B, and 110C for each $step_{MCU}$ in which the plurality of mode change devices 110A, 110B, and 110C operate, and extract the address of the valid mode changer is extracted (908). Particularly, the each of the plurality of indoor units 200 may delete the address of the mode changer 110A, 110B, and 110C operating in the operation mode that is not the same as the operation mode of each of the plurality of indoor units 200 for each $step_{MCU}$ from the mode changer candidate group.

As described above, the operation mode of each of the plurality of indoor units 200 may be determined based on the temperature change of the indoor heat exchanger 210 included in each of the indoor units 200. That is, the larger the temperature change of the indoor heat exchanger 210 is detected, the more accurately the operation mode of each of the plurality of indoor units 200 may be detected.

Therefore, in order to increase the temperature change of the indoor heat exchanger 210, when the outdoor unit 10 is operating in the main cooling mode or the main heating mode, when the $step_{MCU}$ of the mode change device 100 is odd, the outdoor unit 10 may operate the mode changers 110A and 110C of the mode change device (e.g., the first mode change device 100-1 with an address value of 0, the third mode change device 100-3 with an address value of 2) having the even address value in the same operation mode as the operation mode of the outdoor unit 10, and may operate the mode changer 110B of the mode change device (e.g., the second mode change device 100-2 with an address value of 1) having the odd address value in the operation mode opposite to the operation mode of the outdoor unit 10.

In other words, when the outdoor unit 10 is in the main cooling mode, when the $step_{MCU}$ of the mode change device 100 is the odd number, the cooling valves 111A-12, 111A-22, 111A-32, . . . , and 111A-N2 of the mode changer 110A included in the mode change device 100-1 having the even address value may be opened, and the cooling valves 111B-11, 111B-21, 111B-31, . . . , and 111B-N1 of the mode changer 110B included in the mode change device 100-2 having the odd address value may be opened.

In addition, when the $step_{MCU}$ of the mode change device 100 is the even number, contrary to when the $step_{MCU}$ is odd, the mode changer 110A of the mode change device 100-1 having the even address value may operate in the operation mode opposite to the operation mode of the outdoor unit 10, and the mode changer 110B of the mode change device 100-2 having the odd address value may operate in the same operation mode as the operation mode of the outdoor unit 10.

When the $step_{MCU}$ of the mode change device 100 increases and reaches a second operation number, the outdoor unit 10 and each of the plurality of indoor units 200 may end the mode change device determination step and enter the mode changer determination step.

Figure 10:
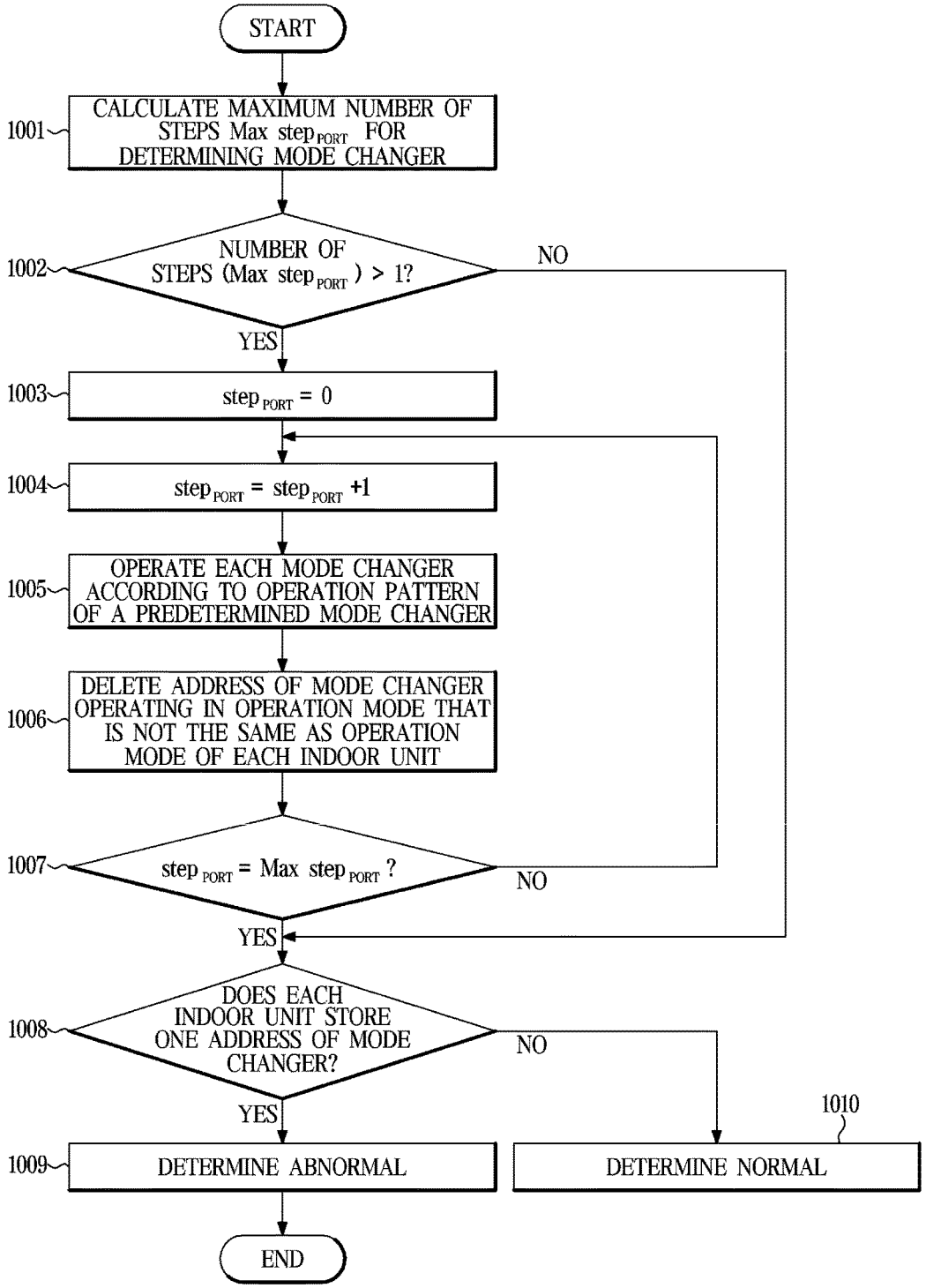
FIG. 10 is a flowchart illustrating a process of extracting an address of a valid mode changer in relation to a process of determining a mode changer among the contents described in FIG. 6.

FIG. 10 is a flowchart illustrating a process of extracting an address of a valid mode changer in relation to a process of determining a mode changer among the contents described in FIG. 6.

Referring to FIG. 10, each of the plurality of indoor units 200 may extract the addresses of the connected mode changers 110A, 110B, and 110C to determine the mode changers 110A, 110B, and 110C to which each of the plurality of indoor units 200 is actually connected.

To this end, first, the outdoor unit 10 may calculate a maximum number of steps MAX $step_{PORT}$ for determining the mode changer corresponding to each of the plurality of indoor units 200 (1001). The MAX $step_{PORT}$ may be calculated based on the number of mode changers 110A, 110B, and 110C of each of the mode change devices 100-1, 100-2, and 100-3. The MAX $step_{PORT}$ may refer to the number of times (second operation number) each of the mode change devices 100-1, 100-2, and 100-3 is operated in the mode changer determination step.

When the plurality of mode change devices 100-1, 100-2, and 100-3 are included in the air conditioner 1, since the number of mode changers 110A, 110B, and 110C included in each mode change device 100-1, 100-2, or 100-3 may be different, the second operation number set for each mode change device 100-1, 100-2, or 100-3 may be different.

The second operation number Max $step_{PORT}$ may be determined by Equation 4 below.

$$\text{Max } step_{PORT} = \text{number of mode changers } (p)/2 \quad \text{[Equation 4]}$$

The outdoor unit 10 may determine whether the second operation number Max $step_{PORT}$ for each mode change device 100-1, 100-2, or 100-3 is 1 or less (1002). When the second repetition number is 1 or less, the outdoor unit 10 may omit the mode changer determination step.

When the second operation number Max $step_{PORT}$ is greater than 1, the outdoor unit 10 may extract the address of the valid mode changer while operating the mode changers 110A, 110B, and 110C of each mode change device 100-1, 100-2, or 100-3 as much as the second operation number Max $step_{PORT}$.

Particularly, when the second operation number Max $step_{PORT}$ is set, the outdoor unit 10 may initialize an operation step value $step_{PORT}$ for each of the plurality of mode change devices 100-1, 100-2, and 100-3 to 0 (1003), and operate the mode changers 110A, 110B, and 110C of each of the plurality of mode change devices 100-1, 100-2, and in a predetermined operation pattern (1005) while increasing by one time (1004).

Meanwhile, when the operation mode of the outdoor unit 10 is the cooling mode or the heating mode, the mode changers 110A, 110B, and 110C of each of the plurality of mode change devices 100-1, 100-2, and 100-3 may operate in the same operation mode as the operation mode of the outdoor unit 10. In addition, when the operation mode of the outdoor unit 10 is the main cooling mode or the main heating mode, the mode changers 110A and 110C included in the mode change devices 100-1 and 100-3 having even addresses may operate in the same operation mode as the operation mode of the outdoor unit 10 and the mode changer 110B included in the mode change device 100-2 having the odd address may operate in the operation mode opposite to the operation mode of the outdoor unit 10. The operation pattern of the mode changers 110A, 110B, and 110C may include operation mode information of the mode changers 110A, 110B, and 110C corresponding to the operation mode of the outdoor unit 10.

Meanwhile, in the mode changer determination step, the operation patterns of the mode changers 110A, 110B, and 110C may be set in various ways as follows.

As an embodiment, the outdoor unit 10 may calculate $V_{(2)}$ (binary number) according to Equation 5 below by using the number p of mode changers 110A, 110B, and 110C of each mode change device 100-1, 100-2, or 100-3.

$$V_{(2)} = \sum_{i=0}^{p-1} 2^i - \sum_{k=step_{PORT}-1}^{\frac{p}{2}+step_{PORT}-1} 2^k \quad \text{[Equation 5]}$$

Particularly, as illustrated in FIG. 17, when the number p of the mode changers 110A of the first mode change device 100-1 is 6, according to Equation 5, $V_{(2)}$ may be calculated in a first step ($step_{PORT}$=1) as $110000_{(2)}$. The mode changer (01, 02) corresponding to 1 of values of the $V_{(2)}$ may operate in the operation mode (cooling mode) corresponding to the operation mode of the outdoor unit 10, and the mode changer (03, 04, 05, 06) corresponding to 0 of values of the $V_{(2)}$ may operate in the off mode.

Therefore, when the outdoor unit 10 is operating in the cooling mode, in the mode changer determination step, the first mode changer 110A-1 and the second mode changer 110A-2 of the first mode change device 100-1 may open the cooling valve 111A-12 and close the heating valve 111A-11, and the remaining third mode changer 110A-3 to sixth mode changer 110A-6 may close all of the changing valves 111A-2 and 111A-3, 111A-4, and 111A-5.

As another embodiment, $V_{(2)}$ may be calculated according to Equation 6 below.

$$V_{(2)} = \sum_{i=p-2\times step_{PORT}}^{p+1-2\times step_{PORT}} 2^i \quad \text{[Equation 6]}$$

As another embodiment, a method of operating a specific number of mode changers while moving the address of the mode changers 110A, 110B, and 110C for each $step_{PORT}$ of the mode changer determination step may be used.

Particularly, in the first step ($step_{PORT}$=1) of the mode changer determination step, the first mode change device 100-1 may control the changing valves of A number (=mode changer number (p)/2) continuous mode changers among the plurality of mode changers 110A to be closed, and may control the changing valve of the remaining number (p-A) of continuous mode changers to be opened. For example, when the number of mode changers 110A of the first mode change device 100-1 is 6, since A is 3, the changing valves 111A-1, 111A-2, and 111A-3 of three consecutive first mode changers 110A-1 to third mode changers 110A-3 may be closed.

From a second step ($step_{PORT}$=2) to the last step ($step_{PORT}$=Max $step_{PORT}$−1), the first mode change device 100-1 may move a start address of the continuous mode changer by $step_{PORT}$−1, and then control the changing valves of B number (=mode changer number (p)/2+1) continuous mode changers to be closed and the changing valve of the remaining mode changers to be opened. For example, B is 4, and since the start address of the continuous mode changer is 2, the changing valves 111A-2, 111A-3, 111A-4, and 111A-5 of the second mode changer 110A-2 to the fifth mode changer 110A-5 may be closed.

In the last step Max $step_{PORT}$, the first mode change device 100-1 may move the start address of the continuous mode changer by $step_{PORT}$, and then control the changing valves of A number continuous mode changers to be closed and the changing valve of the remaining mode changers to be opened. For example, when the number of mode changers 100A is 6, and since the Max $step_{PORT}$=3, A=3, the start address of consecutive mode changers is 4. Accordingly, the changing valves 111A-4, 111A-5, and 111A-6 of the fourth mode changer 110A-4 to the sixth mode changer 110A-4 may be closed.

Meanwhile, each of the plurality of indoor units 200 may extract the address of the valid mode changer by comparing the temperature change of the indoor heat exchanger 210 with the operation mode of the mode changers 110A, 110B, and 110C for each $step_{PORT}$ of the mode change device 100 (1006). Particularly, each of the plurality of indoor units 200 may delete the address of the mode changers 110A, 110B, and 110C operating in the operation mode different from its own operation mode from the mode changer candidate group for each $step_{PORT}$ of each mode change device 100.

On the other hand, in order to increase the temperature change of the indoor heat exchanger 210 in the mode changer determination step, each of the plurality of mode change devices 100-1, 100-2, and 100-3 may control the changing valves 111A, 111B, and 111C of the mode changers 110A, 110B, and 110C to operate alternately for each $step_{PORT}$.

Particularly, when the outdoor unit 10 is operating in the main cooling mode or the main heating mode, when the $step_{PORT}$ of the mode change device 100 is odd, the outdoor unit 10 may operate the mode changers 110A and 110C of the mode change device (e.g., the first mode change device 100-1 with the address value of 0, the third mode change device 100-3 with an address value of 2) having the even address value in the same operation mode as the operation mode of the outdoor unit 10, and may operate the mode changer 110B of the mode change device (e.g., the second mode change device 100-2 with the address value of 1) having the odd address value in the operation mode opposite to the operation mode of the outdoor unit 10.

In other words, when the outdoor unit 10 is in the main cooling mode, in the odd numbered $step_{PORT}$, the cooling valves 111A-12, 111A-22, 111A-32, . . . , and 111A-N2 of the mode changer 110A included in the mode change device 100-1 having the even address value may be opened, and the cooling valves 111B-11, 111B-21, 111B-31, . . . , and 111B-N1 of the mode changer 110B included in the mode change device 100-2 having the odd address value may be opened. In addition, in the even numbered $step_{PORT}$, contrary to when the $step_{PORT}$ is odd, the mode changer 110A of the mode change device 100-1 having the even address value may operate in the operation mode opposite to the operation mode of the outdoor unit 10, and the mode changer 110B of the mode change device 100-2 having the odd address value may operate in the same operation mode as the operation mode of the outdoor unit 10.

Thereafter, when the $step_{PORT}$ increases and reaches the second operation number, the outdoor unit 10 and each of the plurality of indoor units 200 may end the mode changer determination step (1007).

Each of the plurality of indoor units 200 may determine whether the address of the valid mode changer extracted through the mode changer determination step corresponds one-to-one (1008). When the address of the valid mode changer corresponds one-to-one, each of the plurality of indoor units 200 may determine the address of the valid mode changer as branch duct connection information (1009). In other words, when the extracted valid mode changer address is one, each of the plurality of indoor units 200 may determine the address of the valid mode changer as the branch duct connection information.

Meanwhile, each of the plurality of indoor units 200 may determine that it is directly connected to the outdoor unit 10 or that the branch duct connection information is abnormal when there is no address of the valid mode changer (1010).

Finally, each of the plurality of indoor units 200 may convert the address of the mode change device included in the determined branch duct connection information into an address designated by the user, and provide the user with the connection information between the plurality of indoor units 200 and the plurality of branch ducts.

FIGS. 11 to 19 are views for describing an entire process of obtaining connection information between a plurality of indoor units and a plurality of mode changers when an outdoor unit is in a cooling mode.

FIGS. 11 to 14 illustrate a process of determining the mode changer candidate group when the outdoor unit 10 is in the cooling mode. When the outdoor unit 10 is in the heating mode, the changing valves 111A of the plurality of mode changers 110A may be controlled opposite to that in the cooling mode. Therefore, in order to avoid redundant description, the description will be made based on when the outdoor unit 10 is in the cooling mode.

First, it is assumed that the air conditioner 1 includes 3 mode change devices and 11 indoor units. That is, it is assumed that the first mode change device 100-1, the second mode change device 100-2 exist, and the third mode change device 100-3 exist, and the first indoor unit 200-1 to the eleventh indoor unit 200-11 exist. As described above, the number of mode change devices and the number of indoor units included in the air conditioner 1 are not limited thereto.

As described in FIG. 7, when the process for obtaining the connection information between the plurality of indoor units 200 and the plurality of mode change devices 100-1, 100-2, and 100-3 is started, the outdoor unit 10 may operate in the operation mode determined according to the outdoor temperature. In FIGS. 11 to 19, it is assumed that the outdoor unit 10 operates in the cooling mode.

In addition, the outdoor unit 10 may initialize the connection information set in the plurality of indoor units 200 and the mode changers 110A, 110B, and 110C of the plurality of mode change devices 100-1, 100-2, and 100-3, and reset the addresses of the mode change devices 100-1, 100-2, and 100-3 and the addresses of the mode changers 110A, 110B, and 110C.

As illustrated in FIG. 11, the address of the first mode change device 100-1 is set to 0, the addresses of the six mode changer 110A included in the first mode change device 100-1 are set to 01, 02, 03, 04, 05, and 06, respectively. The address of the second mode change device 100-2 is set to 1, and the addresses of the four mode changers 110B included in the second mode change device 100-2 are set to 11, 12, 13, and 14. In addition, the address of the third mode change device 100-3 is set to 2, and the addresses of the four mode changers 110C included in the third mode change device 100-3 are set 21, 22, 23, and 24, respectively. The addresses of the plurality of indoor units 200 are set from 1 to 11.

In addition, the identifier for each of the plurality of mode change devices 100-1, 100-2, and 100-3 may be set. However, when the outdoor unit 10 is in the cooling mode or the heating mode, the identifier of the mode change device does not affect determining the mode changer candidate group.

FIG. 11 illustrates the first mode changer candidate group saved step.

Referring to FIG. 11, the plurality of mode change devices 100-1, 100-2, and 100-3 may operate all mode changers 110A in the cooling mode according to the operation mode (cooling mode) of the outdoor unit 10. For example, the first mode change device 100-1 may control to open the cooling valves 111A-12, 111A-22, 111A-32, . . . , and 111A-N2 among the changing valves 111A of all mode changers 110A. Accordingly, when the refrigerant is transmitted to the plurality of indoor units 200, the plurality of indoor units 200 may operate in the cooling mode. A shaded indoor unit is the indoor unit operated in the cooling mode.

Each of the plurality of indoor units 200 may store the addresses of all mode changers 110A, 110B, and 110C as the first saved address. That is, each of the indoor units 200 may store 01, 02, 03, 04, 05, 06/11, 12, 13, 14/21, 22, 23, and 24.

FIGS. 12 and 13 illustrate the second mode changer candidate group saved step.

Referring to FIG. 12, the outdoor unit 10 may control the mode changers (01, 03, 05, 11, 13, 21) of the odd addresses of each of the plurality of mode change devices 100-1, 100-2, and 100-3 to operate in the cooling mode and the mode changers (02, 04, 06, 12, 14, 22, 24) of the even addresses of each of the plurality of mode change devices 100-1, 100-2, and 100-3 to operate in the off mode. Accordingly, when the refrigerant flows through the plurality of indoor units 200, the outdoor unit 10 may determine the operation mode by detecting the temperature change of the indoor heat exchanger 210 of each of the plurality of indoor units 200, and store the address of the mode changer 110A operating in the same operation mode as the operation mode of the indoor unit 200 as the second saved address.

Accordingly, the storage 203 of each of the plurality of indoor units 200 may store the address of the mode changer operated in the same operation mode as that of each of the indoor units. As illustrated in FIG. 12, each of the first indoor unit 200-1, the third indoor unit 200-3, the fifth indoor unit 200-5, the seventh indoor unit 200-7, and the eighth indoor unit 200-8, the ninth indoor unit 200-9, and the tenth indoor unit 200-10 may store the addresses (01, 03, 05/11, 13/21, 23) of the odd mode changer, which is the address of the mode changer operated in the same operation mode as the second saved address.

Referring to FIG. 13, the outdoor unit 10 may control the mode changers (01, 03, 05, 11, 13, 21) of the odd addresses of each of the plurality of mode change devices 100-1, 100-2, and 100-3 to operate in the off mode and the mode changers (02, 04, 06, 12, 14, 22, 24) of the even addresses of each of the plurality of mode change devices 100-1, 100-2, and 100-3 to operate in the cooling mode. Thereafter, the second indoor unit 200-2, the fourth indoor unit 200-4, the sixth indoor unit 200-6, the seventh indoor unit 200-7, the eighth indoor unit 200-8, and the ninth indoor unit 200-9, and the eleventh indoor unit 200-11 may determine that it is operating in the cooling mode based on the temperature change of the outdoor heat exchanger 210. Therefore, each of the second indoor unit 200-2, the fourth indoor unit 200-4, the sixth indoor unit 200-6, the seventh indoor unit 200-7, the eighth indoor unit 200-8, the ninth indoor unit 200-9, and the eleventh indoor unit 200-11 may store the addresses (02, 04, 06/12, 14/22, 24) of the even mode changer as the third saved address.

FIG. 14 illustrates the mode changer candidate group determination step.

Referring to FIG. 14, in the second mode changer candidate group saved step, since each of the first to sixth indoor units, the tenth indoor unit, and the eleventh indoor unit operates only once, it is determined that it is connected to one mode changer. In addition, since the seventh indoor unit to the ninth indoor unit are each operated twice, it is determined that they are connected to two mode changers.

In addition, each of the plurality of indoor units 200 may determine the address of the redundantly stored mode changer as the mode changer candidate group by comparing the first saved address stored in the first mode changer candidate group saved step with the second saved address and the third saved address stored in the second mode changer candidate group saved step.

Therefore, the first, third, fifth, and tenth indoor units may determine the mode changer candidate group as 01, 03, 05/11, 13/21, and 23 respectively, and the second, fourth, sixth, and eleventh indoor units may determine the mode changer candidate group as 02, 04, 06/12, 14/22, and 24, respectively.

The seventh, eighth, and ninth indoor units may determine a 'combined address' in which the second saved address and the third saved address stored in the second mode changer candidate group saved step are combined as the mode changer candidate group. That is, the seventh, eighth, and ninth indoor units may determine the mode changer candidate group as 012, 023, 034, 045, 056/112, 123, 134/212, 223, and 234, respectively.

FIGS. 15 and 16 illustrate the mode change device determination step.

Referring to FIG. 15, the identifiers for each of the first, second, and third mode change devices 100-1, 100-2, and 100-3 are set to 0, 1, and 2, respectively. As described above, in the mode change device determination step, the identifier of the mode change device may be determined by Equation 3.

In FIGS. 15 and 16, the first operation number Max $step_{MCU}$ for determining the mode change device is 2, and FIG. 15 illustrates the address of the valid mode changer extracted when the first step ($step_{MCU}$=1), and FIG. 16 illustrates the address of the valid mode changer extracted in the second step ($step_{MCU}$=2).

In FIG. 15, when the first step ($step_{MCU}$=1) for determining the mode change device, all mode changers of the first mode change device 100-1 and the third mode change device 100-3 having the even identifiers operate in the cooling mode, and all mode changers of the second mode change device 100-2 having the odd identifiers operate in the off mode. Thereafter, it is detected that the first to sixth indoor units and the ninth to eleventh indoor units operate in the cooling mode.

Therefore, each of the plurality of indoor units 200 may delete the address of the mode changer operated in the operation mode that is not the same as the operation mode of the indoor unit 200 from the stored mode changer candidate group. For example, the first indoor unit may delete the address (11, 13) of the mode changer of the second mode change device 100-2, which is not operated in the cooling mode, and remain 01, 03, 05, 21, and 23 in the changer candidate group. The seventh indoor unit may delete the address (012, 023, 034, 045, 056/212, 223, 234) of the mode changer of the first mode change device 100-1 and the third mode change device 100-3 operated in the cooling mode and remain 112, 123, and 134.

In FIG. 16, when the second step ($step_{MCU}$=2), the identifiers of the mode change devices 100-1, 100-2, and 100-3 may be changed. Accordingly, the identifier of the second mode change device 100-2 may be changed to 0, and the identifier of the third mode change device 100-3 may be changed to 1. As in the first step ($step_{MCU}$=1), all mode changers of mode change devices with the even identifiers operate in the cooling mode, and all mode changers of mode change devices with the odd identifiers operate in the off mode.

The process of extracting the address of the valid mode changer by deleting the address of the mode changer by each of the plurality of indoor units 200 operated in the operation mode that is not the same as the operation mode of the indoor unit, is the same as the process of the first step.

As a result, after going through the mode change device determination step, the address of the mode changer stored in each of the plurality of indoor units 200 is as illustrated in FIG. 16. That is, only the address of the mode changer related to the mode change device to which each of the plurality of indoor units 200 is actually connected remains.

FIGS. 17 to 19 describe the mode changer determination step.

Since the mode change device to which each of the plurality of indoor units 200 is connected is determined in the mode changer candidate group, it is necessary to determine which mode changer is connected among the mode changers of each mode change device.

Referring to FIGS. 17 to 19, the second operation number Max $step_{PORT}$, which is the maximum number of steps for determining the mode changers 110A, 110B, and 110C, is 3, and the operation pattern of the mode changer for each $step_{PORT}$ is determined according to Equation 5 described above. FIGS. 17 to 19 illustrate the addresses of the valid mode changers extracted in the first step ($step_{PORT}$=1) to the third step ($step_{PORT}$=3) of the mode changer determination step.

Referring to FIG. 17, the operation patterns $V_{(2)}$ of the mode changers included in the first mode change device 100-1 to the third mode change device 100-3 in the first step ($step_{PORT}$=1) may be determined $110000_{(2)}$, $1000_{(2)}$, and $1000_{(2)}$, respectively. Therefore, the mode changer of address 01 and 02 among the mode changer of the first mode change device 100-1, the mode changer of address 11 of the mode changer among the second mode change device 100-2, and the mode changer of address 21 of the mode changer among the third mode change device 100-3 may operate in the cooling mode, which is the same operation mode as the operation mode of the outdoor unit 10, and all other mode changers operate in the off mode.

Thereafter, the first, second, seventh, and ninth indoor units may determine the cooling mode based on the temperature change of the indoor heat exchanger 210, and delete the address of the mode changer operated in the different operation mode. For example, the first indoor unit may delete addresses 03 and 05 of the mode changer operating in the off mode from the mode changer candidate group (01, 03, 05). Therefore, only 01 remains in the mode changer candidate group of the first indoor unit. Only the combined address 112 related to the mode changer 11 operated in the same operation mode as the seventh indoor unit remains in the mode changer candidate group of the seventh indoor unit.

Referring to FIG. 18, the operation pattern $V_{(2)}$ of the mode changer of each mode change device 100-1, 100-2, or 100-3 in the second step ($step_{PORT}$=2) may be determined $100001_{(2)}$, $0001_{(2)}$, $0001_{(2)}$, respectively. Each mode changer may operate in the same operation mode as the outdoor unit 10 according to the operation pattern, and the operation mode of each of the indoor units 200 may be detected. Each of the plurality of indoor units 200 may delete the address of the mode changer operating in the different operation mode from the mode changer candidate group, and extract the address of the remaining mode changer as the address of the valid mode changer.

Referring to FIG. 19, the operation pattern $V_{(2)}$ of the mode changer of each mode change device 100-1, 100-2, or 100-3 in the third step ($step_{PORT}$=3) may be determined $000011_{(2)}$, $0000_{(2)}$, $0000_{(2)}$, respectively. Each mode changer may operate in the same operation mode as the outdoor unit 10 according to the operation pattern, and the operation mode of each of the indoor units 200 may be detected. Each of the plurality of indoor units 200 may delete the address of the mode changer operating in the different operation mode from the mode changer candidate group, and extract the address of the remaining mode changer as the address of the valid mode changer.

Finally, each of the plurality of indoor units 200 may determine the address of the connected mode changer. In FIG. 19, since each of the plurality of indoor units 200 has one address of the extracted valid mode changer, it is determined as the branch duct connection information.

FIGS. 20 to 27 are views for describing an entire process of obtaining connection information between a plurality of indoor units and a plurality of mode changers when an outdoor unit is in a main cooling mode.

FIGS. 20 to 23 illustrate the process of determining the mode changer candidate group when the outdoor unit 10 is in the main cooling mode. When the outdoor unit 10 is in the main heating mode, the changing valves 111A, 111B, and 111C of the plurality of mode changers 110A, 110B, and 110C may be controlled opposite to that in the main cooling mode. Therefore, in order to avoid overlapping description, the description will be made based on the case where the outdoor unit 10 is in the main cooling mode.

The outdoor unit 10 may initialize the connection information set in the mode changers 110A, 110B, and 110C of the plurality of indoor units 200 and the plurality of mode change devices 100-1, 100-2, and 100-3. Since resetting the addresses of the mode change devices 100-1, 100-2, and 100-3 and the addresses of the mode changers 110A, 110B, and 110C has been described in FIG. 11, and thus redundant description will be omitted.

When the outdoor unit 10 is in the main cooling mode, the identifier of the mode change device may be used in the process of determining the mode changer candidate group. The contents related to this have been described in FIG. 8.

FIG. 20 illustrates the first mode changer candidate group saved step. In the first mode changer candidate group saved step, according to the control of the outdoor unit 10, the mode change device having the even identifier among the plurality of mode change devices 100-1, 100-2, and 100-3 may operate in the cooling mode, and the mode change device having the odd identifier may operate in the heating mode. That is, the mode changers 110A of the first mode change device 100-1 and the third mode change device 100-3 having the even identifier (0, 2) may operate in the cooling mode, and the mode changers 110A of the second mode change device 100-2 having the odd identifier (1) may operate in the heating mode.

Each of the plurality of indoor units 200 in which the temperature change of the indoor heat exchanger 210 is detected may store the address of the mode changer operating in the same operation mode as that of each of the indoor units 200.

As illustrated in FIG. 20, in the first mode changer candidate group saved step, the addresses of mode changers stored in each of the first to sixth indoor units and the ninth to eleventh indoor units may be 01, 02, 03, 04, 05, 06/21, 22, 23, and 24. The addresses of mode changers stored in the seventh indoor unit and the eighth indoor unit may be 11, 12, 13, and 14.

FIGS. 21 and 22 illustrate the second mode changer candidate group saved step.

Referring to FIGS. 21 and 22, the identifiers of each of the plurality of mode change devices 100-1, 100-2, and 100-3 may be changed in the second mode changer candidate group saved step. According to Equation 1, in the second mode changer candidate group saved step, the identifier of the first mode change device 100-1 may be changed to 0, the identifier of the second mode change device 100-2 may be changed to 0, and the identifier of the third mode change device 100-3 may be changed to 1.

Referring to FIG. 21, the plurality of mode change devices 100-1, 100-2, and 100-3 may control the odd mode changer of the mode change device having the even identifier to operate in the cooling mode and the odd mode changer of the mode change device having the odd identifier to operate in the cooling mode. Therefore, the mode changer with addresses 01, 03, 05, 11, 13 may operate in the cooling mode, and the mode changer with addresses 21, 23 may operate in the heating mode. All even mode changers 02, 04, 06, 12, 14, 22, and 24 may operate in the off mode.

Each of the plurality of indoor units 200 may detect the temperature change of the indoor heat exchanger 210 and store the address of the mode changer operating in the same operation mode as that of the indoor unit 200. Therefore, the addresses of the mode changer stored in each of the first, third, fifth, seventh and eighth indoor units may be 01, 03, 05, 11, and 13. The addresses of mode changers stored in each of the ninth and tenth indoor units may be 21 and 23.

Referring to FIG. 22, the plurality of mode change devices 100-1, 100-2, and 100-3 may control the even mode changer of the mode change device having the even identifier to operate in the cooling mode and the even mode changer of the mode change device having the odd identifier to operate in the cooling mode. Therefore, the mode changer with addresses 02, 04, 06, 12, 14 may operate in the cooling mode, and the mode changer with addresses 22, 24 may operate in the heating mode. All even mode changers 01, 03, 05, 11, 13, 21, and 23 may operate in the off mode.

Each of the plurality of indoor units 200 may detect the temperature change of the indoor heat exchanger 210 and store the address of the mode changer operating in the same operation mode as that of the indoor unit 200. Therefore, the addresses of the mode changer stored in each of the second, fourth, sixth, seventh and eighth indoor units may be 02, 04, 06, 12, and 14. The addresses of mode changers stored in each of the ninth and tenth indoor units may be 22 and 24.

FIG. 23 illustrates the step of determining the mode changer when the outdoor unit 10 operates in the main cooling mode.

Referring to FIG. 23, each of the plurality of indoor units 200 may determine the number of mode changers connected to each of the indoor units 200 based on the number of times each of the plurality of indoor units 200 operate in the second mode changer candidate group saved step.

Since the first to sixth indoor units, the tenth indoor units, and the eleventh indoor units operate only once in the second mode changer candidate group saved step, it is determined that they are connected to one mode changer. In addition, since the seventh to ninth indoor units operate twice in the second mode changer candidate group saved step, it is determined that they are connected to two mode changers.

In addition, each of the plurality of indoor units 200 may compare the first saved address stored for each of the plurality of indoor units 200 in the first mode changer candidate group saved step with the second saved address, which is the address of the odd mode changer in each of the plurality of indoor units 200 in the second mode changer candidate group saved step, or the third saved address, which is the address of the even mode changer, and may determine the mode changer candidate group by detecting the address of the redundantly saved mode changer.

Therefore, the first, third, and fifth indoors may determine the mode changer candidate group as 01, 03, and 05, and the second, fourth, and sixth indoors may determine the mode changer candidate group as 02, 04, and 06. The tenth indoor unit may determine the mode changer candidate groups as 21 and 23, and the eleventh indoor unit may determine the mode changer candidate groups as 22 and 24.

The seventh, eighth, and ninth indoor units may determine the mode changer candidate group as the 'combined address'. That is, the seventh and eighth indoor units may determine the mode changer candidate group as 112, 123, and 134, and the ninth indoor unit may determine the mode changer candidate group as 212, 223, and 234.

FIG. 24 illustrates the mode change device determination step when the outdoor unit operates in the main cooling mode. The method of extracting the address of the valid mode changer in the mode change device determination step will be as described in FIG. 9.

Since the air conditioner 1 includes three mode change devices 100-1, 100-2, and 100-3, the first operation number Max $step_{MCU}$ according to Equation 2 may be calculated less than 0 ($\log_2 3-2=-0.415$). Therefore, the mode change device determination step may be omitted. However, when the outdoor unit 10 operates in the main cooling mode, if the number of mode change devices is 5 or more, the mode change device determination step may be performed.

For reference, referring to FIGS. 23 and 24, it may be determined that each of the indoor units 200 is already connected to one mode change device in the mode changer candidate group determination step, and the mode change device determination step may be omitted.

FIGS. 25 to 27 illustrate the mode changer determination step when the outdoor unit operates in the main cooling mode.

Referring to FIGS. 25 to 27, the second operation number Max $step_{PORT}$, which is the maximum number of steps for determining the mode changers may be 3, and the operation pattern of the mode changer for each $step_{PORT}$ may be determined according to Equation 5 described above. FIGS. 25 to 27 illustrate the addresses of the valid mode changers extracted in the first step ($step_{PORT}=1$) to the third step ($step_{PORT}=3$) of the mode changer determination step.

Referring to FIG. 25, the operation patterns $V_{(2)}$ of the mode changers included in the first mode change device 100-1 to the third mode change device 100-3 in the first step ($step_{PORT}=1$) may be determined $110000_{(2)}$, $1000_{(2)}$, and $1000_{(2)}$, respectively. Therefore, the mode changer of address 01 and 02 among the mode changer of the first mode change device 100-1, the mode changer of address 11 of the mode changer among the second mode change device 100-2, and the mode changer of address 21 of the mode changer among the third mode change device 100-3 may be operated.

Since the outdoor unit 10 is operating in the main cooling mode, the mode changer (01, 02) included in the first mode change device 100-1 having the even address and the mode changer 21 included in the third mode change device 100-3 may operate in the cooling mode, and the mode changer 11 included in the second mode change device 100-2 having the odd address may operate in the heating mode.

Thereafter, it is detected that the first, second, seventh, ninth indoor units operate in the cooling mode, and each of the indoor units 200 deletes the address of the mode changer operated in the different operation mode from the mode changer candidate group. For example, the first indoor unit may delete the addresses 03 and 05 of the mode changer operated in the off mode from the mode changer candidate group (01, 03, 05), and remain only 01 in the mode changer candidate group of the first indoor unit. Only the combined address related to the mode changer 11 operated in the same operation mode as the seventh indoor unit remains in the mode changer candidate group of the seventh indoor unit.

Referring to FIG. 26, the operation pattern $V_{(2)}$ of the mode changer of each mode change device 100-1, 100-2, or 100-3 in the second step ($step_{PORT}=2$) may be determined $100001_{(2)}$, $0001_{(2)}$, $0001_{(2)}$, respectively. According to the operation pattern, the mode changers 01 and 06 included in the first mode change device 100-1 having the even address and the mode changer 24 included in the third mode change device 100-3 may operate in the cooling mode. The mode changer 14 included in the second mode change device 100-2 having the odd address may operate in the heating mode.

After that, each operation mode of the indoor unit may be detected, and the address of the mode changer operated in the operation mode that is not the same as that of each indoor unit may be deleted from the mode changer candidate group, and the address of the valid mode changer may be extracted.

Referring to FIG. 19, the operation pattern $V_{(2)}$ of the mode changer of each mode change device 100-1, 100-2, or 100-3 in the third step ($step_{PORT}=3$) may be determined $000011_{(2)}$, $0000_{(2)}$, $0000_{(2)}$, respectively. According to the operation pattern, the mode changers 05 and 06 included in the first mode change device 100-1 having the even address may be operated. After that, each operation mode of the indoor unit may be detected, and the address of the mode changer operated in the operation mode that is not the same as that of each indoor unit may be deleted from the mode changer candidate group, and the address of the valid mode changer may be extracted.

Finally, each of the plurality of indoor units 200 may determine the address of the connected mode changer. In FIG. 27, since each of the plurality of indoor units 200 has one address of the extracted valid mode changer, it is determined as the branch duct connection information.

FIG. 28 is a view for describing another example of a process of extracting an address of a valid mode changer when an outdoor unit is in a main cooling mode. Compared with FIG. 26, FIG. 28 illustrates that when the outdoor unit 10 is in the main cooling mode, operation modes of mode changers are set differently in the second ($step_{PORT}=2$) of the mode changer determination step.

Particularly, as described in FIG. 10, the outdoor unit 10, in order to increase the temperature change of the indoor heat exchanger 210 in the mode changer determination step, the changing valves 111A, 111B, and 111C of the mode changers 110A, 110B, and 110C may be controller to operate alternately for each $step_{PORT}$.

FIGS. 29 to 32 are views for describing a method of extracting an address of a valid mode changer according to another embodiment.

First, it is assumed that the controller 101 of each of the plurality of mode change devices 100-1, 100-2, and 100-3 recognizes the number of mode changers 110A, 110B, and 110C included in each mode change device. When the controller 101 recognizes the number of mode changers 110A of each mode change device 100-1, 100-2, or 100-3, the mode changer determination step may be performed by setting the mode change device with a large number of mode changers 110A as a priority. Accordingly, the number and time required for obtaining the connection information between the plurality of indoor units 200 and the plurality of branch ducts may be shortened.

The outdoor unit 10 may set the address of the mode change device in an order in which the number of mode changers is large in the step of initializing the connection information and resetting the address of each mode change device.

In order to classify the mode change device having the large number of mode changers, a method of setting a group for the plurality of mode change devices 100-1, 100-2, and 100-3 may be used. Particularly, the plurality of mode change devices 100-1, 100-2, and 100-3 may be divided into two groups (group A or group B) according to a predetermined group setting rule. According to the operation mode of the outdoor unit 10, the address of the valid mode changer may be extracted while operating by setting the operation mode of the mode change device belonging to group A and group B differently.

Then, the process of extracting the address of the valid mode changer may be repeated by dividing the group A into two groups again, operating the mode change devices belonging to each group in different operation modes, and extracting the address of the valid mode changer.

When the operation mode of the outdoor unit 10 is the cooling mode or the heating mode, the outdoor unit 10 may control all mode changers included in each of the mode change devices belonging to group A to operate in the cooling mode or the heating mode, and control all mode changers included in each of the mode change devices belonging to group B to operate in the off mode.

In addition, when the operation mode of the outdoor unit 10 is the main cooling mode (or main heating mode), according to the control of the outdoor unit 10, the mode change device belonging to group A and the mode change device belonging to group B may operate in opposite operation modes. In other words, the mode change device belonging to group A may control all mode changers included in each to operate in the cooling mode (or heating mode), and the mode change device belonging to group B may control all mode changers included in each to operate in the heating mode (or cooling mode).

A reference for dividing the group are determined by Equation 7 below.

$$GR=\mathrm{ABS}[\{\mathrm{Log}_2 n(\mathrm{PORT}_{GroupA})+MP(\mathrm{PORT}_{GroupA})/2\}-\{\mathrm{Log}_2 n(\mathrm{PORT}_{GroupB})+MP(\mathrm{PORT}_{GroupB})/2\}]$$

$$\mathrm{PORT}_{GroupMain}=\mathrm{PORT}_{GroupA}+\mathrm{PORT}_{GroupB}$$

Here, $\mathrm{PORT}_{GroupA}$ and $\mathrm{PORT}_{GroupB}$ are sets of the number of mode changers of each mode change device in group A and group B. $\mathrm{MP}(\mathrm{PORT}_{GroupA})$ and $\mathrm{MP}(\mathrm{PORT}_{GroupB})$ are maximum values in each set. $n(\mathrm{PORT}_{GroupA})$ and $n(\mathrm{PORT}_{GroupB})$ are the number of elements in each set. $\mathrm{PORT}_{GroupMain}$ is a whole set.

Group setting for the mode change device may be performed so that the value of GR according to Equation 7 is minimized.

Figure 29:
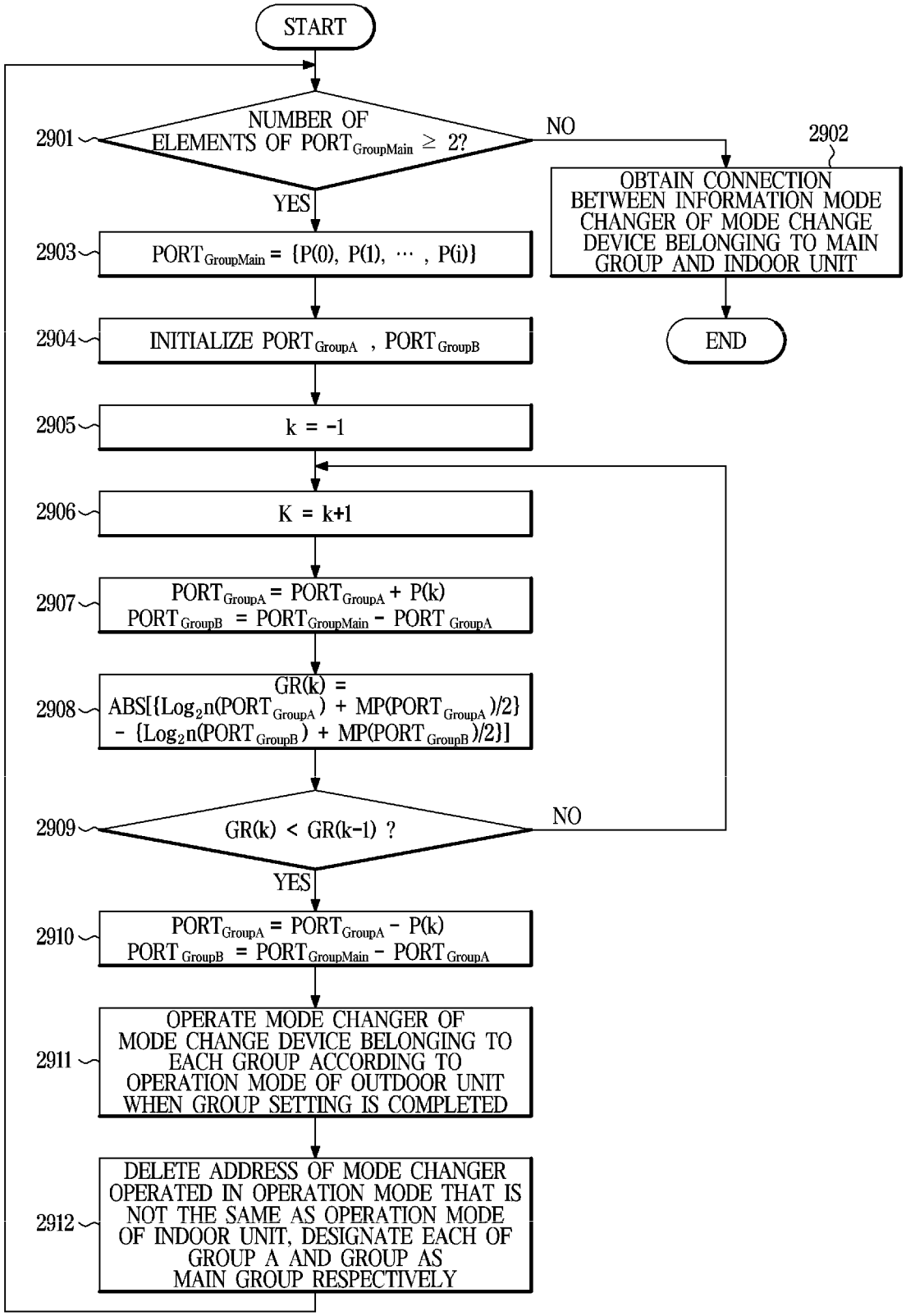

Referring to FIG. 29, the outdoor unit 10 may determine whether the number of elements of $\mathrm{PORT}_{GroupMain}$ is 2 or more (2901). When the number of elements of $\mathrm{PORT}_{GroupMain}$ is less than 2, that is, when there is one mode change device, the process of obtaining the connection information between the mode changer of the corresponding mode change device and the plurality of indoor units 200 may be performed (2902).

When the number of elements of $\mathrm{PORT}_{GroupMain}$ is 2 or more, a set of the number of mode changers included in each mode change device may be generated (2903). P(0) is the number of mode changers of the mode change device whose address is 0, and P(i) is the number of mode changers of the mode change device whose address is i.

$\mathrm{PORT}_{GroupA}$ and $\mathrm{PORT}_{GroupB}$ may be initialized for group setting (2904). K denotes each step according to the number of repetitions when the group setting is repeated. Since K=k+1 and k=−1, K starts from 0 (2905, 2906). P(k) is included in $\mathrm{PORT}_{GroupA}$, and the rest of the set is included in $\mathrm{PORT}_{GroupB}$ (2907). According to Equation 7, a case where the GR value becomes the minimum is found and the group may be set (2908, 2909, 2910). When the group setting is completed, the mode changer of the mode change device belonging to each group may be operated according to the operation mode of the outdoor unit 10 (2911). Thereafter, from the mode changer candidate group of each of the plurality of indoor units 200, the address of the mode changer operated in the operation mode that is not the same as the operation mode of the indoor unit may be deleted, and $\mathrm{PORT}_{GroupA}$ and $\mathrm{PORT}_{GroupB}$ are respectively set to $\mathrm{PORT}_{GroupMain}$ (2912). The group setting is repeated until the number of elements in $\mathrm{PORT}_{GroupMain}$ becomes 1.

Figure 30:
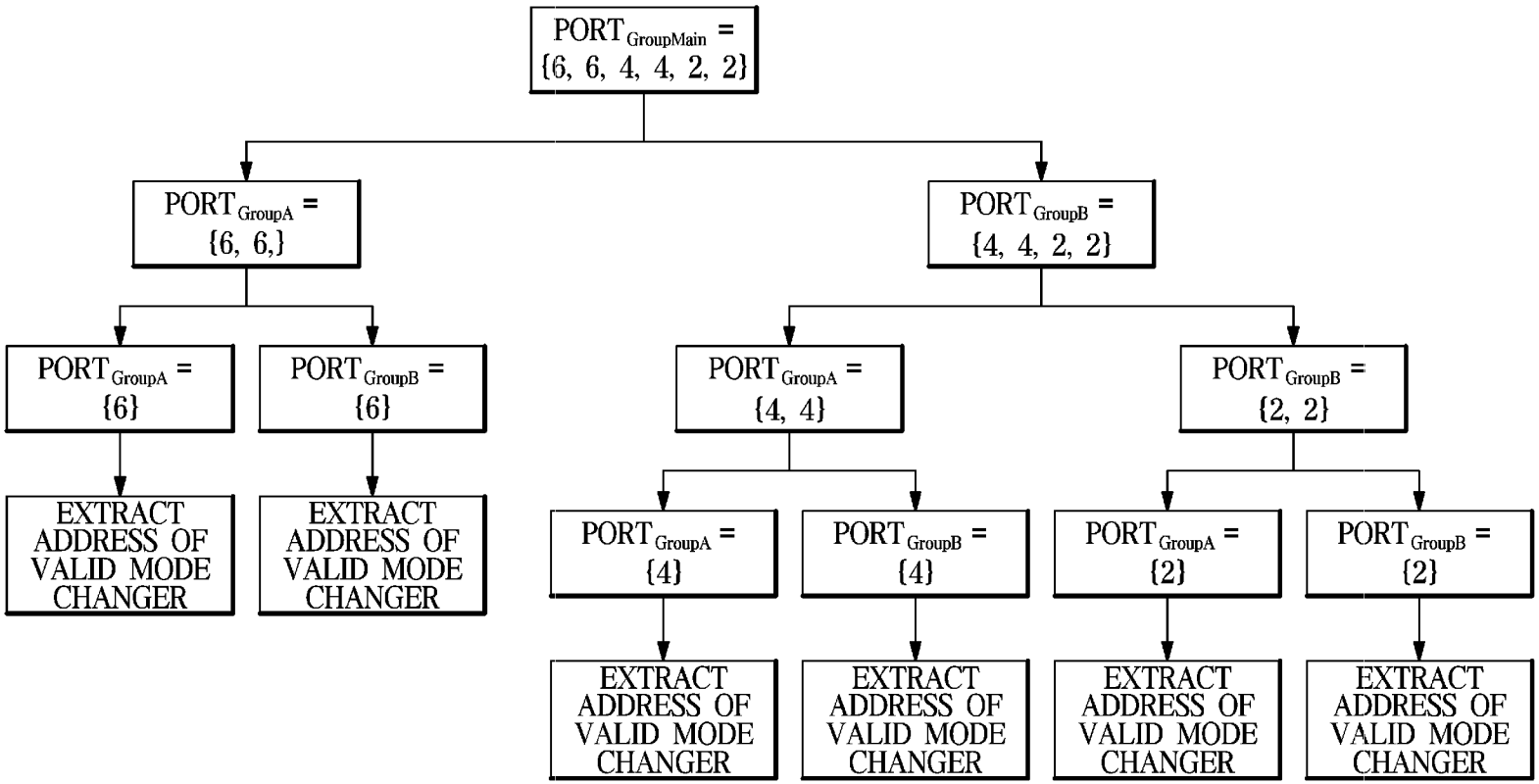

FIG. 30 schematically illustrates a process in which group setting is performed when the number of mode change devices is six.

FIGS. 31 and 32 illustrate a process in which the address of the valid mode changer is extracted according to the group setting when the number of mode change devices is three. FIG. 31 is a process after the mode changer candidate group determination step of FIG. 14.

Referring to FIG. 31, the air conditioner 1 includes the first mode change device 100-1, the second mode change device 100-2, and the third mode change device 100-3, and the number of mode changers of the each mode change device is 6, 4, and 4, respectively. The first mode change device 100-1 with the number of mode changers of 6 is set as group A, and the second mode change device 100-2 and the third mode change device 100-3 with the number of mode changers of 4 are set as group B so that the GR value is minimum according to Equation 7.

Since the operation mode of the outdoor unit 10 is the cooling mode, all mode changers of the first mode change device 100-1 belonging to group A may operate in the cooling mode, and all mode changers of the second mode change device 100-2 and the third mode change device 100-3 belonging to group B may operate in the off mode.

It is detected that the first to sixth indoor units operate in the cooling mode, and in the mode changer candidate group of each of the plurality of indoor units 200, the address of the mode changer operated in the operation mode that is not the same as the operation mode of each indoor unit is deleted. Accordingly, it is determined that each of the first to sixth indoor units is connected to the first mode change device 100-1.

Since only one mode change device belonging to group A is the first mode change device 100-1, the mode changer determination step may be performed.

Referring to FIG. 32, the group setting may be performed again for the second mode change device 100-2 and the third mode change device 100-3 belonging to group B, and the address of a valid mode changer may be extracted. As a result, it is determined that the seventh indoor unit and the eighth indoor unit are connected to the second mode change device 100-2, and the ninth indoor unit to the eleventh indoor unit are connected to the third mode change device 100-3.

Thereafter, since the number of mode change devices belonging to group A and group B is 1, each mode change device may enter the mode changer determination step.

As described above, according to the air conditioner and the method of controlling the air conditioner of the present disclosure, how each of the plurality of indoor units is connected to the mode change device can be promptly and accurately determined automatically.

According to the air conditioner and the method of controlling the air conditioner, indoor units can be simultaneously operated to determine how each of the indoor units is connected to the mode change device, and accordingly, how each of the indoor units is connected to the mode change device can be more promptly determined in comparison to a case in which the indoor units are sequentially operated.

According to the air conditioner and the method of controlling the air conditioner, since the user does not need to individually input information on the connection state between the plurality of indoor units and the mode change device, it is possible to prevent misconfiguration by the user and improve the convenience of use.

According to the air conditioner and the method of controlling the air conditioner, it is possible to obtain connection information between the plurality of indoor units and the mode change devices with the least number of steps, so that an effect of improving operation efficiency can be obtained.

The method of controlling the air conditioner according to the above-described embodiments may be implemented in the form of a program that may be executed by various computer devices. Here, the program may include a program command, a data file, a data structure, and the like solely or in combination. The program may be designed and produced using machine language codes or high-level language codes. The program may be particularly designed to implement the above-described method of controlling an air conditioner or may be implemented using various functions or definitions that are known and usable by one of ordinary skill in the computer software art.

The program for implementing the method of controlling the air conditioner may be recorded in a computer readable recording medium. For example, the computer readable recording medium may include various types of hardware devices capable of storing particular programs executed according to call from a computer and the like such as magnetic disk storage media such as a hard disk and a floppy disk, a magnetic tape, optical media such as a compact disk (CD) or a digital versatile disk (DVD), magneto-optical media such as a floptical disk, and semiconductor storage devices such as a ROM, a RAM, or a flash memory.

Although various embodiments of the air conditioner, a control device thereof, and a method of controlling the same have been described above, the air conditioner, a control device thereof, and a method of controlling the same are not limited to the above-described embodiments. Various embodiments that may be implemented by one of ordinary skill in the art by modifying and changing the above-described embodiments may also be examples of the above-described air conditioner, control device thereof, and method of controlling the same. For example, even when the above-described techniques are performed in a different order from the above-described method, and/or the above-described elements such as a system, a structure, a device, and a circuit are coupled or combined in a different form from the above-described method, or substituted by other elements or their equivalents, like or similar results as the above-described air conditioner, control device thereof, and method of controlling the same may be obtained.

The invention claimed is:

1. An air conditioner comprising:

an outdoor unit comprising a processor configured to generate a control signal;

a plurality of mode change devices connected to the outdoor unit, including at least one mode changer including a branch duct and a changing valve, and configured to receive the control signal from processor of the outdoor unit to control an operation of the at least one mode changer; and a plurality of indoor units connected to the outdoor unit or the plurality of mode change devices, each of the plurality of indoor units comprising a processor and an indoor heat exchanger, wherein the processor of the outdoor unit is configured to:

set an address and an identifier to each of the plurality of mode change devices, set an address to the at least one mode changer included in each of the plurality of mode change devices, and based on the set identifier of the mode change device and the set address of the at least one mode changer, determine an operation mode of the plurality of mode change devices and an operation mode of the plurality of mode changers to operate the plurality of mode change devices a plurality of times; and wherein the processor of each of the plurality of indoor units is configured to:

detect a temperature change of an indoor heat exchanger in response to the operation of the plurality of mode change devices, determine a number of the mode changers that are connected and a mode changer candidate group of the mode changers that are connectable based on the temperature change of the indoor heat exchanger, and extract and store the address of a valid mode changer, which is a mode changer related to the temperature change of the indoor heat exchanger, from the determined mode changer candidate group and obtain branch duct connection information.

2. The air conditioner according to claim 1, wherein the outdoor unit is configured to operate all of the mode changers, and then sequentially operate an odd mode changer having an odd address and an even mode changer having an even address of the mode changers; and wherein the each of the plurality of indoor units is configured to:

store the address of the mode changer related to the temperature change of the indoor heat exchanger as a first saved address after the operation of all the mode changers, store the address of the mode changer related to the temperature change of the indoor heat exchanger as a second saved address after the operation of the odd mode changer, and store the address of the mode changer related to the temperature change of the indoor heat exchanger as a third saved address after the operation of the even mode changer.

3. The air conditioner according to claim 2, wherein the each of the plurality of indoor units is configured to:

determine the number of the connected mode changers by detecting the number of times of operations corresponding to the operation of the odd mode changer and the operation of the even mode changer, and compare the first saved address, the second saved address, and the third saved address, and detect the address of a redundantly stored mode changer to determine the mode changer candidate group.

4. The air conditioner according to claim 1, wherein the outdoor unit is configured to:

operate the plurality of mode change devices by determining a first operation number for the plurality of mode change devices based on the number of the plurality of mode change devices, and determine the operation mode of each of the plurality of mode change devices based on the identifier of the mode change device that changes for each step; and wherein the each of the plurality of indoor units is configured to extract the address of the valid mode changer by comparing the temperature change of the indoor heat exchanger with the operation mode of the mode changers for each step in which the plurality of mode change devices are operated.

5. The air conditioner according to claim 4, wherein the outdoor unit is further configured to:

operate each of the plurality of mode change devices by determining a second operation number for each of the plurality of mode change devices based on the number of mode changers included in each of the plurality of mode change devices, and operate the mode changer of each of the plurality of mode change devices according to a predetermined operation pattern for each operation step; and wherein the each of the plurality of indoor units is further configured to extract the address of the valid mode changer by comparing the temperature change of the indoor heat exchanger with the operation mode of the mode changers for each step in which each of the plurality of mode change devices is operated.

6. The air conditioner according to claim 5, wherein the each of the plurality of indoor units is configured to determine the address of the valid mode changer as the branch duct connection information in response to a case where the address of the extracted valid mode changer is one.

7. The air conditioner according to claim 5, wherein the each of the plurality of indoor units is configured to determine to be directly connected to the outdoor unit in response to a case where there is no address of the extracted valid mode changer.

8. The air conditioner according to claim 1, wherein the outdoor unit is further configured to:

set the plurality of mode change devices as a first group or a second group based on the number of the mode changers included in each of the plurality of mode change devices, and operate the plurality of mode change devices by setting the operation mode of the first group and the operation mode of the second group differently; and wherein the each of the plurality of indoor units is further configured to extract the address of the valid mode changer by comparing the temperature change of the indoor heat exchanger with the operation mode of the mode changer of the first group and the operation mode of the mode changer of the second group.

9. The air conditioner according to claim 8, wherein the outdoor unit is configured to repeat setting the first group and the second group as two groups again until a number of elements in each of the first group and the second group is one.

10. The air conditioner according to claim 8, wherein the outdoor unit is further configured to:

operate the mode change device of the first group or the mode change device of the second group by a predetermined number of steps in response to a case where a number of elements in the first group or the number of elements in the second group is one, and operate the mode changer of the mode change device of the first group or the mode changer of the mode change device of the second group according to a predetermined operation pattern; and wherein the each of the plurality of indoor units is further configured to extract the address of the valid mode changer by comparing the temperature change of the indoor heat exchanger with the operation mode of the mode changer of the first group or the operation mode of the mode changer of the second group each step the mode change device of the first group or the mode change device of the second group is operated.

11. An air conditioner comprising:

an outdoor unit comprising a processor configured to generate a control signal;

a mode change device connected to the outdoor unit, including a plurality of mode changers including a branch duct and a changing valve, and configured to receive a control signal from the processor of the outdoor unit to control an operation of the plurality of mode changers; and a plurality of indoor units connected to the outdoor unit or the plurality of mode change devices and each of the plurality of indoor units comprising a processor and an indoor heat exchanger, wherein the processor of the outdoor unit is configured to:

set an address and an identifier to each of the plurality of mode change devices, set an address to at least one mode changer included in each of the plurality of mode change devices, and based on the set identifier of the mode change device and the set address of the mode changer, determine an operation mode of the mode change device and an operation mode of the plurality of mode changers to operate the mode change device a plurality of times; and wherein the processor of each of the plurality of indoor units is configured to:

detect a temperature change of an indoor heat exchanger in response to the operation of the mode change device, determine a number of the mode changers that are connected and a mode changer candidate group of the mode changers that are connectable based on the temperature change of the indoor heat exchanger, and extract and store the address of a valid mode changer, which is a mode changer related to the temperature change of the indoor heat exchanger, from the determined mode changer candidate group and obtain branch duct connection information.

12. A method of controlling an air conditioner, the air conditioner including an outdoor unit, a plurality of mode change devices connected to the outdoor unit, and a plurality of indoor units connected to the outdoor unit or the plurality of mode change devices, the method comprising:

operating the plurality of mode change devices in an operation mode determined by the outdoor unit;

setting an address and an identifier to each of the plurality of mode change devices;

setting an address to a plurality of mode changers included in the plurality of mode change devices;

determining an operation mode of the plurality of mode change devices and operation modes of the plurality of mode changers based on the set identifier of the plurality of mode change devices and the set address of the plurality of mode changers;

detecting a temperature change of an indoor heat exchanger included in each of the plurality of indoor units in response to the operation of the plurality of mode change devices;

determining a number of mode changers connected to each of the plurality of indoor units and a mode changer candidate group of mode changers that are connectable to each of the plurality of indoor units based on temperature changes of the indoor heat exchangers of each of the plurality of indoor units; and extracting and storing the address of a valid mode changer from the mode changer, which is a mode changer related to the temperature change of the indoor heat exchanger, candidate group and obtaining branch duct connection information for each of the plurality of indoor units.

13. The method according to claim 12, wherein the operating of the plurality of mode change devices further comprises:

determining a first operation number determined based on the number of the plurality of mode change devices and a second operation number for each of the plurality of mode change devices based on the number of mode changers included in each of the plurality of mode change devices, and operating the plurality of mode change devices a plurality of times; and wherein the obtaining of the branch duct connection information comprises:

extracting an address of the valid mode changer by comparing the temperature change of the indoor heat exchanger with operation modes of the mode changers for each operation of the plurality of mode change devices.

* * * * *